US011335280B2

(12) United States Patent
Sato et al.

(10) Patent No.: US 11,335,280 B2
(45) Date of Patent: May 17, 2022

(54) DISPLAY DEVICE, TERMINAL DEVICE, AND DRIVING METHOD WITH A MEMORY FUNCTION FOR TEMPERATURE ACQUISITION AND WAVEFORM SELECTION

(71) Applicant: TIANMA MICROELECTRONICS CO., LTD., Shenzhen (CN)

(72) Inventors: Tetsushi Sato, Kawasaki (JP); Kazunori Masumura, Kawasaki (JP); Koji Shigemura, Kawasaki (JP)

(73) Assignee: TIANMA MICROELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 16/994,121

(22) Filed: Aug. 14, 2020

(65) Prior Publication Data

US 2020/0388231 A1 Dec. 10, 2020

Related U.S. Application Data

(62) Division of application No. 15/168,892, filed on May 31, 2016, now Pat. No. 10,783,839.

(30) Foreign Application Priority Data

Jun. 1, 2015 (JP) ..... 2015-111565
Mar. 22, 2016 (JP) ..... 2016-057575

(51) Int. Cl.
*G09G 3/34* (2006.01)

(52) U.S. Cl.
CPC ..... *G09G 3/344* (2013.01); *G09G 2320/041* (2013.01); *G09G 2330/00* (2013.01); *G09G 2330/045* (2013.01)

(58) Field of Classification Search
None
See application file for complete search history.

(56) References Cited

U.S. PATENT DOCUMENTS

2007/0052665 A1 3/2007 Zhou et al.
2007/0139358 A1 6/2007 Sakamoto
(Continued)

FOREIGN PATENT DOCUMENTS

JP 2001-109420 A 4/2001
JP 2007-163987 A 6/2007
(Continued)

OTHER PUBLICATIONS

Notice of Reasons for Refusal dated Feb. 25, 2020 from the Japanese Patent Office in application No. 2016-057575.

*Primary Examiner* — Amare Mengistu
*Assistant Examiner* — Sarvesh J Nadkarni
(74) *Attorney, Agent, or Firm* — Sughrue Mion, PLLC

(57) ABSTRACT

An image update determining unit compares a previously set temperature with a temperature estimated by a temperature increase estimating unit, and determines whether or not an image update operation is executable, and an image update interval is appropriately set according to the estimated temperature by performing image update on an image to be displayed next when the image update determining unit determines the image update operation to be executable but not performing image update when the image update determining unit determines the image update operation to be non-executable.

4 Claims, 72 Drawing Sheets

(56) References Cited

U.S. PATENT DOCUMENTS

| | | | | |
|---|---|---|---|---|
| 2012/0200610 | A1 | 8/2012 | Sakamoto et al. | |
| 2014/0285479 | A1* | 9/2014 | Yamada | G09G 3/344 345/212 |
| 2015/0206479 | A1* | 7/2015 | Maeda | G09G 3/344 345/107 |
| 2016/0275874 | A1* | 9/2016 | Lin | G09G 3/2003 |
| 2018/0122306 | A1* | 5/2018 | Lin | G09G 3/344 |

FOREIGN PATENT DOCUMENTS

| | | | |
|---|---|---|---|
| JP | 2012-181507 | A | 9/2012 |
| JP | 2012-194252 | A | 10/2012 |

* cited by examiner

FIG. 13

| IMAGE PATTERN | t0~t1 | t1~t2 | t2~t3 | t3~tG | tG~t4 |
|---|---|---|---|---|---|
| ALL WHITE | +15 +15 +15 +15<br>+15 +15 +15 +15<br>+15 +15 +15 +15 | -15 -15 -15 -15<br>-15 -15 -15 -15<br>-15 -15 -15 -15 | +15 +15 +15 +15<br>+15 +15 +15 +15<br>+15 +15 +15 +15 | -15 -15 -15 -15<br>-15 -15 -15 -15<br>-15 -15 -15 -15 | -15 -15 -15 -15<br>-15 -15 -15 -15<br>-15 -15 -15 -15 |
| ALL LG | +15 +15 +15 +15<br>+15 +15 +15 +15<br>+15 +15 +15 +15 | -15 -15 -15 -15<br>-15 -15 -15 -15<br>-15 -15 -15 -15 | +15 +15 +15 +15<br>+15 +15 +15 +15<br>+15 +15 +15 +15 | -15 -15 -15 -15<br>-15 -15 -15 -15<br>-15 -15 -15 -15 | 0 0 0 0<br>0 0 0 0<br>0 0 0 0 |
| WHITE LG CHECK | +15 +15 +15 +15<br>+15 +15 +15 +15<br>+15 +15 +15 +15 | -15 -15 -15 -15<br>-15 -15 -15 -15<br>-15 -15 -15 -15 | +15 +15 +15 +15<br>+15 +15 +15 +15<br>+15 +15 +15 +15 | -15 -15 -15 -15<br>-15 -15 -15 -15<br>-15 -15 -15 -15 | -15 0 -15 0<br>0 -15 0 -15<br>-15 0 -15 0 |
| LG BLACK CHECK | +15 -15 +15 -15<br>-15 +15 -15 +15<br>+15 -15 +15 -15 | -15 +15 -15 +15<br>+15 -15 +15 -15<br>-15 +15 -15 +15 | +15 -15 +15 -15<br>-15 +15 -15 +15<br>+15 -15 +15 -15 | -15 +15 -15 +15<br>+15 -15 +15 -15<br>-15 +15 -15 +15 | 0 +15 0 +15<br>+15 0 +15 0<br>0 +15 0 +15 |
| WHITE/BLACK CHECK | +15 -15 +15 -15<br>-15 +15 -15 +15<br>+15 -15 +15 -15 | -15 +15 -15 +15<br>+15 -15 +15 -15<br>-15 +15 -15 +15 | +15 -15 +15 -15<br>-15 +15 -15 +15<br>+15 -15 +15 -15 | -15 +15 -15 +15<br>+15 -15 +15 -15<br>-15 +15 -15 +15 | -15 +15 -15 +15<br>+15 -15 +15 -15<br>-15 +15 -15 +15 |

FIG. 15

| IMAGE PATTERN | t0~t1 | t1~t2 | t2~t3 | t3~tg | tg~t4 |
|---|---|---|---|---|---|
| ALL WHITE | -15 -15 -15 -15<br>-15 -15 -15 -15<br>-15 -15 -15 -15 | +15 +15 +15 +15<br>+15 +15 +15 +15<br>+15 +15 +15 +15 | -15 -15 -15 -15<br>-15 -15 -15 -15<br>-15 -15 -15 -15 | 0 0 0 0<br>0 0 0 0<br>0 0 0 0 | 0 0 0 0<br>0 0 0 0<br>0 0 0 0 |
| ALL LG | +15 +15 +15 +15<br>+15 +15 +15 +15<br>+15 +15 +15 +15 | -15 -15 -15 -15<br>-15 -15 -15 -15<br>-15 -15 -15 -15 | +15 +15 +15 +15<br>+15 +15 +15 +15<br>+15 +15 +15 +15 | -15 -15 -15 -15<br>-15 -15 -15 -15<br>-15 -15 -15 -15 | 0 0 0 0<br>0 0 0 0<br>0 0 0 0 |
| WHITE LG CHECK | -15 +15 -15 +15<br>+15 -15 +15 -15<br>-15 +15 -15 +15 | +15 -15 +15 -15<br>-15 +15 -15 +15<br>+15 -15 +15 -15 | -15 +15 -15 +15<br>+15 -15 +15 -15<br>-15 +15 -15 +15 | 0 -15 0 -15<br>-15 0 -15 0<br>0 -15 0 -15 | 0 0 0 0<br>0 0 0 0<br>0 0 0 0 |
| LG BLACK CHECK | +15 +15 +15 +15<br>+15 +15 +15 +15<br>+15 +15 +15 +15 | -15 -15 -15 -15<br>-15 -15 -15 -15<br>-15 -15 -15 -15 | +15 +15 +15 +15<br>+15 +15 +15 +15<br>+15 +15 +15 +15 | -15 0 -15 0<br>0 -15 0 -15<br>-15 0 -15 0 | 0 0 0 0<br>0 0 0 0<br>0 0 0 0 |
| WHITE/BLACK CHECK | -15 +15 -15 +15<br>+15 -15 +15 -15<br>-15 +15 -15 +15 | +15 -15 +15 -15<br>-15 +15 -15 +15<br>+15 -15 +15 -15 | -15 +15 -15 +15<br>+15 -15 +15 -15<br>-15 +15 -15 +15 | 0 0 0 0<br>0 0 0 0<br>0 0 0 0 | 0 0 0 0<br>0 0 0 0<br>0 0 0 0 |

J=1, K=1

J=1, K=2

J=1, K=5

J=1, K=20

FIG. 17

| | | Tp | | | | | |
|---|---|---|---|---|---|---|---|
| | | 39～20[℃] | | 19～8[℃] | | 7～0[℃] | |
| | | DRIVING WAVEFORM (HIGH TEMPERATURE) | | DRIVING WAVEFORM (NORMAL TEMPERATURE) | | DRIVING WAVEFORM (LOW TEMPERATURE) | |
| | | Tα | Tβ | Tα | Tβ | Tα | Tβ |
| Ts | 81～85 [℃] | αH85 | βH85 | αN85 | βN85 | αL85 | βL85 |
| | 76～80 [℃] | αH80 | βH80 | αN80 | βN80 | αL80 | βL80 |
| | 71～75 [℃] | αH75 | βH75 | αN75 | βN75 | αL75 | βL75 |
| | 66～70 [℃] | αH70 | βH70 | αN70 | βN70 | αL70 | βL70 |
| | : | : | : | : | : | : | : |
| | 16～20 [℃] | αH20 | βH20 | αN20 | βN20 | αL20 | βL20 |
| | 11～15 [℃] | αH15 | βH15 | αN15 | βN15 | αL15 | βL15 |
| | 6 ～10 [℃] | αH10 | βH10 | αN10 | βN10 | αL10 | βL10 |
| | 1 ～ 5 [℃] | αH5 | βH5 | αN5 | βN5 | αL5 | βL5 |

FIG. 19

| | | Tp | | | | | | | | | | | | | | |
|---|---|---|---|---|---|---|---|---|---|---|---|---|---|---|---|---|
| | | DRIVING WAVEFORM (HIGH TEMPERATURE) | | | | | DRIVING WAVEFORM (NORMAL TEMPERATURE) | | | | | | DRIVING WAVEFORM (LOW TEMPERATURE) | | | |
| | | 39～26[℃] | | ･･ | 23～20[℃] | | 19～16[℃] | | 15～12[℃] | | 11～8[℃] | | 7～4[℃] | | 3～0[℃] | |
| | | Tα | Tβ | ･･ | Tα | Tβ | Tα | Tβ | Tα | Tβ | Tα | Tβ | Tα | Tβ | Tα | Tβ |
| Ts | 81～85 [℃] | $\alpha_{3985}$ | $\beta_{3985}$ | ･･ | $\alpha_{2385}$ | $\beta_{2385}$ | $\alpha_{1985}$ | $\beta_{1985}$ | $\alpha_{1585}$ | $\beta_{1585}$ | $\alpha_{1185}$ | $\beta_{1185}$ | $\alpha_{0785}$ | $\beta_{0785}$ | $\alpha_{0385}$ | $\beta_{0385}$ |
| | 76～80 [℃] | $\alpha_{3980}$ | $\beta_{3980}$ | ･･ | $\alpha_{2380}$ | $\beta_{2380}$ | $\alpha_{1980}$ | $\beta_{1980}$ | $\alpha_{1580}$ | $\beta_{1580}$ | $\alpha_{1180}$ | $\beta_{1180}$ | $\alpha_{0780}$ | $\beta_{0780}$ | $\alpha_{0380}$ | $\beta_{0380}$ |
| | 71～75 [℃] | $\alpha_{3975}$ | $\beta_{3975}$ | ･･ | $\alpha_{2375}$ | $\beta_{2375}$ | $\alpha_{1975}$ | $\beta_{1975}$ | $\alpha_{1575}$ | $\beta_{1575}$ | $\alpha_{1175}$ | $\beta_{1175}$ | $\alpha_{0775}$ | $\beta_{0775}$ | $\alpha_{0375}$ | $\beta_{0375}$ |
| | 66～70 [℃] | $\alpha_{3970}$ | $\beta_{3970}$ | ･･ | $\alpha_{2370}$ | $\beta_{2370}$ | $\alpha_{1970}$ | $\beta_{1970}$ | $\alpha_{1570}$ | $\beta_{1570}$ | $\alpha_{1170}$ | $\beta_{1170}$ | $\alpha_{0770}$ | $\beta_{0770}$ | $\alpha_{0370}$ | $\beta_{0370}$ |
| | ： | ： | ： | | ： | ： | ： | ： | ： | ： | ： | ： | ： | ： | ： | ： |
| | 16～20 [℃] | $\alpha_{3920}$ | $\beta_{3920}$ | ･･ | $\alpha_{2320}$ | $\beta_{2320}$ | $\alpha_{1920}$ | $\beta_{1920}$ | $\alpha_{1520}$ | $\beta_{1520}$ | $\alpha_{1120}$ | $\beta_{1120}$ | $\alpha_{0720}$ | $\beta_{0720}$ | $\alpha_{0320}$ | $\beta_{0320}$ |
| | 11～15 [℃] | $\alpha_{3915}$ | $\beta_{3915}$ | ･･ | $\alpha_{2315}$ | $\beta_{2315}$ | $\alpha_{1915}$ | $\beta_{1915}$ | $\alpha_{1515}$ | $\beta_{1515}$ | $\alpha_{1115}$ | $\beta_{1115}$ | $\alpha_{0715}$ | $\beta_{0715}$ | $\alpha_{0315}$ | $\beta_{0315}$ |
| | 6 ～10 [℃] | $\alpha_{3910}$ | $\beta_{3910}$ | ･･ | $\alpha_{2310}$ | $\beta_{2310}$ | $\alpha_{1910}$ | $\beta_{1910}$ | $\alpha_{1510}$ | $\beta_{1510}$ | $\alpha_{1110}$ | $\beta_{1110}$ | $\alpha_{0710}$ | $\beta_{0710}$ | $\alpha_{0310}$ | $\beta_{0310}$ |
| | 1 ～ 5 [℃] | $\alpha_{3905}$ | $\beta_{3905}$ | ･･ | $\alpha_{2305}$ | $\beta_{2305}$ | $\alpha_{1905}$ | $\beta_{1905}$ | $\alpha_{1505}$ | $\beta_{1505}$ | $\alpha_{1105}$ | $\beta_{1105}$ | $\alpha_{0705}$ | $\beta_{0705}$ | $\alpha_{0305}$ | $\beta_{0305}$ |

FIG. 20

| | | Tp | | | | | | | | | | | | | | |
|---|---|---|---|---|---|---|---|---|---|---|---|---|---|---|---|---|
| | | WF39 | | | WF23 | | WF19 | | WF15 | | WF11 | | WF07 | | WF03 | |
| | | 39～26[℃] | | ・・ | 23～20[℃] | | 19～16[℃] | | 15～12[℃] | | 11～8[℃] | | 7～4[℃] | | 3～0[℃] | |
| | | Tα | Tβ | ・・ | Tα | Tβ | Tα | Tβ | Tα | Tβ | Tα | Tβ | Tα | Tβ | Tα | Tβ |
| Ts | 81～85 [℃] | $\alpha_{3985}$ | $\beta_{3985}$ | ・・ | $\alpha_{2385}$ | $\beta_{2385}$ | $\alpha_{1985}$ | $\beta_{1985}$ | $\alpha_{1585}$ | $\beta_{1585}$ | $\alpha_{1185}$ | $\beta_{1185}$ | $\alpha_{0785}$ | $\beta_{0785}$ | $\alpha_{0385}$ | $\beta_{0385}$ |
| | 76～80 [℃] | $\alpha_{3980}$ | $\beta_{3980}$ | ・・ | $\alpha_{2380}$ | $\beta_{2380}$ | $\alpha_{1980}$ | $\beta_{1980}$ | $\alpha_{1580}$ | $\beta_{1580}$ | $\alpha_{1180}$ | $\beta_{1180}$ | $\alpha_{0780}$ | $\beta_{0780}$ | $\alpha_{0380}$ | $\beta_{0380}$ |
| | 71～75 [℃] | $\alpha_{3975}$ | $\beta_{3975}$ | ・・ | $\alpha_{2375}$ | $\beta_{2375}$ | $\alpha_{1975}$ | $\beta_{1975}$ | $\alpha_{1575}$ | $\beta_{1575}$ | $\alpha_{1175}$ | $\beta_{1175}$ | $\alpha_{0775}$ | $\beta_{0775}$ | $\alpha_{0375}$ | $\beta_{0375}$ |
| | 66～70 [℃] | $\alpha_{3970}$ | $\beta_{3970}$ | ・・ | $\alpha_{2370}$ | $\beta_{2370}$ | $\alpha_{1970}$ | $\beta_{1970}$ | $\alpha_{1570}$ | $\beta_{1570}$ | $\alpha_{1170}$ | $\beta_{1170}$ | $\alpha_{0770}$ | $\beta_{0770}$ | $\alpha_{0370}$ | $\beta_{0370}$ |
| | : | : | : | | : | : | : | : | : | : | : | : | : | : | : | : |
| | 16～20 [℃] | $\alpha_{3920}$ | $\beta_{3920}$ | ・・ | $\alpha_{2320}$ | $\beta_{2320}$ | $\alpha_{1920}$ | $\beta_{1920}$ | $\alpha_{1520}$ | $\beta_{1520}$ | $\alpha_{1120}$ | $\beta_{1120}$ | $\alpha_{0720}$ | $\beta_{0720}$ | $\alpha_{0320}$ | $\beta_{0320}$ |
| | 11～15 [℃] | $\alpha_{3915}$ | $\beta_{3915}$ | ・・ | $\alpha_{2315}$ | $\beta_{2315}$ | $\alpha_{1915}$ | $\beta_{1915}$ | $\alpha_{1515}$ | $\beta_{1515}$ | $\alpha_{1115}$ | $\beta_{1115}$ | $\alpha_{0715}$ | $\beta_{0715}$ | $\alpha_{0315}$ | $\beta_{0315}$ |
| | 6 ～10 [℃] | $\alpha_{3910}$ | $\beta_{3910}$ | ・・ | $\alpha_{2310}$ | $\beta_{2310}$ | $\alpha_{1910}$ | $\beta_{1910}$ | $\alpha_{1510}$ | $\beta_{1510}$ | $\alpha_{1110}$ | $\beta_{1110}$ | $\alpha_{0710}$ | $\beta_{0710}$ | $\alpha_{0310}$ | $\beta_{0310}$ |
| | 1 ～ 5 [℃] | $\alpha_{3905}$ | $\beta_{3905}$ | ・・ | $\alpha_{2305}$ | $\beta_{2305}$ | $\alpha_{1905}$ | $\beta_{1905}$ | $\alpha_{1505}$ | $\beta_{1505}$ | $\alpha_{1105}$ | $\beta_{1105}$ | $\alpha_{0705}$ | $\beta_{0705}$ | $\alpha_{0305}$ | $\beta_{0305}$ |

FIRST DRIVING WAVEFORM(DRIVING WAVEFORM OF FIRST EXAMPLE)

SECOND DRIVING WAVEFORM (1) Q=1 THE APPLIED VOLTAGE AND REFLECTION RATE OF THE PIXELS OF THE ODD-NUMBERED COLUMNS (2) Q=1 THE APPLIED VOLTAGE AND REFLECTION RATE OF THE PIXELS OF THE EVEN-NUMBERED COLUMNS (3) Q=2 THE APPLIED VOLTAGE AND REFLECTION RATE OF THE PIXELS OF THE ODD-NUMBERED COLUMNS (4) Q=2 THE APPLIED VOLTAGE AND REFLECTION RATE OF THE PIXELS OF THE EVEN-NUMBERED COLUMNS (1) Q=3 THE APPLIED VOLTAGE AND REFLECTION RATE OF THE PIXELS OF THE 1st COLUMN (2) Q=3 THE APPLIED VOLTAGE AND REFLECTION RATE OF THE PIXELS OF THE 12th COLUMN (3) Q=4 THE APPLIED VOLTAGE AND REFLECTION RATE OF THE PIXELS OF THE 1st COLUMN (4) Q=4 THE APPLIED VOLTAGE AND REFLECTION RATE OF THE PIXELS OF THE 12th COLUMN

FIG. 67

Tα DATA OF u-th DRIVING WAVEFORMS

| | | | Ts[°C] | | | | | | | | | |
|---|---|---|---|---|---|---|---|---|---|---|---|---|
| | | | 0 | 10 | 20 | 30 | 40 | 50 | 60 | 70 | 80 | 90 |
| DISPLAY PANEL TEMPERATURE | DRIVING WAVEFORMS FOR THE HIGH TEMPERATURE | 50 | | | | | | $T\alpha_{5050}$ | $T\alpha_{6050}$ | $T\alpha_{7050}$ | $T\alpha_{8050}$ | $T\alpha_{9050}$ |
| | | 40 | | | | | $T\alpha_{4040}$ | $T\alpha_{5040}$ | $T\alpha_{6040}$ | $T\alpha_{7040}$ | $T\alpha_{8040}$ | $T\alpha_{9040}$ |
| | DRIVING WAVEFORMS FOR THE NORMAL TEMPERATURE | 30 | | | | $T\alpha_{3030}$ | $T\alpha_{4030}$ | $T\alpha_{5030}$ | $T\alpha_{6030}$ | $T\alpha_{7030}$ | $T\alpha_{8030}$ | $T\alpha_{9030}$ |
| | | 20 | | | $T\alpha_{2020}$ | $T\alpha_{3020}$ | $T\alpha_{4020}$ | $T\alpha_{5020}$ | $T\alpha_{6020}$ | $T\alpha_{7020}$ | $T\alpha_{8020}$ | $T\alpha_{9020}$ |
| | DRIVING WAVEFORMS FOR THE LOW TEMPERATURE | 10 | | $T\alpha_{1010}$ | $T\alpha_{2010}$ | $T\alpha_{3010}$ | $T\alpha_{4010}$ | $T\alpha_{5010}$ | $T\alpha_{6010}$ | $T\alpha_{7010}$ | $T\alpha_{8010}$ | $T\alpha_{9010}$ |
| | | 0 | $T\alpha_{0000}$ | $T\alpha_{1000}$ | $T\alpha_{2000}$ | $T\alpha_{3000}$ | $T\alpha_{4000}$ | $T\alpha_{5000}$ | $T\alpha_{6000}$ | $T\alpha_{7000}$ | $T\alpha_{8000}$ | $T\alpha_{9000}$ |

FIG. 68A

| u=1 | | Ts [°C] | | | | | | | | | |
|---|---|---|---|---|---|---|---|---|---|---|---|
| | | 0 | 10 | 20 | 30 | 40 | 50 | 60 | 70 | 80 | 90 |
| DISPLAY PANEL TEMPERATURE | 50 | | | | | | NG | NG | NG | NG | NG |
| | 40 | | | | | NG | NG | NG | NG | NG | NG |
| | 30 | | | | OK | OK | NG | NG | NG | NG | NG |
| | 20 | | | OK | OK | OK | NG | NG | NG | NG | NG |
| | 10 | | OK | OK | OK | OK | OK | NG | NG | NG | NG |
| | 0 | OK | OK | OK | OK | OK | OK | NG | NG | NG | NG |

FIG. 68B

| u=2 | | Ts [°C] | | | | | | | | | |
|---|---|---|---|---|---|---|---|---|---|---|---|
| | | 0 | 10 | 20 | 30 | 40 | 50 | 60 | 70 | 80 | 90 |
| DISPLAY PANEL TEMPERATURE | 50 | | | | | | NG | NG | NG | NG | NG |
| | 40 | | | | | OK | NG | NG | NG | NG | NG |
| | 30 | | | | OK | OK | OK | NG | NG | NG | NG |
| | 20 | | | OK | OK | OK | OK | OK | NG | NG | NG |
| | 10 | | OK | OK | OK | OK | OK | OK | NG | NG | NG |
| | 0 | OK | OK | OK | OK | OK | OK | OK | NG | NG | NG |

FIG. 69

| | | Ts [°C] | | | | | | | | | |
|---|---|---|---|---|---|---|---|---|---|---|---|
| | | 0 | 10 | 20 | 30 | 40 | 50 | 60 | 70 | 80 | 90 |
| DISPLAY PANEL TEMPERATURE | 50 | | | | | | u=4 | u=5 | u=6 | NG | NG |
| | 40 | | | | | u=2 | u=3 | u=4 | u=5 | u=6 | NG |
| | 30 | | | | u=1 | u=1 | u=2 | u=3 | u=4 | u=5 | u=6 |
| | 20 | | | u=1 | u=1 | u=1 | u=2 | u=2 | u=3 | u=4 | u=5 |
| | 10 | | u=1 | u=1 | u=1 | u=1 | u=1 | u=2 | u=3 | u=4 | u=5 |
| | 0 | u=1 | u=1 | u=1 | u=1 | u=1 | u=1 | u=2 | u=3 | u=4 | u=5 |

DISPLAY DEVICE, TERMINAL DEVICE, AND DRIVING METHOD WITH A MEMORY FUNCTION FOR TEMPERATURE ACQUISITION AND WAVEFORM SELECTION

CROSS-REFERENCE TO RELATED APPLICATIONS

This application is a Divisional of U.S. application Ser. No. 15/168,892 filed May 31, 2016, which claims priority to Japanese Patent Application No. 2015-111565 filed on Jun. 1, 2015 and Japanese Patent Application No. 2016-057575 filed on Mar. 22, 2016, the entire contents of which are hereby incorporated by reference.

FIELD

The present invention relates to a display device employing a display panel with a memory function and a display panel controller thereof, and more particularly, to a technique of suppressing an increase in a driver temperature of a display panel.

BACKGROUND

An electronic paper display device has been developed as an ideal display device that is an alternative to paper. The electronic paper display device is required to be thin in a thickness, low in a weight, hard to be broken, and low in power consumption. In order to achieve the low power consumption, it is desirable that the electronic paper display device employ a display panel capable of holding an displayed image even when power supply is interrupted, that is, a so-called display panel with a memory function. As a display element used for the display panel with the memory function, an electrophoretic display element, an electronic particulate element, a cholesteric liquid crystal, and the like have been known in the past, and a display device with a memory function employing them has been put to practice use in an electronic book terminal.

In the display device with the memory function (for example, in a display device employing an electrophoretic element), it is desirable to supply electric power to the display panel only during an image update operation of rewriting an image. When the image update operation ends, the display image is held by the memory function, and thus it is unnecessary to supply electric power to the display panel until a next image update operation starts. On the other hand, a common display device (for example, a liquid crystal display device or an EL display device) that is used in a television, a PC monitor, a mobile terminal, or the like which is currently in widespread use does not have a memory function, and thus the image update operation is consistently necessary to continuously display an image even though it is a still image. In other words, in the display panel not having a memory function, it is necessary to supply electric power consistently while an image display is being performed. Thus, the display device with the memory function can achieve lower power consumption than a common display device not having a memory function.

For example, in Japanese Patent Application Laid-Open No. 2007-163987, a microcapsule active matrix electrophoretic display device which is a display device with a memory function is disclosed, and a driving example in which +15 V, 0 V, and −15 V are used as a voltage to be applied to an electrophoretic element.

As described above, the display device with the memory function is higher in a voltage to be applied to a display element than a common liquid crystal display device, and thus a large amount of heat is generated in a driver of the display panel to which the voltage is supplied, leading to a high possibility that a driver temperature at the time of image update will be problematic.

Since the display device not having a memory function consistently performs the image update operation, heat is consistently generated in the driver of the display panel, and the driver temperature gets higher than a usage environment temperature. On the other hand, in the display device with the memory function, heat is generated in the driver of the display panel only when an image is updated, and when a sufficient period of time elapses after the image update, the driver temperature is almost equal to the usage environment temperature. In other words, in the display device with the memory function, it is possible to control the driver temperature by controlling an interval at which an image is updated. In the display device not having a memory function, when the power is turned off after the image update, it is difficult to control the driver temperature based on the image update interval in the state in which the display is held since the display disappears.

In other words, the control of the driver temperature based on the image update interval is a problem of only the display device with the memory function.

Even in the display device with the memory function, there is a demand for a large-sized color display device. When the panel size of the display device with the memory function is increased, the number of display element groups is increased, a driving load of the driver of the display panel is increased, and thus generation of heat is increased, and the increase temperature is increased.

The present invention was made in light of the above problems, and it is an object of the present invention to provide a high-quality high-reliable display device with a memory function and a driving method thereof, which are capable of preventing a display trouble caused by an operation failure, performance degradation of the driver, and a breakdown of the driver, which occur when a temperature of a driver is high by estimating the driver temperature of the display panel after the image update and appropriately setting the image update interval according to the estimated temperature.

SUMMARY OF THE INVENTION

According to the present invention, a display device with a memory function includes a first substrate on which a plurality of pixels each of which includes a switching element and a pixel electrode are arranged in a matrix form, and a source line for applying a predetermined signal to the switching element and a scanning line for controlling the switching element are arranged, a second substrate on which an opposite electrode is formed, a display layer that is interposed between the first substrate and the second substrate and configured with an display element with a memory function, a driver that outputs a predetermined signal to the source line, a temperature acquiring unit that acquires a temperature of the driver, an image load value calculating unit that calculates an image load value based on image data to be displayed next, an temperature increase estimating unit that estimates the temperature of the driver after an image update operation of an image to be displayed next according to a temperature acquired by the temperature acquiring unit and the calculated image load value before the image update operation, an image update determining unit that compares a previously set temperature with the temperature estimated by the temperature increase estimating unit, and determines whether or not the image update operation is executable and an image display control unit that executes the image update operation, the image display control unit executes image update on the image to be displayed next when the image update determining unit determines the image update operation to be executable.

It is to be understood that both the foregoing general description and the following detailed description are exemplary and explanatory and are not restrictive of this disclosure.

According to the present invention, it is possible to implement a high-quality high-reliable display device with a memory function, which is capable of suppressing an increase in a size of a device and an increase in a development cost by installation of a heat dissipation plate, a cooling fan, or the like and a redesign of a housing for suppressing heat generation of a panel driver, and an increase in a development cost by a driver redesign intended for high heat generation resistance or low heat generation and preventing a display trouble caused by an operation failure, the performance degradation of the driver, and the breakdown of the driver, which occur when a temperature of a driver is high.

BRIEF DESCRIPTION OF THE DRAWINGS

FIG. 13 is an explanatory diagram illustrating a relation between binary data and an applied voltage;

FIG. 15 is an explanatory diagram illustrating a relation between binary data and an applied voltage in a second example;

FIG. 17 illustrates table data storing a measurement value (a temperature increase ΔT);

FIG. 19 illustrates another measurement data of a source driver temperature increase ΔT stored in a temperature increase estimating unit;

FIG. 20 illustrates another measurement data of a source driver temperature increase ΔT stored in a temperature increase estimating unit;

FIG. 67 illustrates measurement data of a source driver temperature increase $\Delta T$ stored in a temperature increase estimating unit;

FIGS. 68A and 68B are diagrams illustrating a relation example between a set temperature and a source driver temperature;

FIG. 69 illustrates table data for selecting a driving waveform;

DESCRIPTION OF EMBODIMENTS

Figure 1:
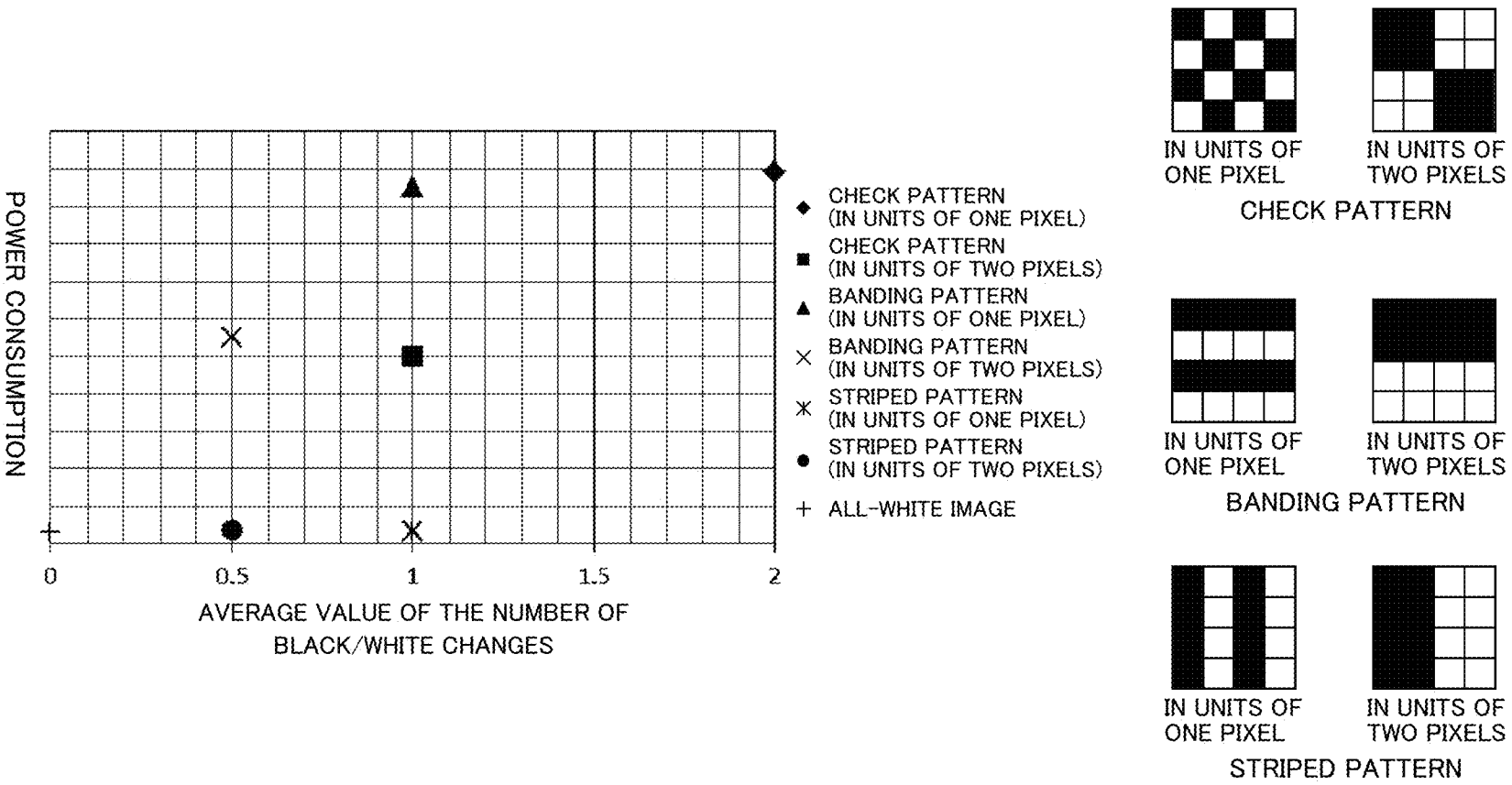
FIG. 1 is a distribution diagram illustrating a relation between the number of black/white changes and panel driver power consumption.

According to the present invention, it is possible to implement a high-quality high-reliable display device with a memory function, which is capable of suppressing an increase in a size of a device and an increase in a development cost by installation of a heat dissipation plate, a cooling fan, or the like and a redesign of a housing for suppressing heat generation of a panel driver, and an increase in a development cost by a driver redesign intended for high heat generation resistance or low heat generation and preventing a display trouble caused by an operation failure, the performance degradation of the driver, and the breakdown of the driver, which occur when a temperature of a driver is high.

Hereinafter, modes (hereinafter, referred to as "embodiments") for carrying out the present invention will be described with reference to the appended drawings. In this specification and the drawings, substantially the same components are denoted by the same reference numerals. Since shapes illustrated in the drawings are depicted to facilitate understanding of those having skill in the art, dimensions and ratios thereof are not necessarily identical to actual ones.

First Embodiment

A relation between an image pattern to be displayed on a display panel and a driver temperature increase will be described below together with an experimental result. The driver temperature increase of the display panel at the time of image update depends on the image pattern to be displayed. In an experiment performed by the inventor(s), a white/black check pattern in units of one pixel was turned out to be high in the temperature increase of the driver by single image update. Further, when the image update of the white/black check pattern in units of one pixel is repeated in a short period of time, it was turned out that the driver temperature steadily increases each time the image update operation is performed, the driver temperature eventually exceeds a usage temperature range, and reaches a level at which a risk such as a display trouble by an operation failure, a driver performance degradation, or a driver breakdown is caused.

In the display device with the memory function, the user is unlikely to intentionally causes the white/black check pattern in units of one pixel in which the temperature increase of the driver is high to be displayed continuously. However, a design in which a worst case is considered is necessary in terms of product warranties.

In future, in the display device with the memory function, the necessity of suppressing the driver temperature of the display panel is increased. A radical solution includes installation of a heat dissipation plate or a cooling fan and redesign of a panel driver for high heat generation resistance or low heat generation. However, the installation of the heat dissipation plate or the cooling fan increases the size of the device and has a problem in that it is unfit for an operation to an electronic paper display device, and the redesign of the panel driver for high heat generation resistance or low heat generation has a problem in that a development cost is reflected in a driver unit price, and price competitiveness of a display device with a memory function is lower than in general liquid crystal display devices in which cost reduction is promoted.

The inventor(s) verified a relation between a display image pattern and power consumption in a display device with a memory function. An electrophoretic display device was used for the verification. In this display device, when whit (or black) is displayed through a pixel neighboring a pixel that displays black (or white), an output current from a driver of a display panel is increased, and thus power consumption is increased. Thus, several image patterns configured with pixels displaying black and pixels white were prepared, the sum of the number of black/white changes in a row direction in an image and the number of black/white changes in a column direction was obtained, and a value obtained by dividing the sum by the number of pixels in the display panel was used as an "average value of the number of black/white changes." Table 1 shows the verified image patterns and the average values of the number of black/white changes, and FIG. 1 illustrates a relation between the number of black/white changes and the driver power consumption of the display panel. In graph illustrated in FIG. 1, a vertical axis indicates power consumption, and a unit is W. A horizontal axis indicates the number of black/white changes.

TABLE 1

| | Image Pattern | Average Value of The Number of Black/White Changes |
|---|---|---|
| 1 | Check Pattern (in units of one pixel) | 2.0 |
| 2 | Check Pattern (in units of two pixels) | 1.0 |
| 3 | Banding Pattern (in units of one pixel) | 1.0 |
| 4 | Banding Pattern (in units of two pixels) | 0.5 |
| 5 | Striped Pattern (in units of one pixel) | 1.0 |
| 6 | Striped Pattern (in units of two pixels) | 0.5 |
| 7 | All-White Image | 0.0 |

FIG. 1 is a distribution diagram illustrating a relation between the number of black/white changes and the panel driver power consumption. As illustrated in FIG. 1, in the verification using the electrophoretic display device, the number of black/white changes and the driver power consumption of the display panel are not in the proportional relation.

Figure 2:
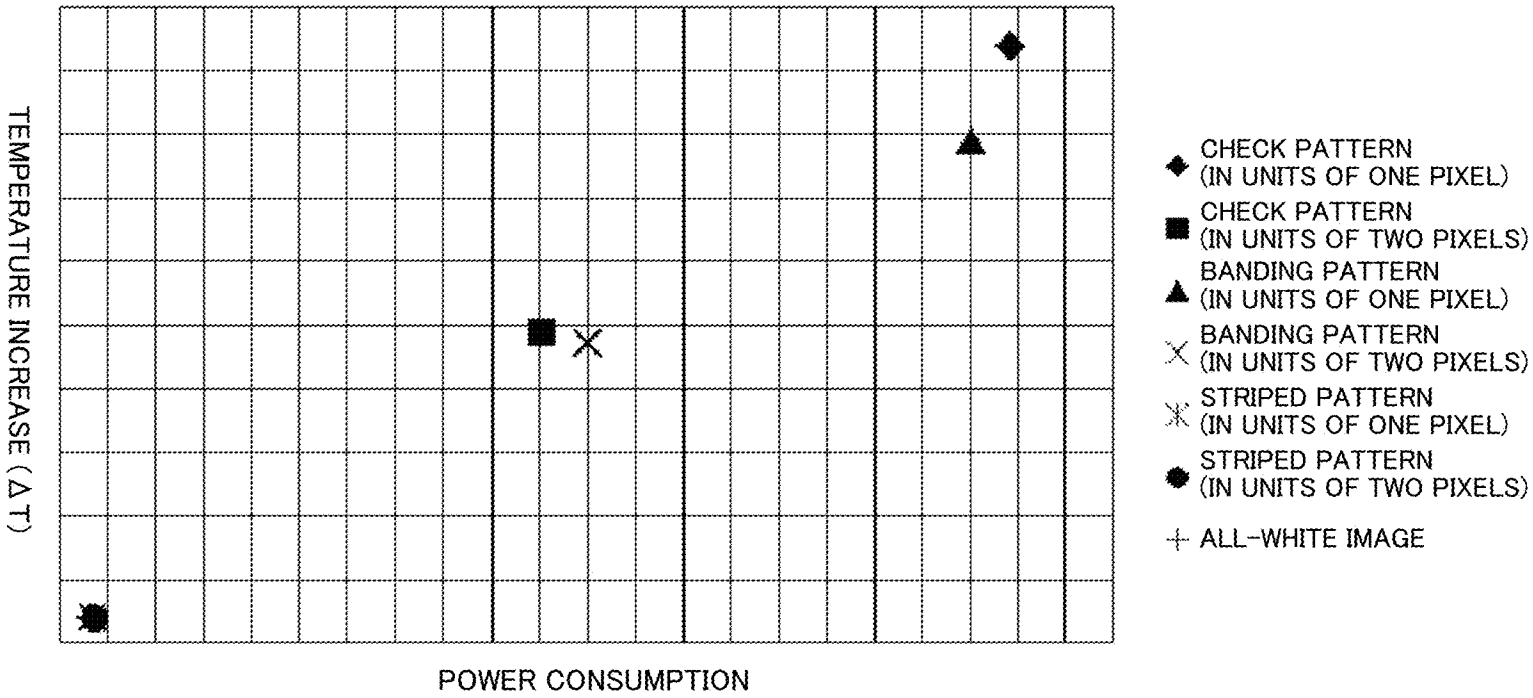
FIG. 2 is a distribution diagram illustrating a relation between driver power consumption and a temperature increase (ΔT)

In the same image patterns as in Table 1 and FIG. 1, the temperature of the driver before the image update and the temperature of the driver after the image update were measured, the temperature increase (ΔT) of the driver according to the image update was obtained, and a relation between the driver power consumption and the driver temperature increase (ΔT) was verified. FIG. 2 is a distribution diagram illustrating the relation between the driver power consumption and the temperature increase (ΔT). In a graph illustrated in FIG. 2, a vertical axis indicates the temperature increase ΔT, and a unit is ° C. A horizontal axis indicates the power consumption, and a unit is W. It is understood from FIG. 2 that there is a possibility that the temperature increase (ΔT) will be not necessarily proportional to the power consumption. This result represents that the driver temperature increase (ΔT) is controlled based on the driver power consumption, there is a possibility that the driver temperature will not be suppressed to a desired temperature or less.

[Description of Configuration]

A configuration of a display device with a memory function according to the first embodiment of the present invention will be described below with reference to the drawings.

Figure 3:
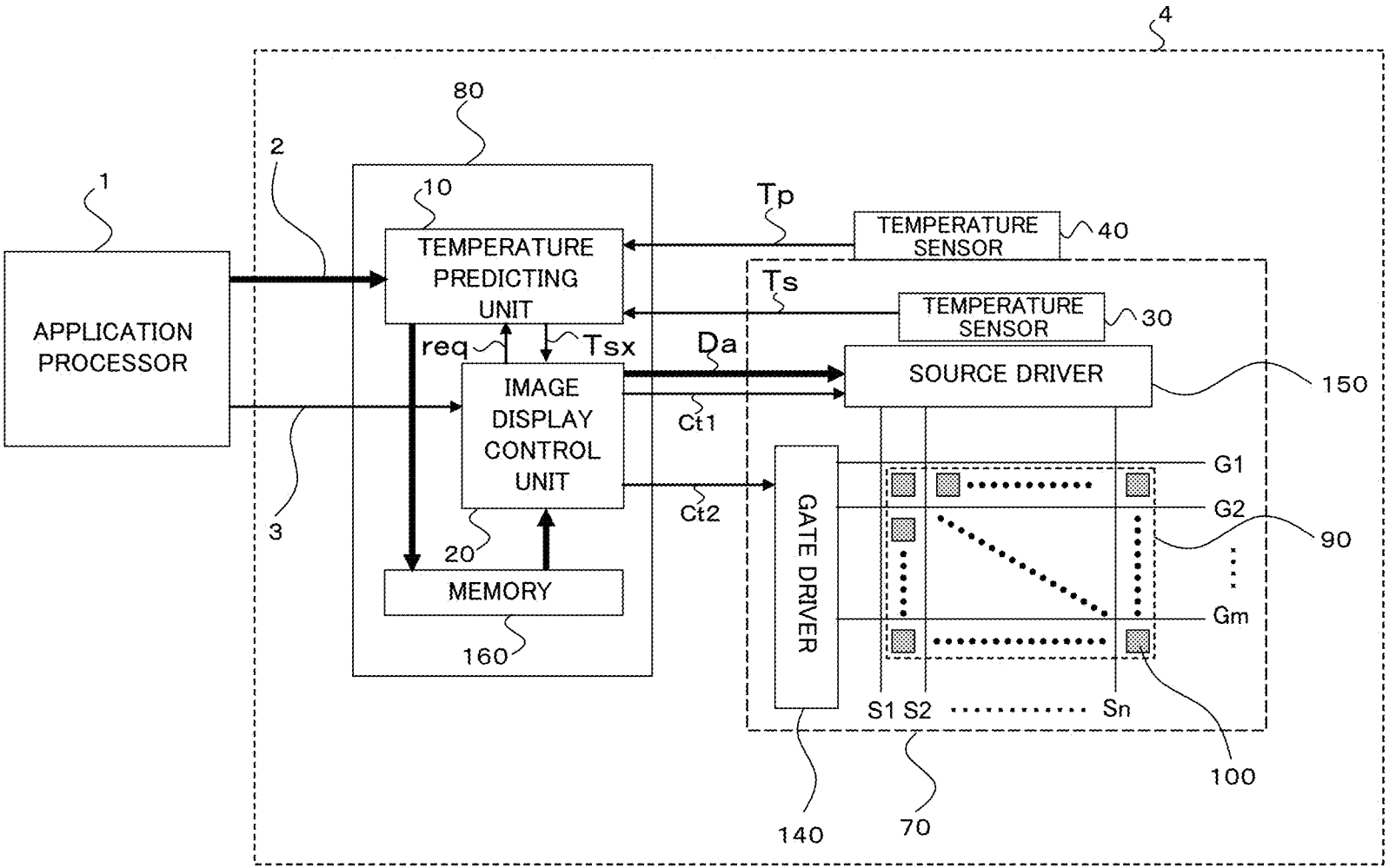
FIG. 3 is a block diagram for describing a configuration of a display device with a memory function according to a first embodiment.

FIG. 3 is a block diagram for describing a configuration of the display device with the memory function according to the first embodiment. A display device 4 with the memory function according to the first embodiment includes a display panel 70 with a memory function and a display panel controller 80.

The display panel 70 with the memory function includes a display unit 90 configured with M×N pixels 100 that display an image, N source lines Sn (n=1, 2, . . . , N) serving as a wiring of a voltage to be applied to pixel electrodes (not illustrated) corresponding to the pixels 100, M gate lines Gm (m=1, 2, . . . , M) serving as a scanning line for turning on or off switching units (switching elements) 104 (which will be described later) corresponding to the pixels 100, common electrodes (not illustrated) to which a potential VCOM of opposite electrodes 122 (which will be described later) is input, a source driver 150 that supplies a voltage according to display data to the source lines Sn, and a gate driver 140 that supplies a voltage for turning on or off the switching units sequentially to the gate lines Gm. In other words, the scanning line is a gate line for controlling the switching element. The display panel 70 with the memory function further includes a temperature sensor 40 that measures a temperature Tp of the display panel 70 with the memory function and a temperature sensor (a temperature acquiring unit) 30 that measures a temperature Ts of the source driver 150. The display panel controller 80 includes a temperature predicting unit 10 that estimates the temperature Tsx of the source driver 150 after the image update, an image display control unit 20 that compares the estimated temperature Tsx with a previously set temperature, and executes the image update operation according to the comparison result, and a memory 160. In other words, the gate line Gm connects the gate driver 140 with the switching element. The gate driver 140 controls the switching element via the gate line Gm.

The display panel 70 with the memory function illustrated in FIG. 3 will be described in detail. For example, a microcapsule electrophoretic display element having a cross-sectional structure illustrated in FIG. 4 may be used as the display unit 90 of the display panel 70 with the memory function.

Figure 4:
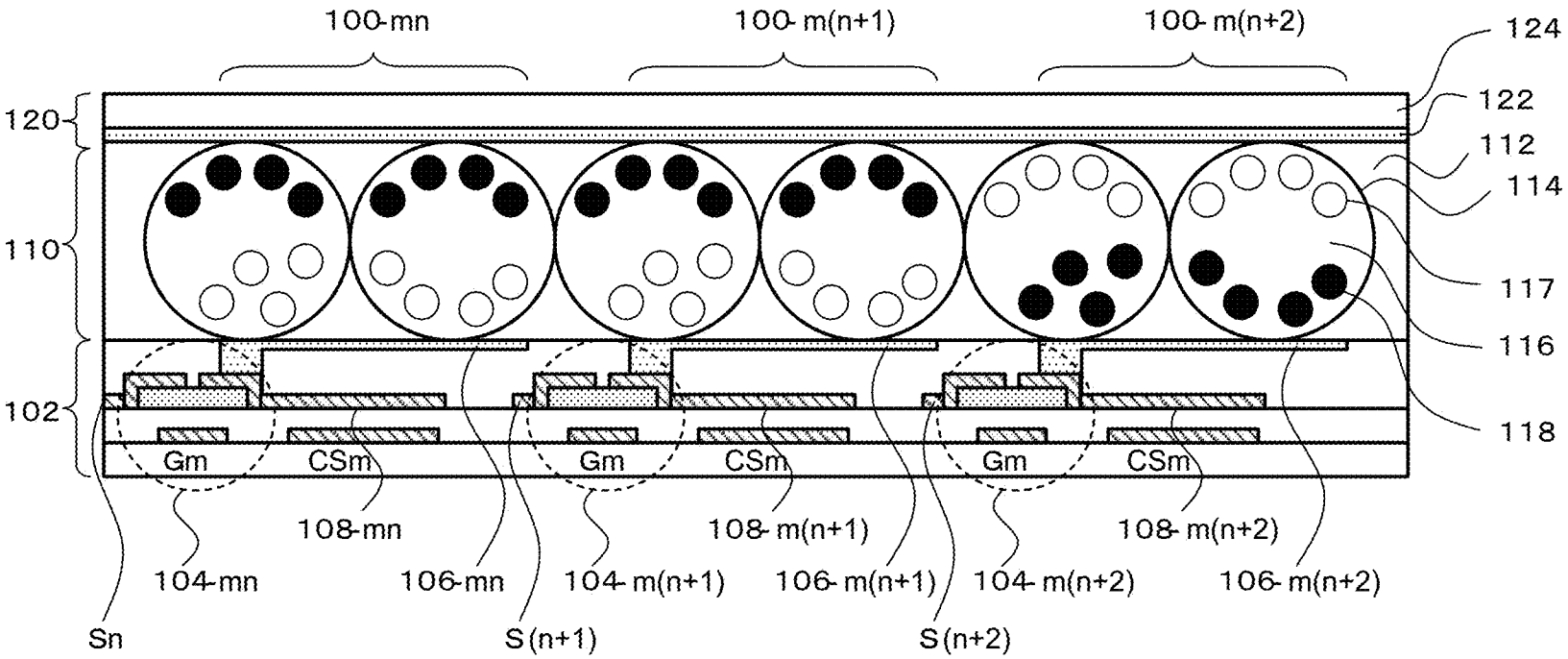
FIG. 4 is a cross-sectional view of a display unit in m rows.

FIG. 4 is a cross-sectional view of the display unit 90 in m rows. As illustrated in FIG. 4, the display unit 90 has a stacked structure in which a thin film transistor (TFT) glass substrate (a first substrate) 102, an electrophoretic layer (a display layer) 110, and an opposite substrate (a second substrate) 120 are stacked in the described order.

A TFT serving as a switching element, a pixel electrode connected to each TFT, a gate line, a source line, and a storage electrode are formed on the TFT glass substrate 102. Specifically, in an n-th column of an m-th row to a (n+2)-th column of the m-th row of the display unit, a TFT (switching element) 104-*mn*, a TFT 104-*m*(*n*+1), and a TFT 104-*m*(*n*+2) are arranged, and a gate line Gm, source lines Sn, S(n+1), and S(n+2), pixel electrodes 106-*mn*, 106-*m*(*n*+1), and 106-*m*(*n*+2), and storage electrodes 108-*mn*, 108-*m*(*n*+1), and 108-*m*(*n*+2) which are connected to the TFTs are arranged. A storage capacitor (a reference numeral is omitted) is formed between a storage line CSm and each of the storage electrodes 108-*mn*, 108-*m*(*n*+1), and 108-*m*(*n*+2).

For example, the electrophoretic layer 110 is formed such that microcapsules 114 are paved in a polymer binder 112. Generally, a dimension of each of the microcapsules 114 is smaller than a dimension of the pixel electrode of the electrophoretic display device. In FIG. 4, two microcapsules 114 correspond to one pixel electrode, but it is for convenience of description, and the present invention is not limited thereto. A solvent 116 is injected into the microcapsule 114. White pigments (white particles, for example, titanium oxide) 117 that have a nano-level size and are negatively charged and black pigment (black particles, for example, carbon) 118 that have a nano-level size and are positively charged are innumerably floating in the solvent 116.

The opposite substrate 120 is formed such that a pair of opposite electrodes 122 facing the pixel electrodes 106-*mn*, 106-*m*(*n*+1), and 106-*m*(*n*+2) of the TFT glass substrate 102 are attached to a transparent plastic substrate 124 (for example, poly ethylene terephthalate (PET)).

Through the configuration of FIG. 4, when a voltage is applied between the pixel electrodes 106-*mn*, . . . and the opposite electrode 122, the charged particles (the white pigments 117 and the black pigments 118) in the microcapsule 114 of the electrophoretic layer 110 move, and a reflection rate of a display surface is changed. Thus, the pixel 100-*mn*, the pixel 100-*m*(*n*+1), and the pixel 100-*m*(*n*+2) are formed on areas corresponding to the pixel electrodes 106-*mn*, 106-*m*(*n*+1), and 106-*m*(*n*+2), respectively.

Figure 5:
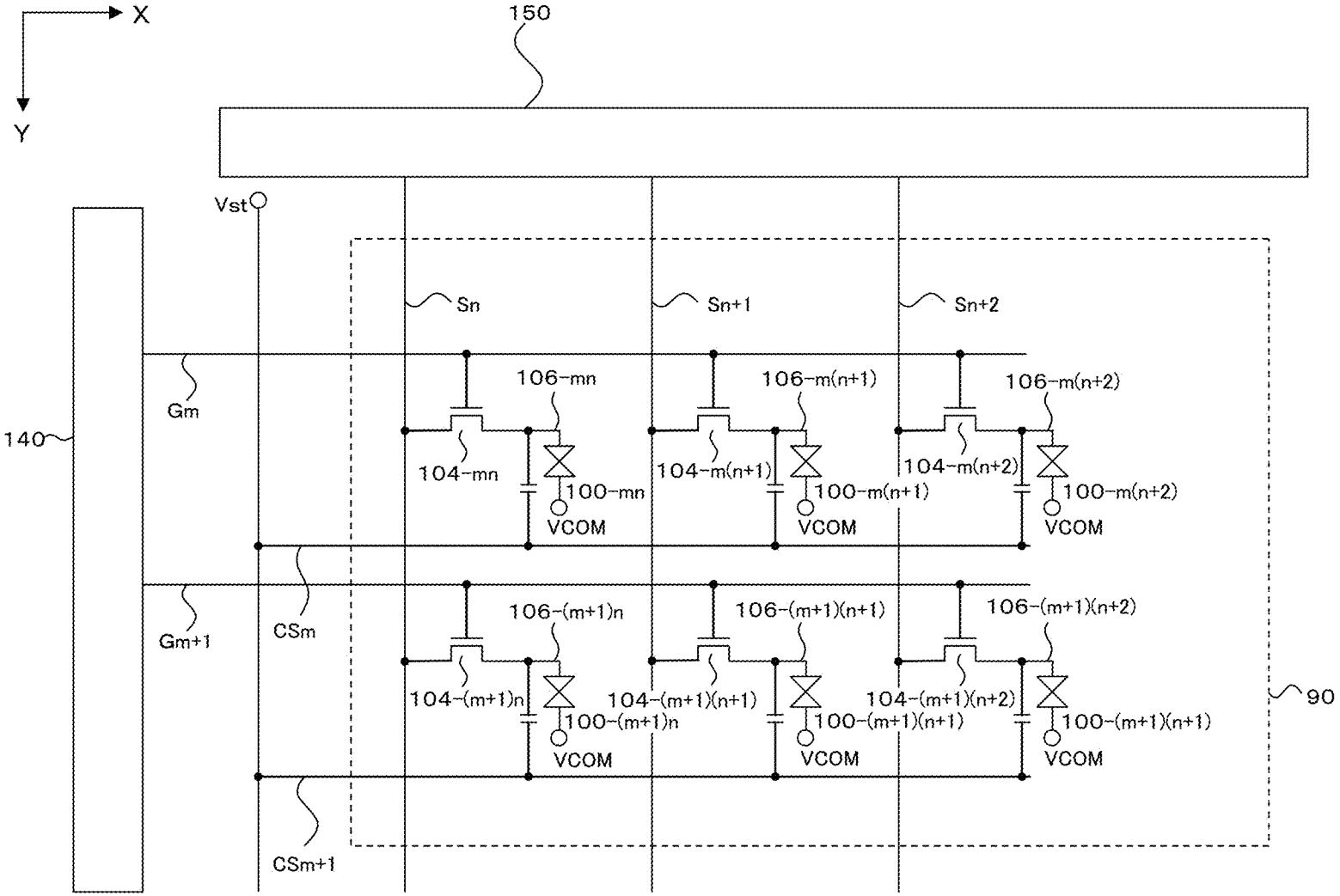
FIG. 5 is a schematic diagram illustrating an electrical connection relation.

FIG. 5 is a schematic diagram illustrating an electrical connection relation. FIG. 5 is a view illustrating a detailed configuration of the display unit 90 illustrated in FIG. 4 on a plane in which a position is decided by coordinates of an X axis and a Y axis that are orthogonal to each other, and an X direction is a horizontal direction of the display unit 90, and a Y direction is a vertical direction of the display unit 90. Thus, a row of the display unit 90 is formed by a group of pixel having the same Y coordinate, and a column of the display unit 90 is formed by a group of pixel having the same X coordinate.

As illustrated in FIG. 5, the source line for supplying the voltage corresponding to the display data to the pixel electrode 106-*mn* or the like through the TFT 104-*mn* or the like extends in the Y direction, and each of the source lines (the source line Sn, the source line Sn+1, and the source line Sn+2) is arranged for each column of the display unit 90 and connected with the source driver 150 that supplies a voltage. The gate line for controlling the TFT 104-*mn* or the like extends in the X direction, and each of the gate lines (the gate line Gm and the gate line Gm+1) are arranged for each row of the display unit 90 and connected with the gate driver 140 that supplies a control signal. The storage line for forming the storage capacitor with the storage electrode 108-*mn* (a reference numeral is omitted in FIG. 5) or the like extends in the X direction, and each of the storage lines (the storage line CSm and the storage line CSm+1) is arranged for each row of the display unit 90. The storage lines are connected to one another, and a common potential Vst is applied to the storage lines as illustrated in FIG. 5. Generally, a common potential Vst is configured to apply the same potential VCOM as the potential applied to the opposite electrode.

Through the above configuration, it is possible to sample the voltage simultaneously supplied from the source driver 150 to the N source lines in units of rows using signals sequentially supplied from the gate driver 140 to the gate lines G1, G2, . . . , GM and write the voltage corresponding to the display data to an arbitrary pixel electrode 106*mn* (so-called line sequential driving). The storage capacitor is designed to be able to hold the written voltage until next sampling. In the above driving, an interval at which an on operation and an off operation of an arbitrary TFT are repeated, that is, an interval until a next sampling signal is supplied after a sampling signal is supplied to a certain gate line is referred to as a "frame."

Meanwhile, in the electrophoretic display element, a change speed of a display state (the reflection rate) of the pixel is decided according to a movement speed of the charged particles, and the change speed is much slower than that of a liquid crystal display element. For this reason, a general liquid crystal display device performs the image update during one frame period, where as in the electrophoretic display device, a plurality of frame periods are necessary for the image update. Since a desired display state (reflection rate) of the pixel is obtained by applying the voltage over a plurality of frames, in the electrophoretic display device, a gray-out display (a halftone display) can be implemented by a pulse width modulation (PWM) scheme in which one frame is used as a unit time. For this reason, as in the general liquid crystal display, it is unnecessary to use the source driver that outputs the multi-value voltage corresponding the gray-out display (the halftone display), and it is possible to a three-value driver that outputs, for example, +V, 0, and −V. Hereinafter, in the description of the first embodiment, it is assumed that the PWM scheme is applied to the gray-out display (the halftone display), and the three-value driver that outputs +V, 0, and −V is used as the source driver 150.

The display panel controller 80 (see FIG. 3) that controls the display panel 70 with the memory function having the above configuration will be described below in detail.

Figure 6:
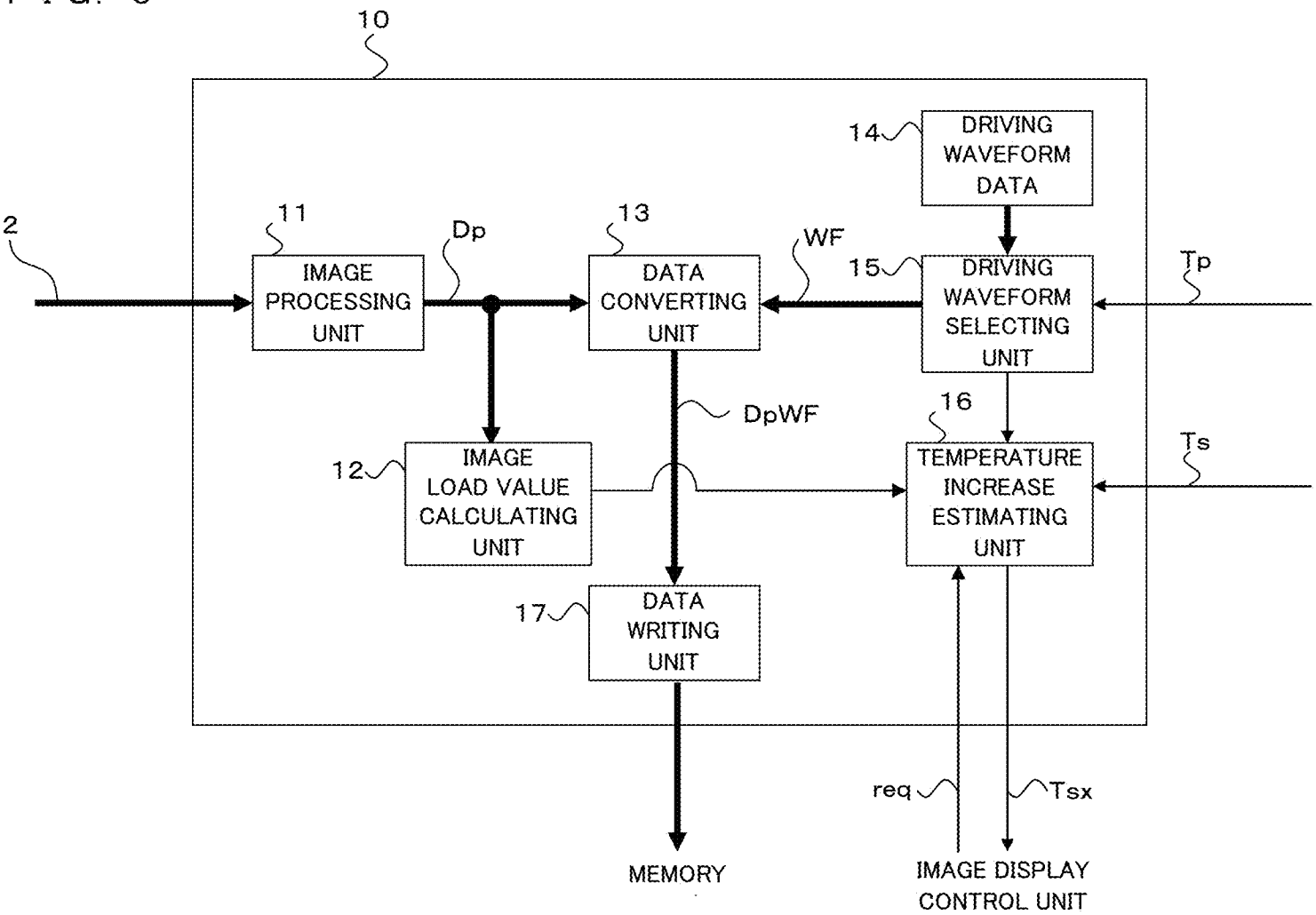
FIG. 6 is a block diagram illustrating a configuration of a temperature predicting unit.

FIG. 6 is a block diagram illustrating a configuration of the temperature predicting unit 10. The temperature predicting unit 10 includes an image processing unit 11, an image load value calculating unit 12, a data converting unit 13, driving waveform data 14, a driving waveform selecting unit 15, a temperature increase estimating unit 16, and a data writing unit 17.

The image processing unit 11 has a processing function of image data 2 of a general format output from an application processor 1 into data of a data format according to characteristics of the display panel 70 with the memory function. For example, when display characteristics of the display panel 70 are 1 pixel: monochrome 16 gradations (4 bits), and the image data 2 is color image (1 pixel: R, G, and B, and each has 256 gradations (8 bits)) data, the color image data is converted into monochrome 16-gradation data. The image processing unit 11 has a function of performing a gray scale conversion process, a number-of-bits conversion process, a dithering process, and the like which are necessary for performing this conversion, and data that has undergone the image processing and then are output from the image processing unit 11 is referred to as "gradation data Dp."

The gradation data Dp is data having a gradation value in all (M×N) pixels of the display unit 90, and a data structure is an M×N two-dimensional (2D) array corresponding to the display unit 90. The output gradation data Dp is input to the image load value calculating unit 12 and the data converting unit 13.

The image load value calculating unit 12 has a function of calculating an image load value based on the gradation data Dp and outputting the calculated value to the temperature increase estimating unit 16. A method of calculating the image load value will be described later.

The driving waveform selecting unit 15 has a function of selecting an optimal driving waveform WF from the driving waveform data 14 according to the display panel temperature Tp. The driving waveform WF is voltage data that is applied in units of frames according to a gradation to be displayed at the time of image update for frames 1 to L, and a data structure thereof is a 2D array in which a frame number and a display gradation value are arranged in a matrix form. The electrophoretic display element will be described later in detail, but since the display characteristics change according to an ambient temperature, several driving waveforms to be applied according to the ambient temperature are prepared as the driving waveform data 14. For example, three driving waveforms, that is, a driving waveform (a high temperature) used when the display panel temperature is 39° C. to 20° C., a driving waveform (a normal temperature) used when the display panel temperature is 19° C. to 8° C., and a driving waveform (a low temperature) used when the display panel temperature is 7° C. to 0° C. are prepared. The driving waveform WF selected by the driving waveform selecting unit 15 is output to the data converting unit 13, and information of the selected driving waveform, for example, information indicating the driving waveform of the selected temperature among the high temperature, the normal temperature, and the low temperature is output to the temperature increase estimating unit 16.

The data converting unit 13 has a function of converting the gradation data Dp into chronological voltage data of a frame unit based on the driving waveform WE In other words, the gradation data of the pixel is converted into voltage data that is applied according to a time. The converted data is referred to as "DpWF." DpWF is a group of data of a voltage to be applied to all (M×N) pixels of the display unit 90 in units of frames from the start frame 1 to the end frame L of the image update, and thus a frame number is added to a 2D array in which a pixel is designated by a matrix, and a data structure is a three-dimensional (3D) array.

The data writing unit 17 has a function of storing DpWF output from the data converting unit 13 in the memory 160.

The temperature increase estimating unit 16 has a function of estimating the source driver temperature Tsx after the display operation (image update) of the input image data 2 ends based on the image load value calculated by the image load value calculating unit 12, the information of the driving waveform, and the source driver temperature Ts and a function of updating the temperature Tsx according to a request signal req input from the image display control unit 20 and outputting the updated temperature Tsx to the image display control unit 20.

Figure 7:
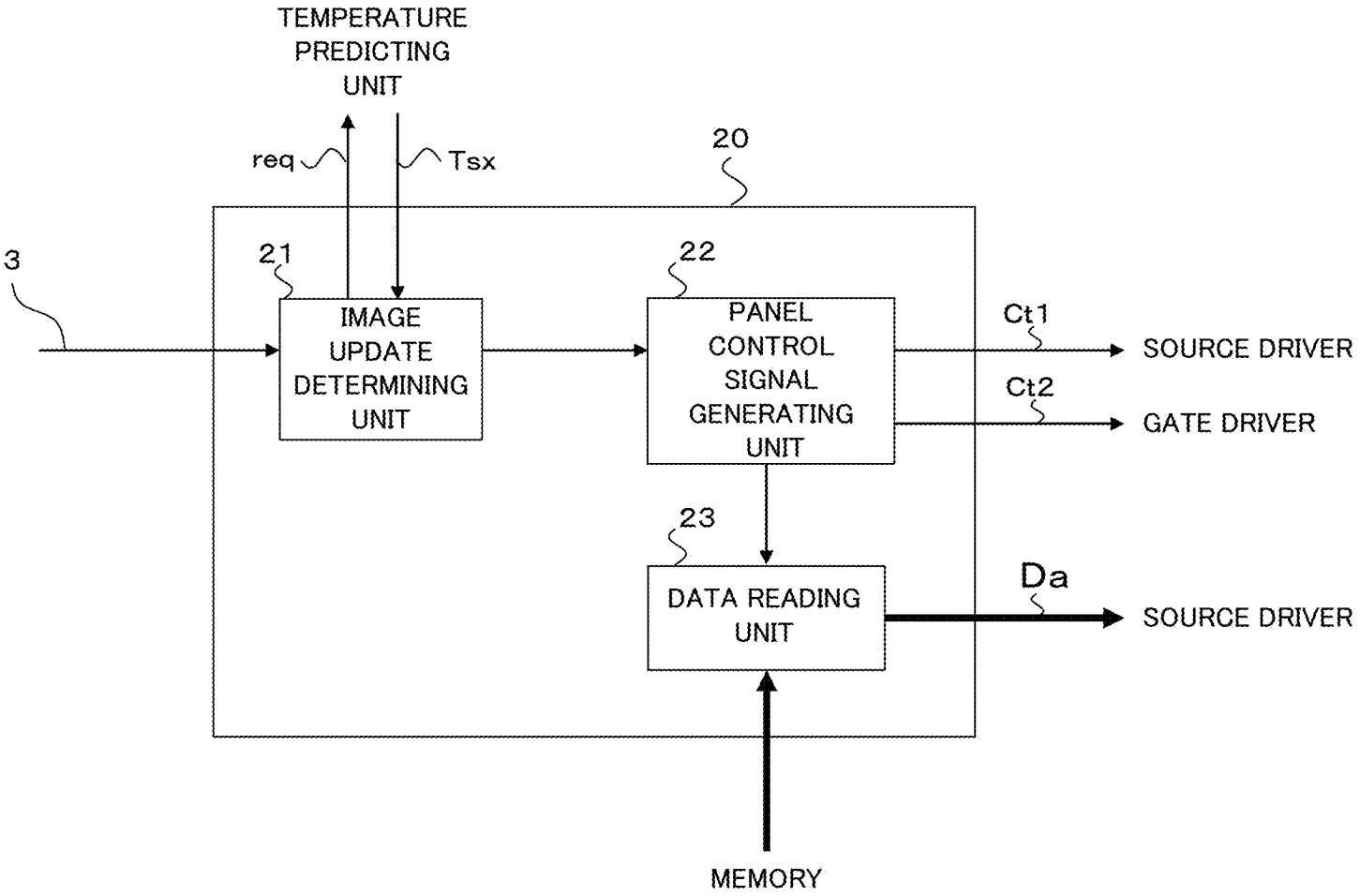
FIG. 7 is a block diagram illustrating a configuration of an image display control unit.

Next, the image display control unit 20 of the display panel controller 80 (FIG. 3) will be described. FIG. 7 is a block diagram illustrating a configuration of the image display control unit 20. The image display control unit 20 includes an image update determining unit 21, a panel control signal generating unit 22, and a data reading unit 23.

The image update determining unit 21 has a function of comparing the temperature Tsx input from the temperature predicting unit 10 with a temperature that is set in advance according to a specification of the source driver 150 when an image update signal 3 is input from the application processor 1, transferring a signal to start an operation to the panel control signal generating unit 22 when the temperature Tsx is lower than the set temperature, and transferring a Tsx request signal req to the temperature predicting unit 10 at predetermined time intervals when the temperature Tsx is higher than the set temperature.

The panel control signal generating unit 22 has a function of generating various kinds of signals and electric power for controlling the source driver 150 according to a signal input from the image update determining unit 21 (Ct1) and outputting the generated signal and the electric power to the source driver 150, a function of generating various kinds of signals and electric power for controlling the gate driver 140 (Ct2) and outputting the generated signal and the electric power to the gate driver 140, and a function of generating a timing signal for reading data out to the data reading unit 23 and outputting a timing signal.

The data reading unit 23 has a function of reading data from the memory 160 in synchronization with the timing signal generated by the panel control signal generating unit 22 and outputting voltage data Da of a data format complying with the specification of the source driver 150. For example, in the case of a specification in which the output voltage to be output to the source line is decided by 2-bit data (+V=01, 0=00, and −V=10), and the voltage data is input in units of 4 source lines, the source driver 150 converts the voltage data read from the memory 160 into 8-bit data Da complying the specification, and outputs the 8-bit data Da to the source driver 150.

[Description of Operation]

Next, an operation according to the first embodiment will be described.

First, an operation of the display panel 70 with the memory function configured with the microcapsule electrophoretic display element will be described.

FIGS. 8A to 8D are diagrams illustrating a state in which a reflection rate R of the pixel changes according to an elapsed time t. In other words, FIGS. 8A to 8D are diagrams illustrating a state in which the reflection rate R of the pixel changes according to the elapsed time t when a voltage (+V or −V) is applied between an arbitrary pixel electrode 106-*mn* and the opposite electrode 122. FIGS. 8A to 8D each includes two graphs in an upper portion and in a lower portion. In the upper graphs, a vertical axis indicates the reflection rate R, and a unit is a percentage. In the lower graphs, a vertical axis indicates a voltage, and a unit is a volt. In the upper and lower graphs, a horizontal axis is the same. In the upper and lower graphs, the horizontal axis indicates an elapsed time, and a unit is a second.

Figure 8A:
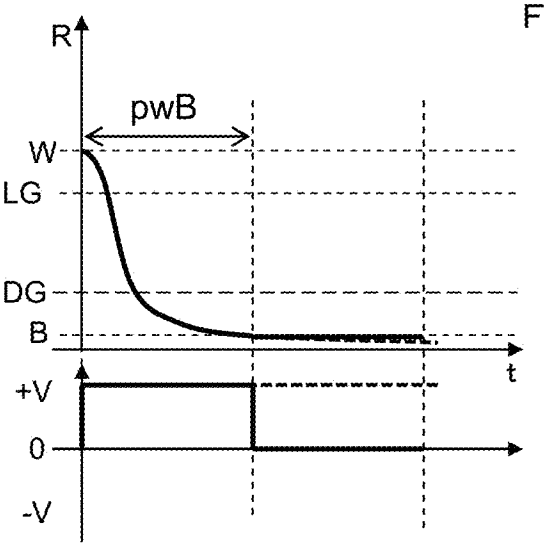
FIGS. 8A to 8D are diagrams illustrating a state in which a reflection rate R of a pixel changes according to an elapsed time t.

FIG. 8A illustrates a state in which the display of the pixel changes from a W (white) display to a B (black) display. In the pixel of the W (white) display, the white particles 117 that are negatively charged are collected to the opposite electrode side, and the black particles 118 that are positively charged are collected to the pixel electrode side. When the voltage that is +V to the opposite electrode is applied to the pixel electrode in this state, the white particles 117 move to the pixel electrode side, and the black particles 118 move to the opposite electrode side. For this reason, the reflection rate of the pixel decreases according to an applying period of time, but the movement of the particles converges according to the elapsed time, and thus a reflection rate change per unit time steadily decreases. Here, a +V applying period of time taken to cause the reflection rate to be sufficiently low is indicated by pwB, and the display state by the reflection rate at this time is assumed to be B (black). When the applied voltage is changed from +V to 0, the movement of the particles stops, and the reflection rate is maintained by the memory function. Thus, after pwB elapses, even when the applied voltage is changed from +V to 0, the display state B (black) is maintained. Further, when the voltage is continuously applied during a period of time larger than pwB as indicated by a broken line, the reflection rate steadily decreases, but it is a level that is not identified as the display color of the pixel by human eyes.

Figure 8B:
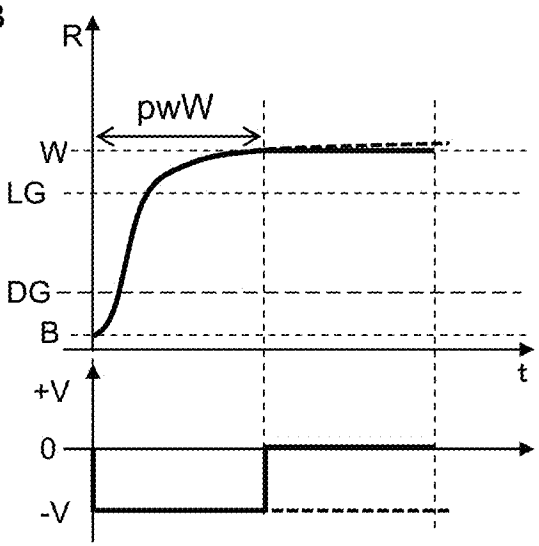

FIG. 8B illustrates a state in which the display of the pixel changes from the B (black) display to the W (white) display. In the pixel of the B (black) display, the black particles that are positively charged are collected to the opposite electrode side, and the white particles that are negatively charged are collected to the pixel electrode side. When the voltage that is −V to the opposite electrode is applied to the pixel electrode in this state, the black particles move to the pixel electrode side, and the white particles move to the opposite electrode side. For this reason, the reflection rate of the pixel increases according to the applying period of time and an opposite characteristics to that of FIG. 8A. A −V applying period of time taken to cause the reflection rate to be sufficiently high is indicated by pwW, and the display state by the reflection rate at this time is assumed to be W (white).

Figure 8C:
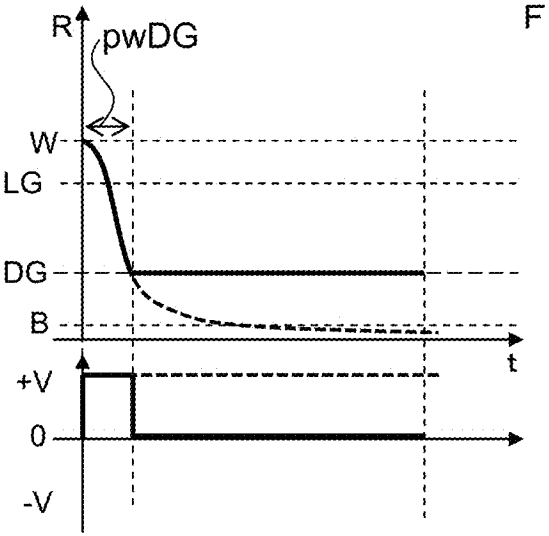
Figure 8D:
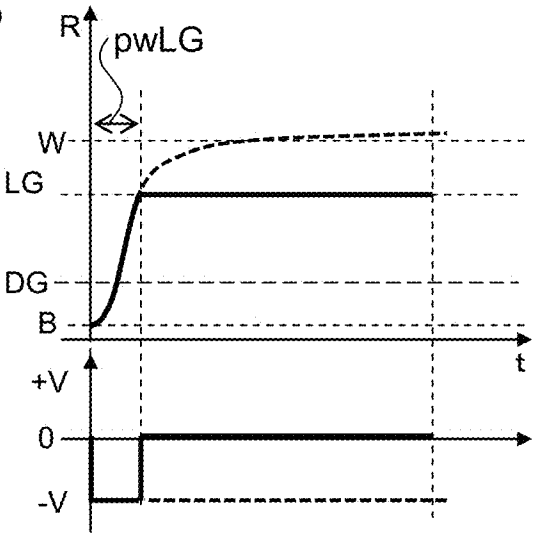

As described above, the electrophoretic display element can perform the gray-out display (the halftone display) using this characteristics since the reflection rate R changes according to the voltage applying period of time. FIG. 8C illustrates a state in which the display of the pixel changes from the W (white) display to a DG (dark gray) display as +V is applied during an applying period of time of pwDG, and FIG. 8D illustrates a state in which the display of the pixel changes from the B (black) display to an LG (light gray) display as −V is applied during an applying period of time of pwLG. FIGS. 8C and 8D illustrate the DG (dark gray) display and the LG (light gray) display, but for example, the monochrome 16-gradation display can be implemented by adjusting the voltage applying period of time similarly.

However, in the electrophoretic display device with the memory function, when a desired image display is actually performed, if +V or −V is applied by simply adjusting a period of time as illustrated in FIGS. 8A to 8D, history of an previous image has influence on a next image, and the previous image is viewed as an afterimage. In order to prevent the afterimage, a reset period of time in which the white display (applying of (−V) and the black display (applying of +V) are repeated is set, and a voltage corresponding to a desired gradation is applied during a period of time corresponding to a desired gradation after the reset period of time. In other words, when the image display is performed, a voltage applied to cause an arbitrary pixel to have a desired gradation is not constant but changes. Thus, in order to display a desired gradation, a series of voltage to be applied to the pixel electrode between the start and the end of the image display is referred to as a "voltage waveform." In the image display, the voltage waveforms that correspond in number to the number of gradations to be displayed in one pixel are necessary, and, for example, 16 voltage waveforms are necessary in the 16-gradation display. The voltage waveforms that correspond in number to the number of gradations are referred to collectively as a "driving waveform."

Figures 9A, 9B, 9C, 9D:
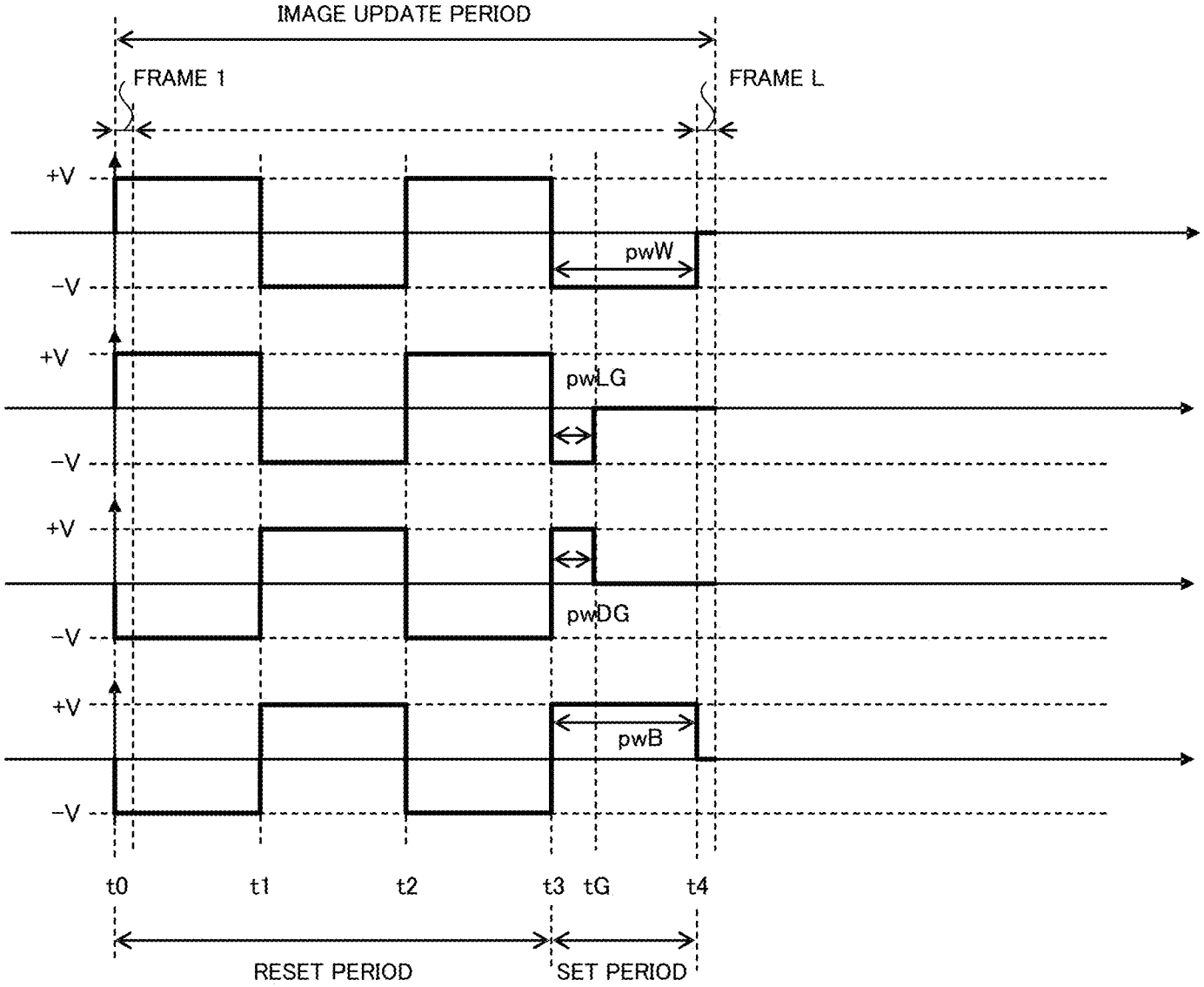
FIGS. 9A to 9D are graphs illustrating a first example of a driving waveform.
Figures 10A, 10B, 10C, 10D:
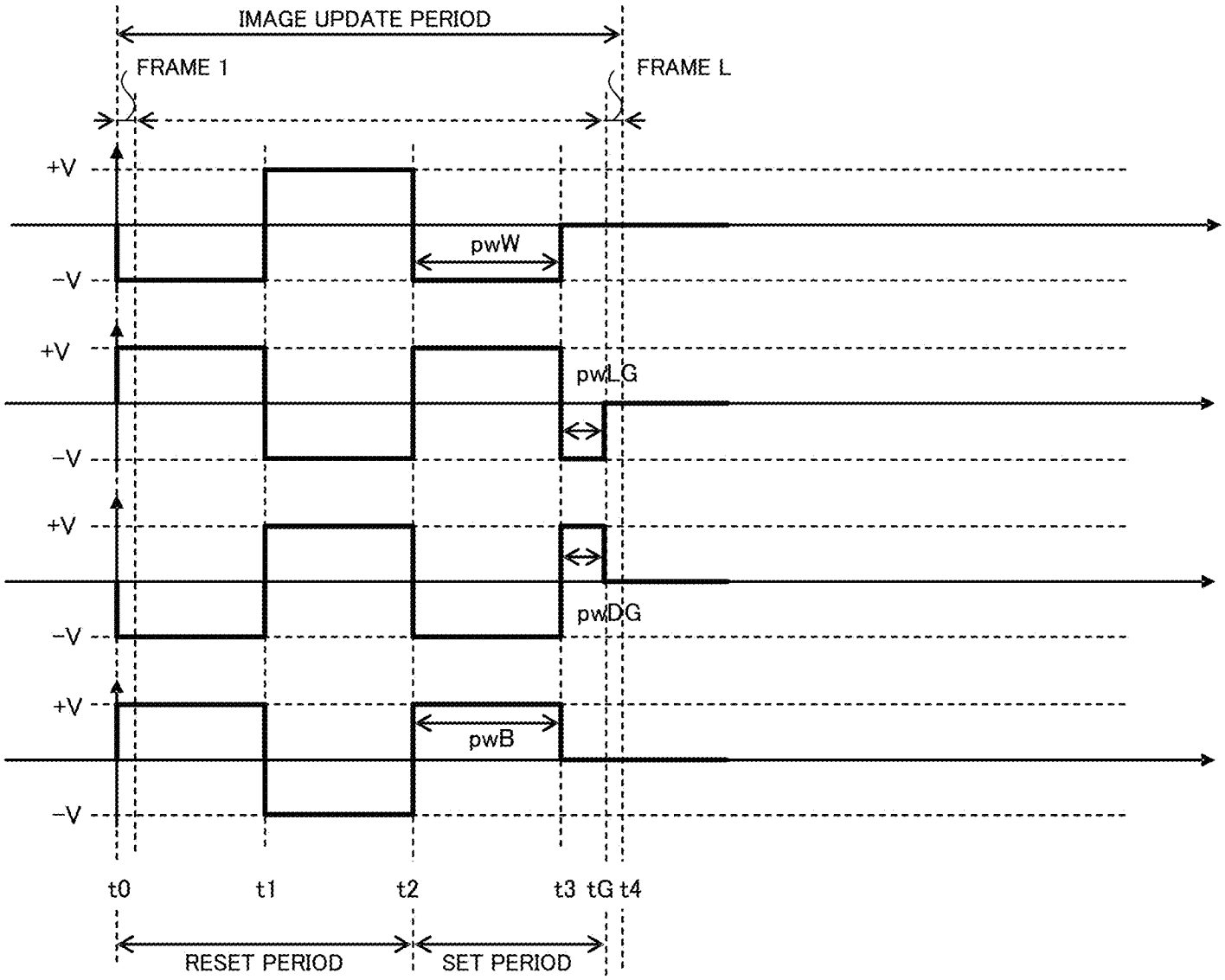
FIGS. 10A to 10D are graphs illustrating a second example of a driving waveform.

Specific examples of the driving waveforms will be described based on an example of a monochrome 4-gradation display. FIGS. 9A to 9D are graphs illustrating a first example of the driving waveform. FIG. 9A illustrates a voltage waveform to be applied to the pixel that displays W (white) next at the time of the image update, FIG. 9B illustrates a voltage waveform to be applied to the pixel that displays LG (light gray) next at the time of the image update similarly, FIG. 9C illustrates a voltage waveform to be applied to the pixel that displays DG (dark gray) next at the time of the image update, and FIG. 9D illustrates a voltage waveform to be applied to the pixel that displays B (black) at the time of the image update. The voltage waveform to be applied to the pixel is one in which a voltage (+V/0/−V) written in the pixel electrode in units of frames according to a gradation to be displayed is continuously expressed. In FIGS. 9A to 9D, a vertical axis indicate a voltage, and a unit is V. In FIGS. 9A to 9D, a horizontal axis indicates a time in which a frame is a minimum unit. An image update period of time is configured with L frames ranging from a frame 1 starting from t0 to a frame L.

t0 to t3 is a reset period of time in which a previously displayed image is erased, and t3 to t4 is a period of time in which desired gradations corresponding to FIGS. 8A to 8D are displayed and referred to as a "set period of time." In the driving waveform of FIGS. 9A to 9D, the voltage waveforms of the reset periods of time of W (white) and LG (light gray) are the same, and after the display state becomes B (black) at t3, W (white) and LG (light gray) are decided according to an applying period of time of −V from t3. Further, the voltage waveforms of the reset periods of time of B (black) and DG (dark gray) are the same, and after the display state becomes B (black) at t3, B (black) and DG (dark gray) are decided according to an applying period of time of +V from t3.

FIGS. 10A to 10D are graphs illustrating a second example of the driving waveform. In FIGS. 10A to 10D, a vertical axis indicate a voltage, and a unit is V. In FIGS. 10A to 10D, a horizontal axis indicates a period of time in which a frame is a minimum unit. In the second example of the driving waveform illustrated in FIGS. 10A to 10D, a timing at which the pixel displays LG (light gray) by applying −V during the period of time of pwLG and a timing at which the pixel displays DG (dark gray) by applying +V during the period of time of pwDG are timings after voltages are applied to cause the pixel to display W (white) and B (black), unlike the first examples of the driving waveforms of FIGS. 9A to 9D. For this reason, the voltage waveforms of W (white) and DG (dark gray) are the same during a period of time of t0 to t3, and after t3, 0 V is applied for W (white), and +V is applied during the period of time of pwDG for DG (dark gray). Further, the voltage waveforms of B (black) and LG (light gray) are the same during the period of time of t0 to t3, and after t3, 0 V is applied for B (black), and −V is applied during the period of time of pwLG for LG (light gray).

By applying the driving waveforms illustrated in FIGS. 9A to 10D, it is possible to cause the display panel 70 with the memory function employing the electrophoretic display element to perform a desired image display based on monochrome 4-gradation image data. For the sake of convenience of description, the monochrome 4-gradation driving waveforms are illustrated, but the number of gradations can be increased by increasing the number of voltage waveforms causing the pixel to perform other gray-out displays (halftone displays), and for example, the monochrome 16-gradation display can be implemented by the driving waveform configured with 16 voltage waveforms. Meanwhile, the moving speed of the charged particles (117 and 118) of the electrophoretic display element changes according to the ambient temperature.

Figure 11A:
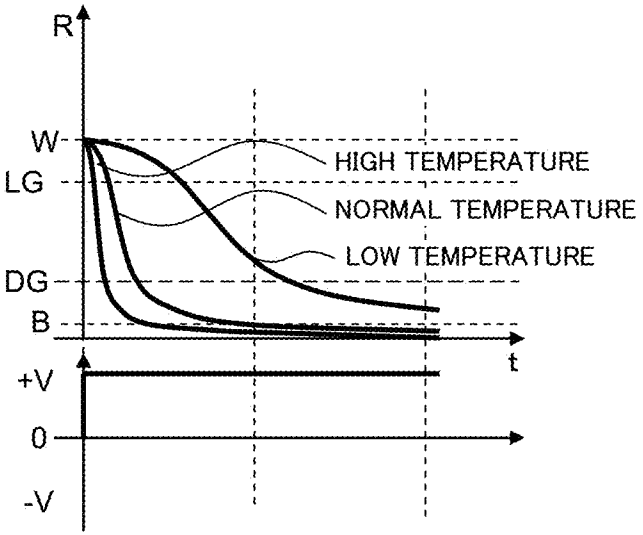
FIGS. 11A and 11B are graphs illustrating an example in which the same voltage is applied during the same period of time in a state of the same reflection rate.
Figure 11B:
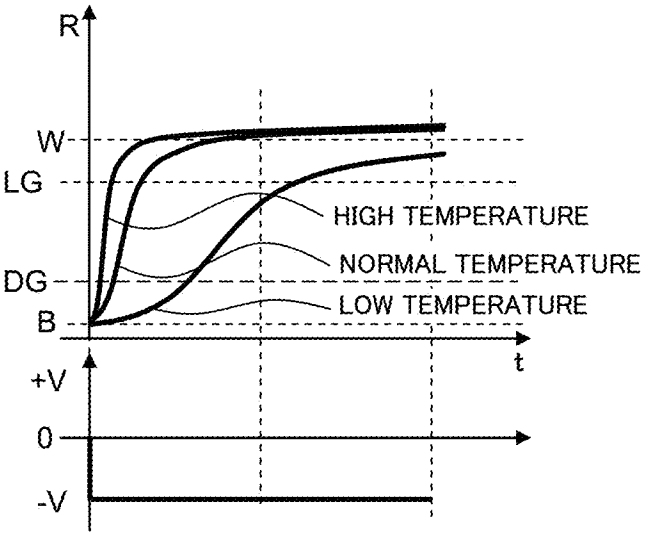

FIGS. 11A and 11B are graphs obtained by applying the same voltage during the same period of time in the state of the same reflection rate. In FIGS. 11A and 11B, a vertical axis and a horizontal axis are the same as those of FIG. 8, and a description thereof is omitted for the sake of simplicity. Thus, as illustrated in FIGS. 11A and 11B, even when the same voltage (+V or −V) is applied during the same period of time in the state of the same reflection rate, the reflection rate changes according to the temperature. In other words, even in the same driving waveform, when the temperature Tp of the display panel 70 with the memory function is changed, the same gradation data becomes the gray-out display (the halftone display) of the different reflection rate, and an effect in which the previously displayed image is erased in the reset period of time is changed as well, and thus an afterimage may occur. In order to prevent such an image quality degradation, a driving waveform in which the applying period of time is adjusted for arbitrary gradation data so that substantially the same reflection rate is obtained according to the temperature Tp is prepared. For example, driving waveforms used at the high temperature, the normal temperature, and the low temperature are designed, selected according to the temperature Tp, and used.

Next, an estimation operation of the source driver temperature Tsx after the image update in the temperature predicting unit 10 according to the first embodiment will be described. In the source driver 150, compared to when the same voltage is applied to the neighboring pixel electrodes, when different voltages are applied to the neighboring pixel electrodes, a large current is necessary, an amount of generated heat is also large, and the temperature increase ΔT is also high. The voltages to be applied to an arbitrary pixel and a neighboring pixel are decided based on image data to be displayed and the driving waveform. In other words, the temperature increase ΔT can be estimated based on the image data (image pattern) to be displayed and the driving waveform, and a value obtained by quantifying the image pattern is referred to as an "image load value." Ideally, the image load value is decided so that the temperature increase ΔT of the source driver 150 is proportional to the image load value.

Figure 12:
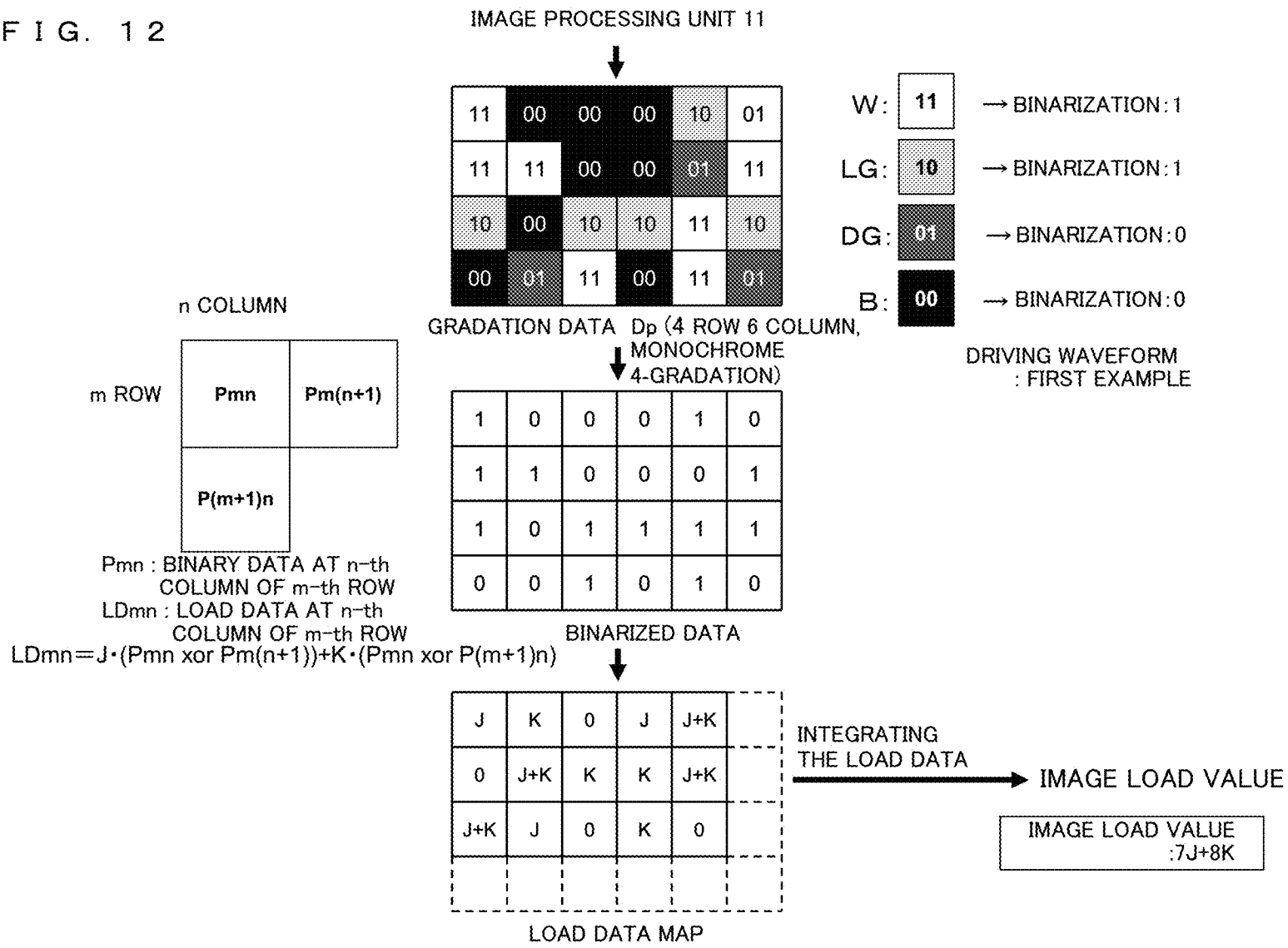
FIG. 12 is an explanatory diagram illustrating a specific example of a process of calculating an image load value in an image load value calculating unit illustrated in FIG. 6.

FIG. 12 is an explanatory diagram illustrating a specific example of a process of calculating an the image load value in the image load value calculating unit 12 illustrated in FIG. 6. As described above, the gradation data Dp that is converted according to characteristics of the display panel 70 with the memory function is input from the image processing unit 11 to the image load value calculating unit 12. In the example of FIG. 12, the display panel 70 with the memory function are configured with 4×6 pixels and displays the monochrome 4-gradation display. Here, gradation values displayed by the pixel are indicated by binary expressions such as W (white)=11, LG (light gray)=10, DG (dark gray)=01, and B (black)=00.

The input gradation data Dp is binarized ("0" or "1") according to the gradation value and the driving waveform. W (white)=11 is indicated by "1," B (black) is indicated by "0," the gray (halftone) is decided with reference to the driving waveform to be used. In FIG. 12, the first example of the driving waveform illustrated in FIG. 9 is used. As illustrated in FIGS. 8A to 8D, LG whose voltage waveform is the same as the voltage waveform of W in many parts is indicated by "1," and, similarly, DG whose voltage waveform is the same as the voltage waveform of B in many parts is indicated by "0." The converted binary data has a relation in which many periods of time (frames) correspond to the voltage to be applied to the pixel, for example, the different voltages are applied when the binary data of the two neighboring pixels are "0"-"1" or "1"-"0." A relation between the binary data and the applied voltage will be described using a specific example of FIG. 13. FIG. 13 is an explanatory diagram illustrating the relation between the binary data and the applied voltage. As illustrated in FIG. 13, the distribution of the voltages actually applied to the pixel according to the image pattern and the first example of the driving waveform (see FIG. 9) is illustrated. In FIG. 13, +V=15 [V] and −V=−15 [V] are set, voltages applied to 3×4 pixels during t0 to t1, t1 to t2, t2 to t3, t3 to tG, and tG to t4 are illustrated. In FIG. 13, the voltages applied to the pixels that display W (white) and LG (light gray) during t0 to tG are the same and can be dealt as "1" serving as a binary expression as described above.

A process of calculating an the image load value based on the binary data of FIG. 12 will be described in detail. First, binary data (P11) of a pixel at a first column of a first row is compared with binary data (P12) of a neighboring pixel at a second column of the first row in the horizontal direction, and 0 is obtained when the binary data (P11) is identical to the binary data (P12), and J is obtained when the binary data (P11) is different from the binary data (P12). In the example of FIG. 12, J is obtained since the binary data (P11) is different from the binary data (P12). Then, the binary data (P11) of the pixel at the first column of the first row is compared with binary data (P21) of a neighboring pixel at a column of a second row in the vertical direction, 0 is obtained when the binary data (P11) is identical to the binary data (P21), and K is obtained when the binary data (P11) is different from the binary data (P21). In the example of FIG. 12, since the binary data (P11) is identical to the binary data (P21), 0 is obtained. Lastly, the values obtained by comparing the pixel at the first column of the first row with the neighboring pixels in the vertical and horizontal directions are added. The added value is referred to as "load data." In the example of FIG. 12, the load data of the pixel at the first column of the first row is J (=J+0). Similarly, the load data of a pixel at a second column of a first row, a pixel at a third column of a first row, . . . , a pixel at a fifth column of a first row, a pixel at a first column of a second row, . . . , a pixel at a fifth column of a second row, a pixel at a first column of a third row, . . . , and a pixel at a fifth column of a third row is obtained, and a load data map illustrated in FIG. 12 is obtained. The load data of pixels in a six column and a fourth row is not calculated. Thus, the load data map is 3×5 load data, and a value obtained by integrating the load data is referred to as an "image load value." In the example of FIG. 12, the image load value is 7J+8K. Here, J is a coefficient for the number of times that different voltages are applied in the horizontal direction between pixels in the first to third rows, and K is a coefficient for the number of times that different voltages are applied in the vertical direction between pixels in the first to fifth rows. In other words, J is a weighting of an image frequency in a direction in which the scanning line extends, and K is a weighting of an image frequency in a direction in which the source line extends.

A method of deciding the coefficients J and K will be described later.

Figure 14:
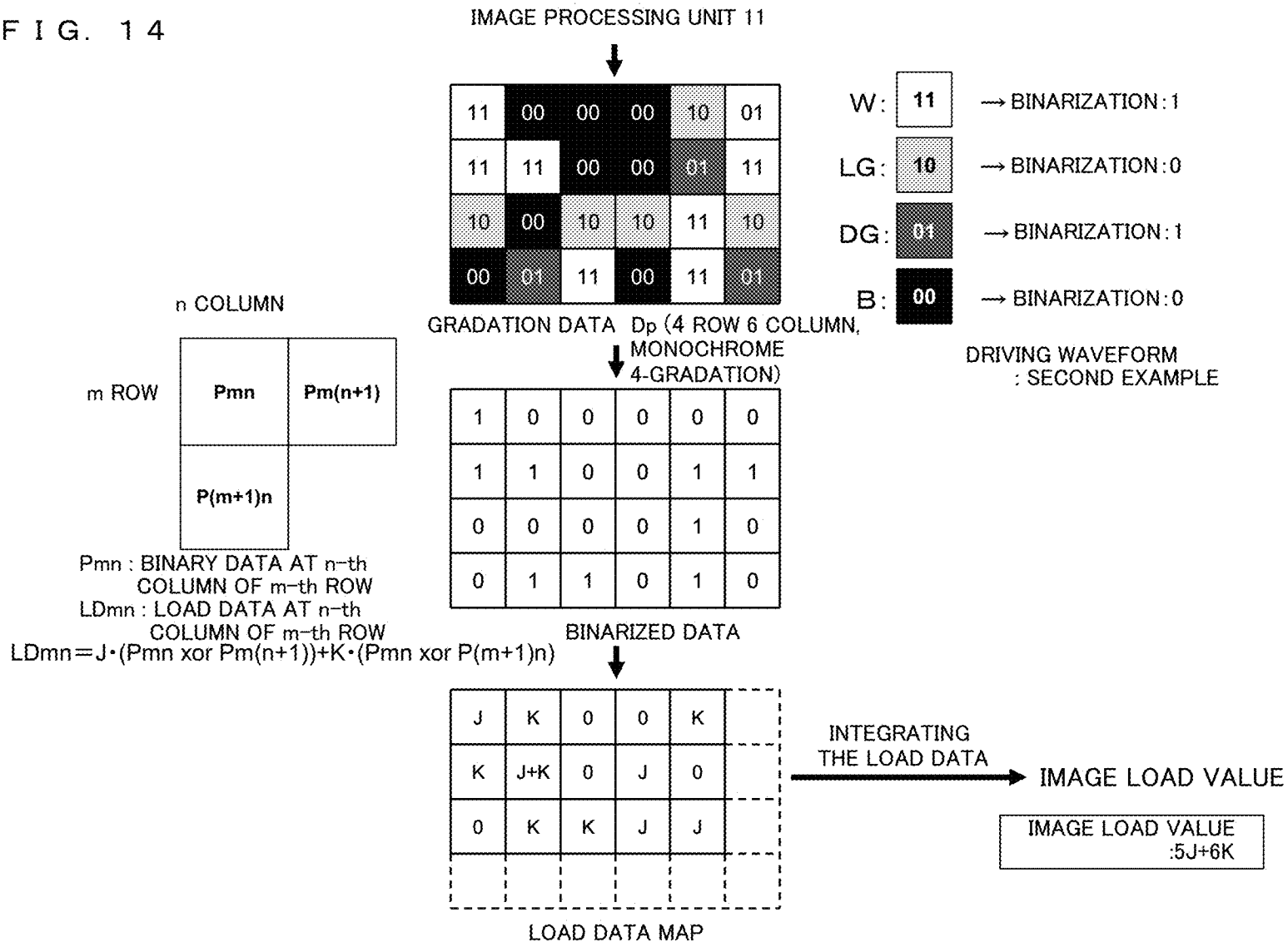
FIG. 14 illustrates a calculation example of an image load value when another driving waveform is used.

FIG. 14 illustrates a calculation example of the image load value when another driving waveform is used. In FIG. 14, the second example illustrated in FIG. 10 is used. The same gradation data Dp as in FIG. 12 is input, but since the driving waveform is different, a value obtained by binarizing the gray (halftone) is different from that of FIG. 12. When the driving waveform of the second example is used, "0" is obtained for LG (light gray) since the voltage waveform of LG (light gray) is the same as the voltage waveform of B (black) in many parts, and "1" is obtained for DG (dark gray) since the voltage waveform of DG (dark gray) is the same as the voltage waveform of W (white) in many parts. FIG.

15 is an explanatory diagram illustrating the relation between the binary data and the applied voltage in the second example. As illustrated in FIG. 15, the distribution of the voltages actually applied to the pixel according to the second example of the driving waveform (see FIG. 10) is illustrated. In FIG. 15, the voltages applied to the pixels that display B (black) and LG (light gray) during t0 to t3 are the same and can be dealt as "0" serving as a binary expression as described above.

Since the value obtained by binarizing the gray (halftone) is different from that of FIG. 12 as described above, pixels having different load data occur. Thus, the image load value obtained by integrating the load data is also different from that of the example of FIG. 12, and in the example of FIG. 14, the image load value is 5J+6K.

The calculation of the image load value has been described in FIG. 12 and FIG. 14 in connection with the example in which the 4×8 gradation data Dp of the monochrome 4-gradation is input, but, for example, even when the display panel performs the monochrome 16-gradation display, the image load value can be similarly calculated. The driving waveform used for the monochrome 16-gradation display is referred to when the binary data is generated, and, preferably, "1" is obtained when the voltage waveform of the gray-out display (the halftone display) is the same as the voltage waveform of W (white) in many parts, and "0" is obtained when the voltage waveform of the gray-out display (the halftone display) is the same as the voltage waveform of B (black) in many parts. The number of pixels of the display panel is not limited to 4×8 and may be M×N.

In a display panel configured with M×N pixels, if binary data at an n-th column of an m-th row is indicated by Pmn, the load data of an arbitrary pixel at the n-th column of the m-th row is indicated by LDmn, the image load value of image data at the n-th column of the m-th row is indicated by PLD, load data LDmn is indicated by the following Formula (1).

[Math. 1]

$$LD_{mn}=J\cdot(P_{mn}\ \mathrm{XOR}\ P_{m(n+1)})+K\cdot(P_{mn}\ \mathrm{XOR}\ P_{(m+1)n}) \quad (1)$$

XOR is an exclusive OR. Image load value PLV of the image data at the n-th column of the m-th row is indicated by the following Formula (2).

[Math. 2]

$$PLV=\Sigma_{m=1}^{M-1}\Sigma_{n=1}^{N-1}LD_{mn} \quad (2)$$

An image load value PLV of the display panel configured with the M×N pixels can be calculated using Formulas (1) and (2).

Next, the method of deciding the coefficients J and K will be described.

The coefficients J and K are decided by causing the display panel 70 with the memory function that is actually used to display a basic image pattern and measuring the temperature increase ΔT of the source driver 150 at the time of image update.

FIGS. 16A to 16D are distribution diagrams illustrating a relation between the temperature increase ΔT and the image load value when the coefficients J and K are changed. FIGS. 16A to 16D illustrate the relation between the temperature increase ΔT measured for each image pattern using the driving waveform of the first example (see FIG. 9) and the image load value when the coefficients J and K are changed. In graphs illustrated in FIGS. 16A to 16D, a horizontal axis is an image load value that is normalized by dividing the image load values calculated from the respective image patterns by the image load value of the image pattern (a white/black check pattern in units of one pixel in this example) that is highest in the temperature increase ΔT. A vertical axis indicates the temperature increase ΔT, and a unit is ° C.

The temperature increase ΔT when the normalized image load value is 1 is indicated by Tα, the temperature increase ΔT in the case of the image pattern (for example, an all-white image) in which the image load value is calculated to be 0 is indicated by Tβ, and a straight line connecting Tα with Tβ is indicated by a broken line.

Thus, the image load value and the temperature increase ΔT are in the proportional relation when the coefficients J and K are decided so that the temperature increase ΔT measured for the value obtained by normalizing the image load value PLV calculated using Formulas (1) and (2) approximates to the broken line of the graph. Thus, when the coefficients J and K are decided as described above, the temperature increase ΔT of the source driver 150 at the time of image update by an arbitrary image pattern is obtained using the following Formula (3) by calculating the image load value PLV.

$$\Delta T=(T\alpha-T\beta)\times PLV/PLV\max+T\beta \quad (3)$$

Here, PLVmax indicates the image load value of the image pattern in which the temperature increase ΔT is highest.

Figure 16A:
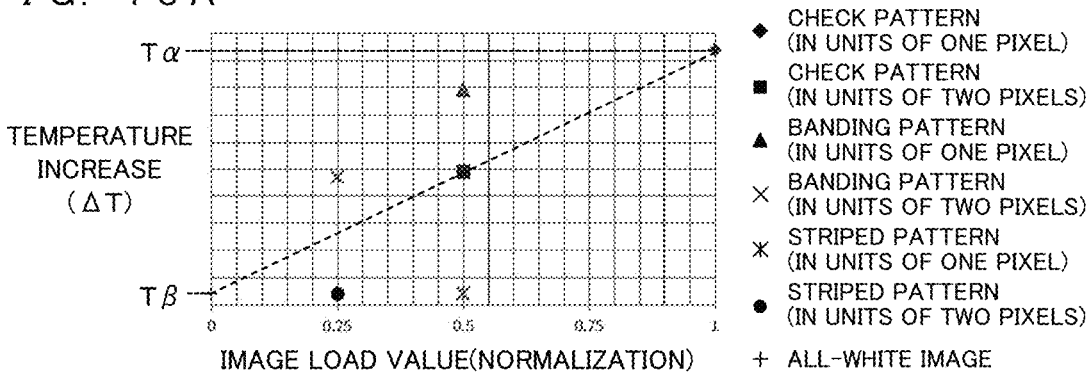
FIGS. 16A to 16D are distribution diagrams illustrating a relation between a temperature increase ΔT and an image load value when coefficients J and K are changed.

FIG. 16A illustrates a relation between the image pattern when the image load value is calculated using J=1 and K=1 and the measured temperature increase ΔT. The temperature increases ΔT of the source driver that are actually measured for the image patterns in which the same image load value (0.5 or 0.25) is calculated using these coefficient are greatly different. Thus, a possibility that ΔT that is calculated based on the image load value calculated using the coefficients and Formula (3) will not be identical to the actual source driver temperature increase is very high.

Figure 16B:
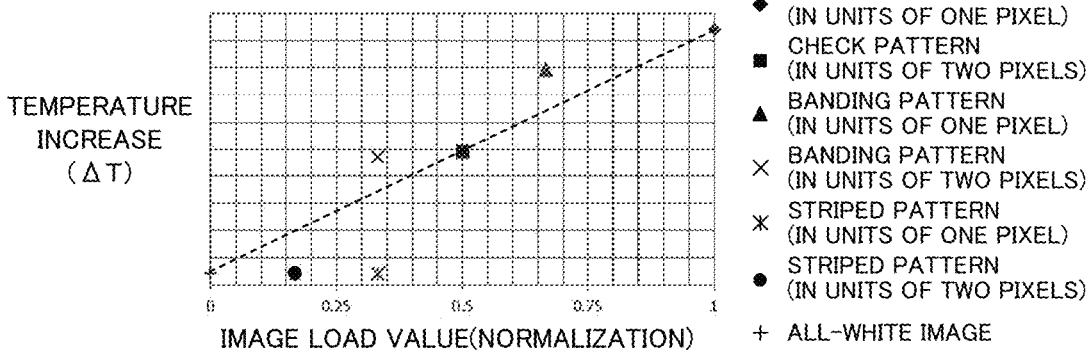
Figure 16C:
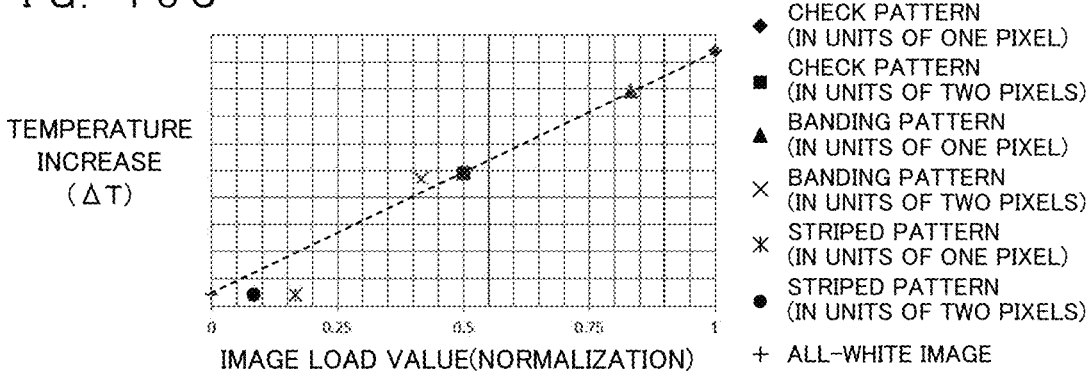
Figure 16D:
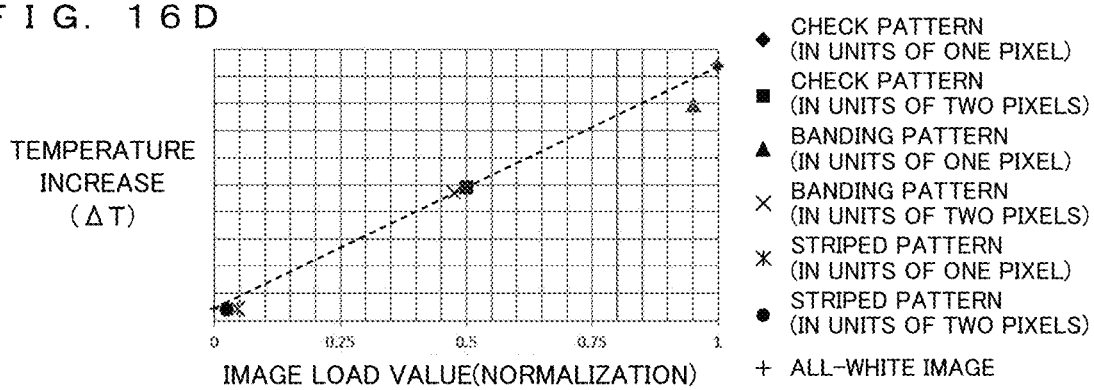

FIG. 16B illustrates a relation between the image pattern when the image load value is calculated using J=1 and K=2 and the measured temperature increase ΔT, FIG. 16C similarly illustrates a relation between the image pattern when the image load value is calculated using J=1 and K=5 and the measured temperature increase ΔT, and FIG. 16D illustrates a relation between the image pattern when the image load value is calculated using J=1 and K=20 and the measured temperature increase ΔT. In FIG. 16B, there is a discrepancy between the actually measured temperature increases ΔT of the source driver for the image patterns (a banding pattern (in units of two pixels) and a stripe pattern (in units of one pixel)) in which the same image load value is calculated. Further, since the banding pattern (in units of one pixel) in which the actually measured temperature increase ΔT is relatively high is higher than the broken straight line, the temperature increase that is lower than the actually measured temperature increase is calculated by Formula (3). For this reason, it is desirable that the coefficients J and K satisfy a condition that at least K is larger than 2 when J=1. For example, in the case of J=1 and K=5 illustrated in FIG. 16C, ΔT of the banding pattern (in units of one pixel) that is actually measured overlaps a straight line indicated by a broken line, and it is not problematic although it is applied. Further, FIG. 16D can be applied since in the case of J=1 and K=20, the actual measurement result approximates the straight line of Formula (3). However, since the temperature measured by Formula (3) is higher than the actually measured temperature increase ΔT of the banding pattern (in units of one pixel), the source driver temperature after the image update is likely to be estimated to be higher than the actual temperature. Due to the above reasons, it is desirable that the coefficients J and K be decided to be J=1 and 2<K<20. In other words, it is desirable that K be larger than J.

As described above, as the coefficients J and K are decided, the temperature increase ΔT of the source driver 150 for an arbitrary gradation data Dp can be calculated using Formula (3). This calculation is performed by the temperature increase estimating unit 16. In order to perform this calculation, temperature increase data at the time of image update which is measured according to the source driver temperature for each driving waveform selected according to the display panel temperature Tp is stored in the temperature increase estimating unit 16. FIG. 17 illustrates an example of the stored data.

FIG. 17 illustrates table data storing the measurement value (the temperature increase ΔT). As illustrated in FIG. 17, the table data stores the measurement value (the temperature increase ΔT) obtained by measuring a source driver temperature increase α when the image update is performed on the image pattern having the largest image load value and a source driver temperature increase β when the image update is performed on the image pattern having the smallest image load value while changing the source driver temperature at intervals of 5° C. for the three driving waveforms, that is, the driving waveform for the high temperature (39° C. to 20° C.), the driving waveform for the normal temperature (19° C. to 8° C.), and the driving waveform for the low temperature (7° C. to 0° C.) which are selected according to the display panel temperature Tp. For example, when the display panel temperature Tp is 18° C., and the source driver temperature Ts is 20° C., αN20 and βN20 are used as Tα and Tβ with reference to FIG. 17, and the source driver temperature increase ΔT is calculated based on the image load value using Formula (3).

The source driver temperature Tsx after the image update is calculated using the following Formula (4) based on the calculation result of the temperature increase ΔT and the source driver temperature Ts.

$$Tsx = Ts + \Delta T \quad (4)$$

As described above, the temperature predicting unit 10 estimates the source driver temperature Tsx after the image update for the input image data 2.

The operation of estimating the source driver temperature Tsx through the temperature increase estimating unit 16 is performed according to the request signal req input from the image display control unit 20.

Figure 18:
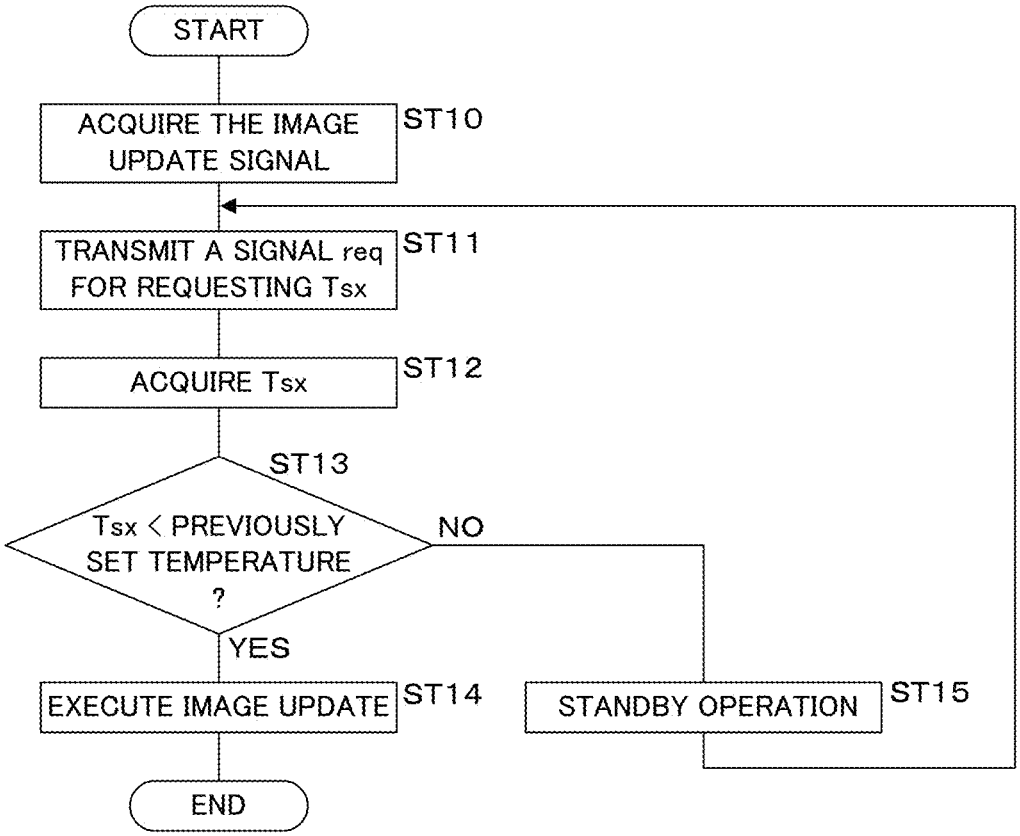
FIG. 18 is a flowchart for describing an operation of an image display control unit.

Next, an operation of the image display control unit 20 will be described with reference to FIG. 3, FIG. 6, FIG. 7, and FIG. 18. FIG. 18 is a flowchart for describing an operation of the image display control unit 20.

The image update determining unit 21 (see FIG. 7) acquires the image update signal 3 to instruct the image update from the application processor 1 (step ST10). The image update determining unit 21 transmits a signal req for requesting the temperature predicting unit 10 to transmit the source driver temperature Tsx after the image update (step ST11). Upon receiving the signal req, the temperature predicting unit 10 (see FIG. 3) acquires the current source driver temperature Ts in the temperature increase estimating unit 16 (see FIG. 6), calculates the source driver temperature Tsx after the image update based on the image load value and the selected driving waveform, and transmits the source driver temperature Tsx after the image update to the image display control unit 20 (see FIG. 7). The transmitted temperature Tsx is acquired by the image update determining unit 21 (step ST12). Then, the image update determining unit 21 determines whether or not the acquired temperature Tsx is lower than a previously set temperature (step ST13). When the determination result of step ST13 is NO, the image update is not performed, and an standby operation is performed during a certain period of time (step ST15). After the standby operation, the signal req for requesting the temperature Tsx is transmitted again (step ST11). When the determination result of step ST13 is YES, a signal to instruct an operation is output from the image update determining unit 21 to the panel control signal generating unit 22 (see FIG. 7), a signal and a voltage (ct1 and ct2) for controlling the source driver and the gate driver are output according to this signal, the data reading unit 23 reads data forming an image from the memory 160 (see FIG. 7) in synchronization with the control signal, and Da is output according to the specification of the source driver 150 (step ST14).

As described above, by configuring and operating the display device with the memory function, it is possible to maintain the temperature of the source driver 150 to be equal to or less than the set temperature without deteriorating the display image quality. Thus, by setting an appropriate temperature based on the specification of the source driver as the set temperature, it is possible to prevent the image quality deterioration, the performance degradation of the source driver, and the breakdown of the source driver which are caused by the operation failure occurring when the operation guarantee temperature of the source driver is exceeded, and it is possible to implement the reliable high-quality display device with the memory function.

The operation of the temperature increase estimating unit 16 has been described using the example illustrated in FIG. 17 as the actually measured data of the stored source driver temperature increase, but the actually measured data is not limited to the example of FIG. 17. Further, the source driver temperature increase may be measured according to the display panel temperature Tp, and data illustrated in FIG. 19 may be used. FIG. 19 illustrates another measurement data of the source driver temperature increase ΔT stored in the temperature increase estimating unit. As illustrated in FIG. 19, the temperature increase data measured under a temperature condition (for example, at intervals of 4° C.) divided according to the temperature Ts regarded as the ambient temperature of the source driver from the applying temperature range of the driving waveform decided according to the display panel temperature Tp is stored. Thus, since the ambient temperature is reflected, it is possible to calculate the temperature increase ΔT more accurately and increase the accuracy of the estimated temperature Tsx. When the data illustrated in FIG. 19 is used, it is desirable that the temperature Tp is output from the driving waveform selecting unit 15 (see FIG. 6) to the temperature increase estimating unit.

Instead of the data illustrated in FIG. 17, data illustrated in FIG. 20 may be applied. FIG. 20 illustrates another measurement data of the source driver temperature increase ΔT stored in the temperature increase estimating unit. It is an example in which the number of driving waveforms selected according to the display panel temperature Tp is increased from 3 to 8, and it is desirable to store the driving waveforms WF03, WF07, . . . , WF39 generated at intervals of the display panel temperature 4° C. in driving waveform data (a storage unit) 14 (see FIG. 6) and select the driving waveform to be used according to the display panel temperature Tp through the driving waveform selecting unit 15.

In the first embodiment, when the image update determining unit 21 determines the estimated source driver temperature Tsx to be equal to or higher than the set temperature, the image update is not performed. Thus, the display image does not change until the source driver temperature Tsx is equal to or less than the set temperature. When the user intentionally performs the image update, the user is likely to be confused unless the display image does not react immediately. A display device with the memory function according to the present invention that provides a countermeasure for preventing the user's confusion will be described below as a modified example of the first embodiment. Except components and operations to be described below, the remaining components and operations are the same as those in the first embodiment, and for example, the method of calculating the image load value, particularly the method of deciding the coefficients J and K serving as the weighting is the same as the method described with reference to FIG. 16.

Figure 21:
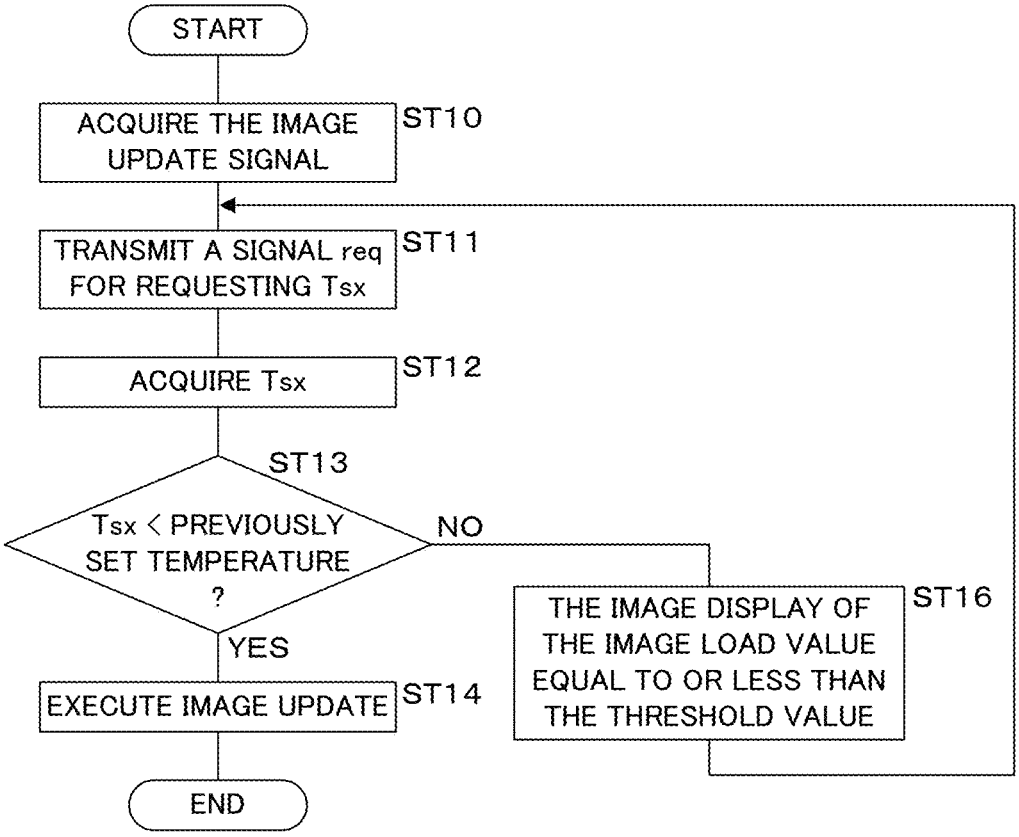
FIG. 21 is a flowchart for describing an operation of an image display control unit according to a modified example of the first embodiment.

FIG. 21 is a flowchart for describing an operation of an image display control unit 20 according to the modified example of the first embodiment. The operation according to the modified example of the first embodiment differs from that of the first embodiment in an operation of performing an image display of an image load value equal to or less than a threshold value when the determination result of step ST13 is NO. For example, the threshold value is 0 to 0.1, and preferably equal to or less than 0.01. As described above in the operation of the temperature predicting unit 10 according to the first embodiment, as the number of pixels in which different voltages are applied to neighboring pixel electrodes in the display unit 90 increases, the image load value increases. Further, when the determination result of step ST13 is NO, the image display of the smallest image load value among the image load values equal to or less than the threshold value may be performed. Thus, in the case of the first embodiment, an image of the smallest image load value is an image in which the same colors is displayed through all the pixels of the display unit 90, for example, an all-white image or an all-black image.

Since the image display of the image load value equal to or less than the threshold value is performed in step ST16, even when the determination result of step ST13 is NO, the image update determining unit 21 of the present modified example outputs the signal to instruct an operation to the panel control signal generating unit 22. In addition, information indicating whether an image to be displayed is an image of the image load value equal to or less than the threshold value (when the determination result of step ST13 is NO) or an update image (when the determination result of step ST13 is YES) is added to this signal. When the determination result of step ST13 is NO, the panel control signal generating unit 22 outputs an instruction for instructing the data reading unit 23 to read the image data of the image load value equal to or less than the threshold value and output Da in response to this signal. The image data of the image load value equal to or less than the threshold value is preferably stored in the memory 160 in advance.

According to the above modification of the first embodiment, even when the estimated source driver temperature Tsx is equal to or higher than the set temperature, it is possible to prevent the user's confusion when the display image is changed, but the display screen does not react immediately.

Next, a display device with a memory function according to a second embodiment of the present invention will be described. The second embodiment differs from the first embodiment in a method of calculating the image load value. In the first embodiment, the image load value is calculated based on the gradation data Dp, whereas in the second embodiment, the image load value is calculated based on DpWF output from the data converting unit 13.

[Description of Configuration]

Figure 22:
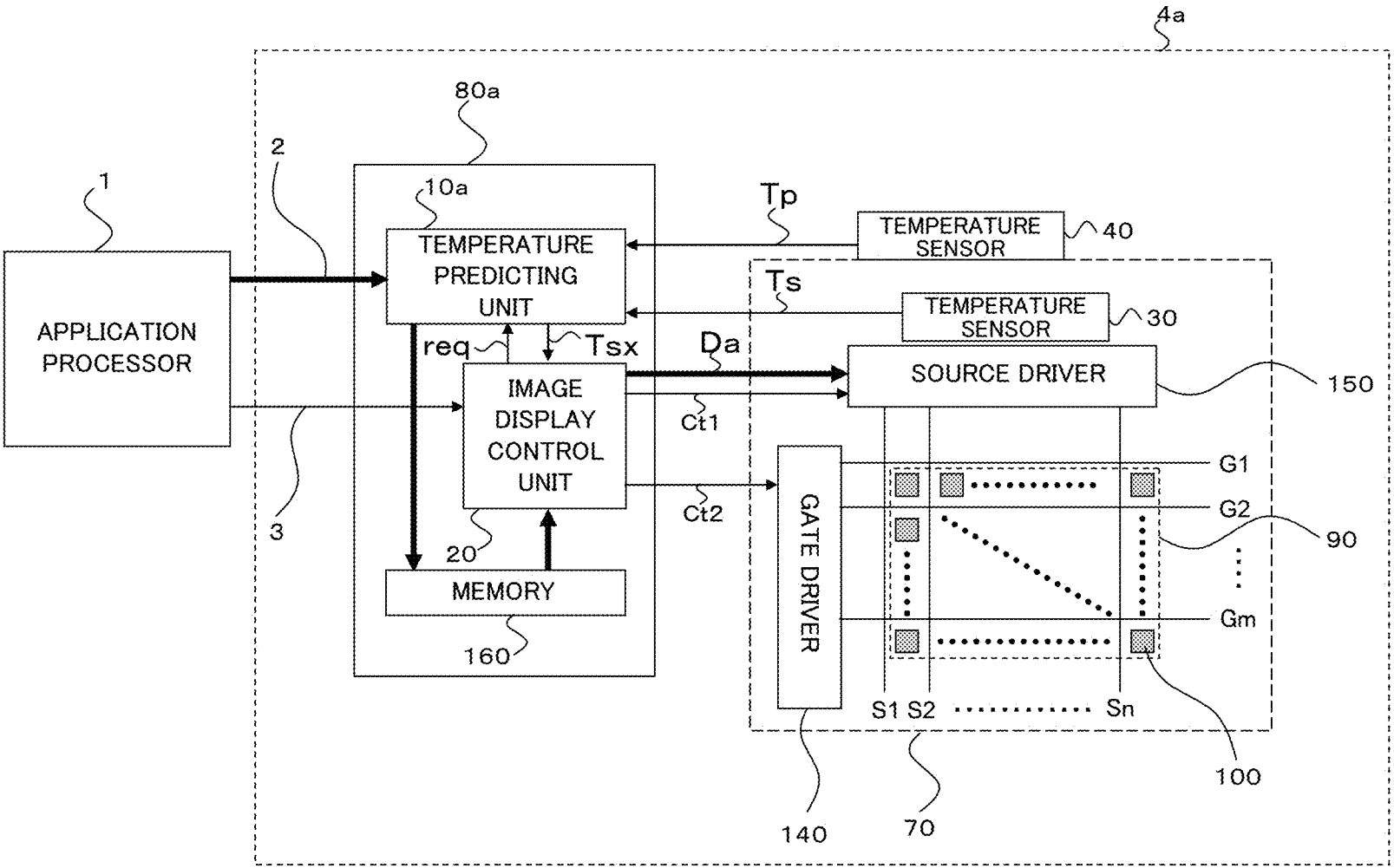
FIG. 22 is a block diagram for describing a configuration of a display device with a memory function according to a second embodiment.

FIG. 22 is a block diagram for describing a configuration of the display device with the memory function according to the second embodiment. The configuration of the display device with the memory function according to the second embodiment differs from that of the first embodiment (FIG. 3) in a temperature predicting unit 10*a*, the remaining components are the same, and thus a description thereof is omitted.

Figure 23:
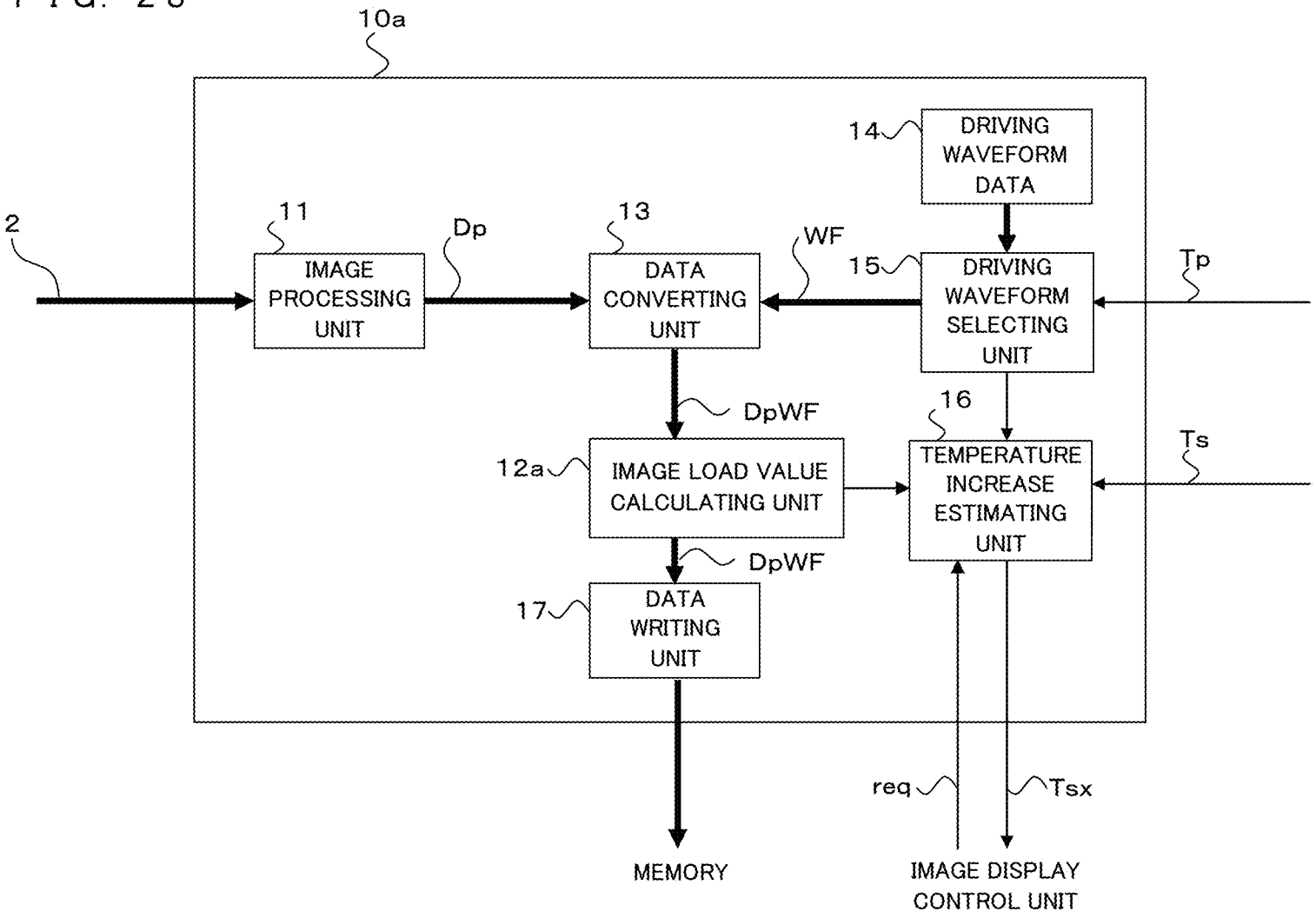
FIG. 23 is a block diagram of a temperature predicting unit according to the second embodiment.

FIG. 23 is a block diagram of the temperature predicting unit 10*a* according to the second embodiment. The temperature predicting unit 10*a* according to the second embodiment differs from the temperature predicting unit 10 (FIG. 6) according to the first embodiment in that an image load value calculating unit 12*a* is provided, Dp output from the image processing unit 11 is input only to the data converting unit 13, DpWF output from the data converting unit 13 is input to the image load value calculating unit, and DpWF is input to the data writing unit 17 through the image load value calculating unit. The remaining components of the temperature predicting unit 10*a* are the same as those of the first embodiment.

[Description of Operation]

Next, an operation of the temperature predicting unit 10*a* according to the second embodiment will be described focusing on different points from the first embodiment.

Figure 24:
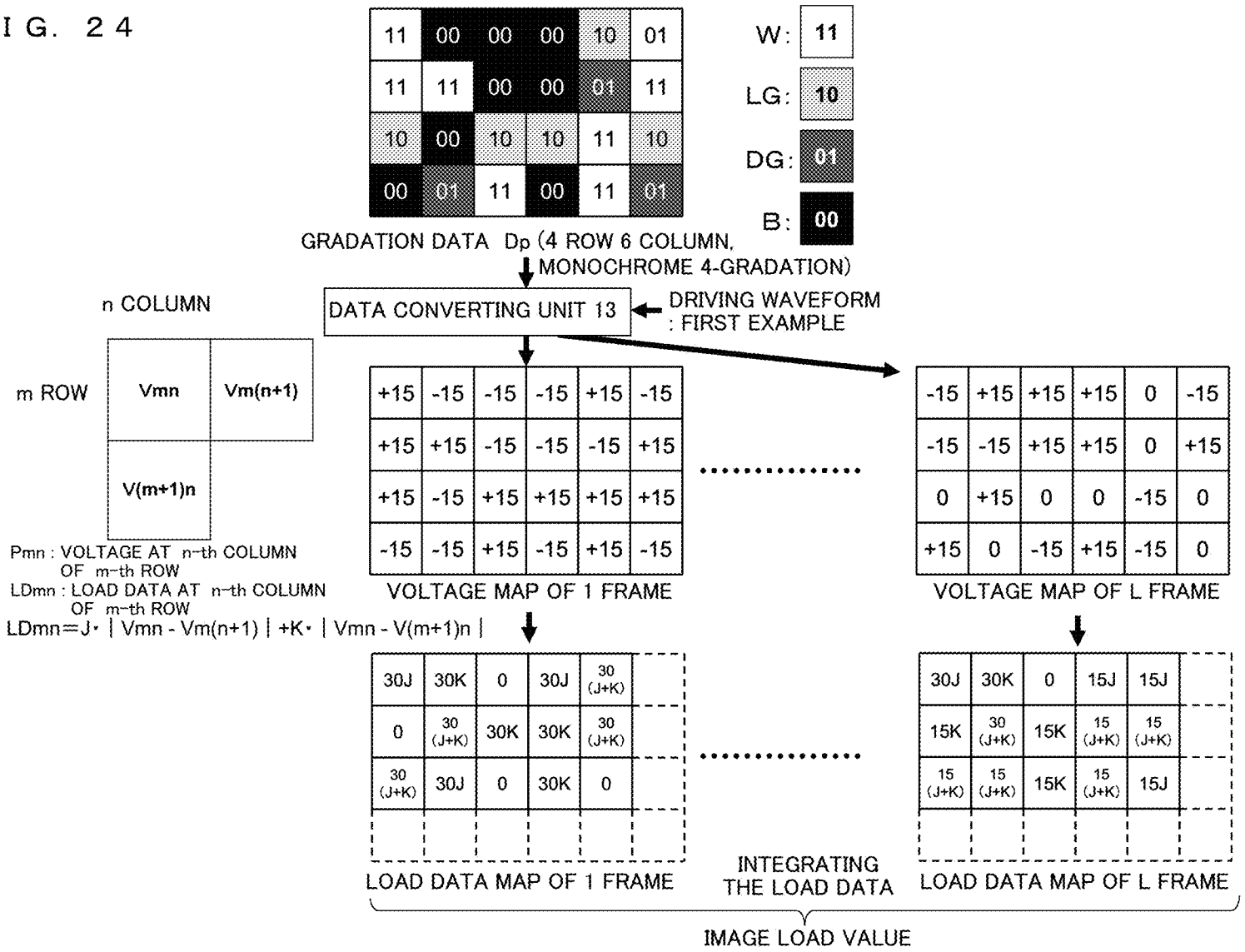
FIG. 24 is an explanatory diagram for describing a process of calculating an image load value in an image load value calculating unit 12*a* configuring a temperature predicting unit illustrated in FIG. 22.

FIG. 24 is an explanatory diagram for describing a process of calculating the image load value through the image load value calculating unit 12*a* configuring the temperature predicting unit 10*a* illustrated in FIG. 22. Similarly to the description of the first embodiment (see FIG. 12), the description will proceed with an example in which the display panel 70 with the memory function performs the monochrome 4-gradation display of the 4×6 matrix form, and the gradation data Dp having the same data as in FIG. 12 is converted by the data converting unit 13 according to the first example of the driving waveform illustrated in FIG. 9 and input to the image load value calculating unit 12*a*. +V=+15 [V] and −V=−15 [V] are used as a voltage to be applied to the pixel.

As described above, data DpWF input to the image load value calculating unit 12*a* has a 3D array including voltage data applied to the pixels in a frame 1, a frame 2, . . . , a frame L. Here, a 2D array of voltages to the pixels in a frame l (l=1, 2, . . . , L) is referred to as a voltage map of the frame l. FIG. 24 illustrates the voltage maps of the frame 1 and the frame L, and the voltage maps of the remaining frames are omitted.

In the second embodiment, instead of the binary data in the first embodiment, the load data is obtained from the voltage map, and the image load value is calculated. As a method of calculating the load data in each pixel, similarly to the first embodiment, a method of comparing voltages of neighboring pixels in the horizontal and vertical directions and adding the coefficients J and K when the voltages are different is used, but the calculation method of the second embodiment differs from the calculation method of the first embodiment in that a voltage value with a sign is used for an operation. In the second embodiment, the load data LDmn may be indicated by the following Formula (5) when a voltage of a pixel at an n-th column of an m-th row is indicated by Vmn.

[Math. 3]

$$LD_{mn}=J\cdot|(V_{mn}-V_{m(n+1)})|+K\cdot|(V_{mn}-V_{(m+1)n})| \quad (5)$$

Here, | | indicates an absolute value.

The load data LDmn is integrated up to an (M−1)-th row and an (N−1)-th column, and an integrated value of the frame 1 to the frame L, that is, the image load value PLV may be indicated by the following Formula (6).

$$PLV=\Sigma_{l=1}^{L}\Sigma_{m=1}^{M-1}\Sigma_{n=1}^{N-1}LDmn \quad \text{[Math. 4]}$$

As described above, in the second embodiment, the image load value PLV of the display panel configured with M×N pixels is calculated using Formulas (5) and (6).

Since the load data is obtained using Formula (5), the load data is added to the image load value even in the pixel, to which +15 or −15 [V] is applied, adjacent to the pixel to which 0 [V] is applied as illustrated in FIG. 12. A value added when +15 or −15 [V] is separated from 0 [V] is half a value added when +15 [V] and −15 [V] are adjacent.

In other words, a value that is proportional to a difference in an applied voltage between neighboring pixels can be calculated using Formula (5), and a weighting that is proportional to the magnitude of the voltage difference between the neighboring pixels is included. Thus, it is possible to increase the resolution of the image load value to be higher than that of the calculation method of the first embodiment.

In the second embodiment in which the calculation is performed using Formulas (5) and (6), the image load value includes the coefficients J and K, but similarly to the method described above in the first embodiment, the coefficients J and K can be decided by causing the specific image pattern to be displayed on the display panel 70 that is actually used and measuring the temperature increase ΔT of the source driver 150.

By deciding the coefficients J and K and performing the normalization so that the maximum value of the image load value is 1, similarly to the first embodiment, it is possible to estimate the temperature increase ΔT for the arbitrary image data 2 using Formula (3). Thus, the temperature increase estimating unit 16 of the second embodiment illustrated in FIG. 23 can estimate the source driver temperature Tsx after the image update through the same configuration and operation as those of the first embodiment and output the source driver temperature Tsx after the image update to the image display control unit 20.

An operation according to the second embodiment that has not described above is the same as in the first embodiment, for example, the same as the flowchart illustrated in FIG. 18, and thus a description thereof is omitted. The modified example of the first embodiment can be applied to the second embodiment, and the same effects as the effects described in the modified example of the first embodiment are obtained.

The display device with the memory function of the second embodiment of the present invention that operates with the above-described configuration can increase the resolution of the image load value to be higher than that of the first embodiment, and thus it is possible to increase the estimation accuracy of the temperature increase ΔT and predict the source driver temperature Tsx more accurately.

In addition, since the weighting proportional to the voltage difference between the neighboring pixels is included, the description of the second embodiment can be applied to the source driver of the multiple outputs with no particular change. Thus, for example, it can be applied to the electrophoretic display device that performs a multi-color display using two or more colored particles having different voltage threshold values.

Further, in the first embodiment, the binary data is generated based on the gradation data Dp and the driving waveform, if the driving waveform for implementing multiple gradations or a high image quality gets complicated, a possibility that linearity of the image load value and the temperature increase ΔT calculated based on the binary data will be distorted increases. Further, when the driving waveform gets complicated, a workload necessary for generation of the binary data is increased, and it is necessary to review the binary data each time the driving waveform is revised as well.

Figure 25:
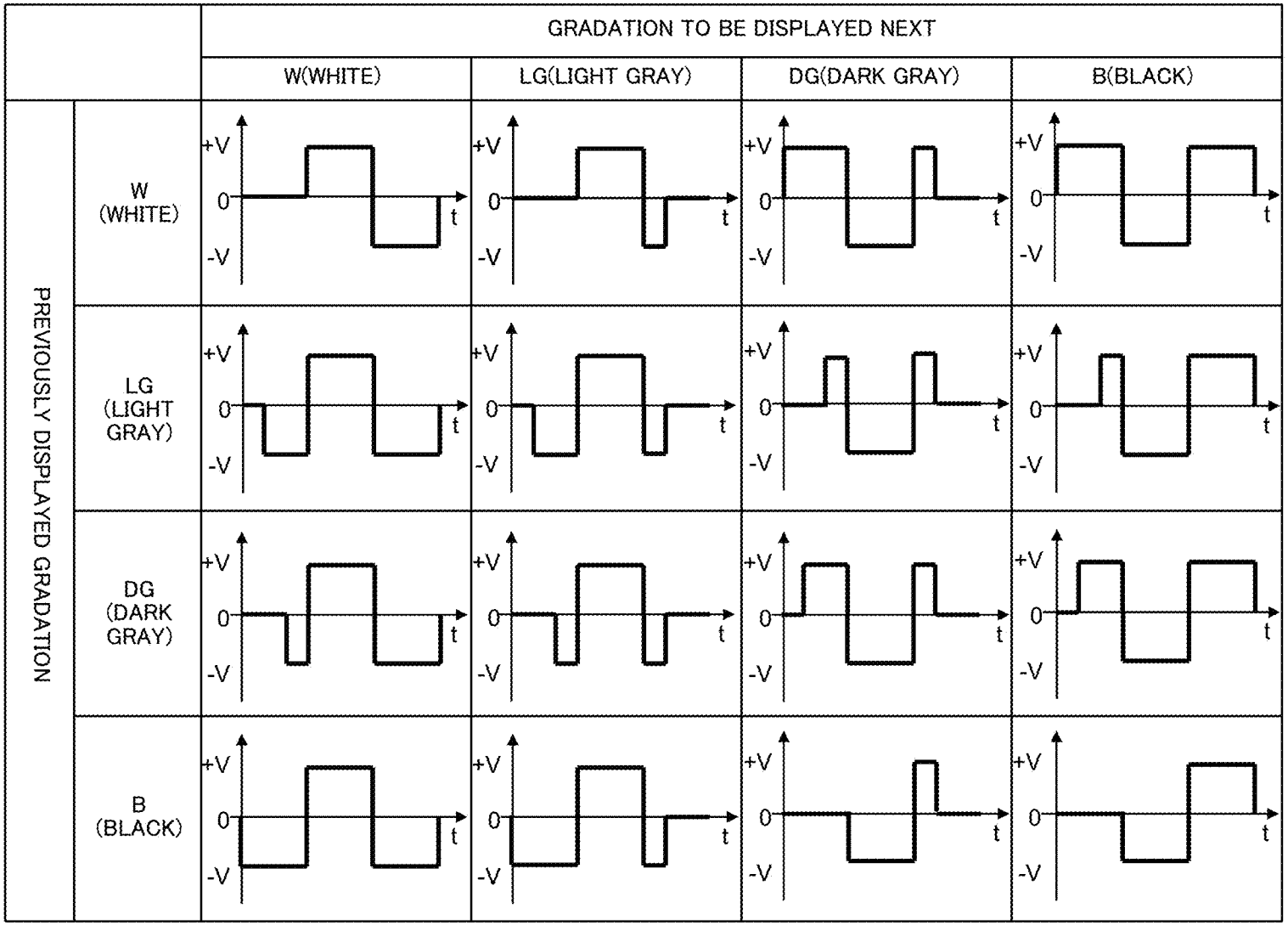
FIG. 25 illustrates an example of a driving waveform in which a voltage waveform of a gradation to be displayed at the time of next image update is decided according to a gradation displayed at the time of previous image update.

FIG. 25 illustrates a driving waveform in which a voltage waveform of a gradation to be displayed next is decided according to a previously displayed gradation. In FIG. 25, a vertical axis indicates a voltage, and a unit is V. In FIG. 25, a horizontal axis is a time in which a frame is a minimum unit. In the second embodiment, since the binary data is not generated, it is possible to support a complicated driving waveform, for example, a driving waveform in which a voltage waveform of a gradation to be displayed next is decided by a previously displayed gradation as illustrated in FIG. 25 through the following simple change. For the application of the driving waveform of FIG. 25, DpWF can be generated by setting an area for storing previous gradation data Dp in the data converting unit 13 and adding a function of deciding the voltage waveform based on a previously displayed gradation and a gradation to be displayed next. Thus, any other special work is unnecessary, and it is unnecessary to review even in the calculation of the image load value associated with the revision of the driving waveform.

Third Embodiment

Next, a display device with the memory function according to a third embodiment of the present invention will be described. The first and second embodiments have been described in connection with the example in which one source driver 150 is provided, but the present invention can be applied to a display panel equipped with a plurality of source drivers. A display panel including i source drivers according to the third embodiment will be described below.

[Description of Configuration]

Figure 26:
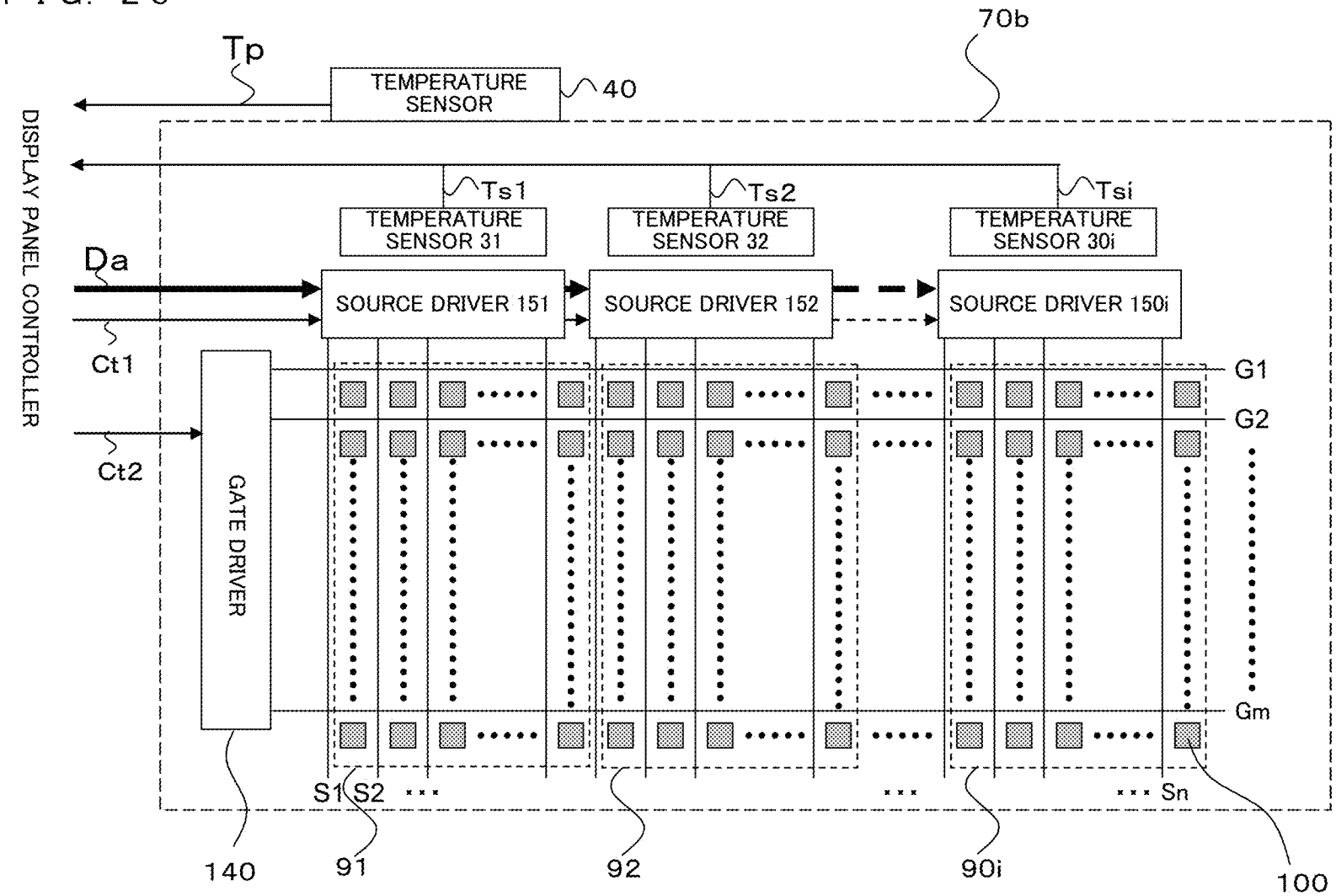
FIG. 26 is a block diagram illustrating a configuration of a display panel with a memory function according to a third embodiment.

FIG. 26 is a block diagram illustrating a configuration of a display panel **70*b* with a memory function according to the third embodiment. Similarly to the first embodiment, the display panel 70*b* with the memory function is configured with M×N pixels 100, and includes N source lines Sn serving as a wiring of a voltage to be applied to pixel electrodes (not illustrated) corresponding to the pixels 100, M gate lines Gm for turning on or off switching units (switching elements) corresponding to the pixels 100**, and common electrodes (not illustrated) to which a potential VCOM of an opposite electrodes is input.

The N source lines are connected to a source driver 151, a source driver 152, . . . , a source driver **150*i* in units of two or more lines that correspond in number to the number of source driver outputs, and each of a display unit 91, a display unit 92, . . . , a display unit 90*i*** is configured with a group of pixels driven by each source driver.

Each of the source drivers is equipped with a temperature sensor, and for example, a temperature Ts1 of the source driver 151 is measured by a temperature sensor 31, a temperature Ts2 of the source driver 152 is measured by a temperature sensor 32, and a temperature Tsi of the source driver 150*i* is measured by the temperature sensor 30*i*, and the measured temperatures are output to the display panel controller. The remaining components of the display panel 70*b* are the same as in the first embodiment, and thus a description thereof is omitted.

Figure 27:
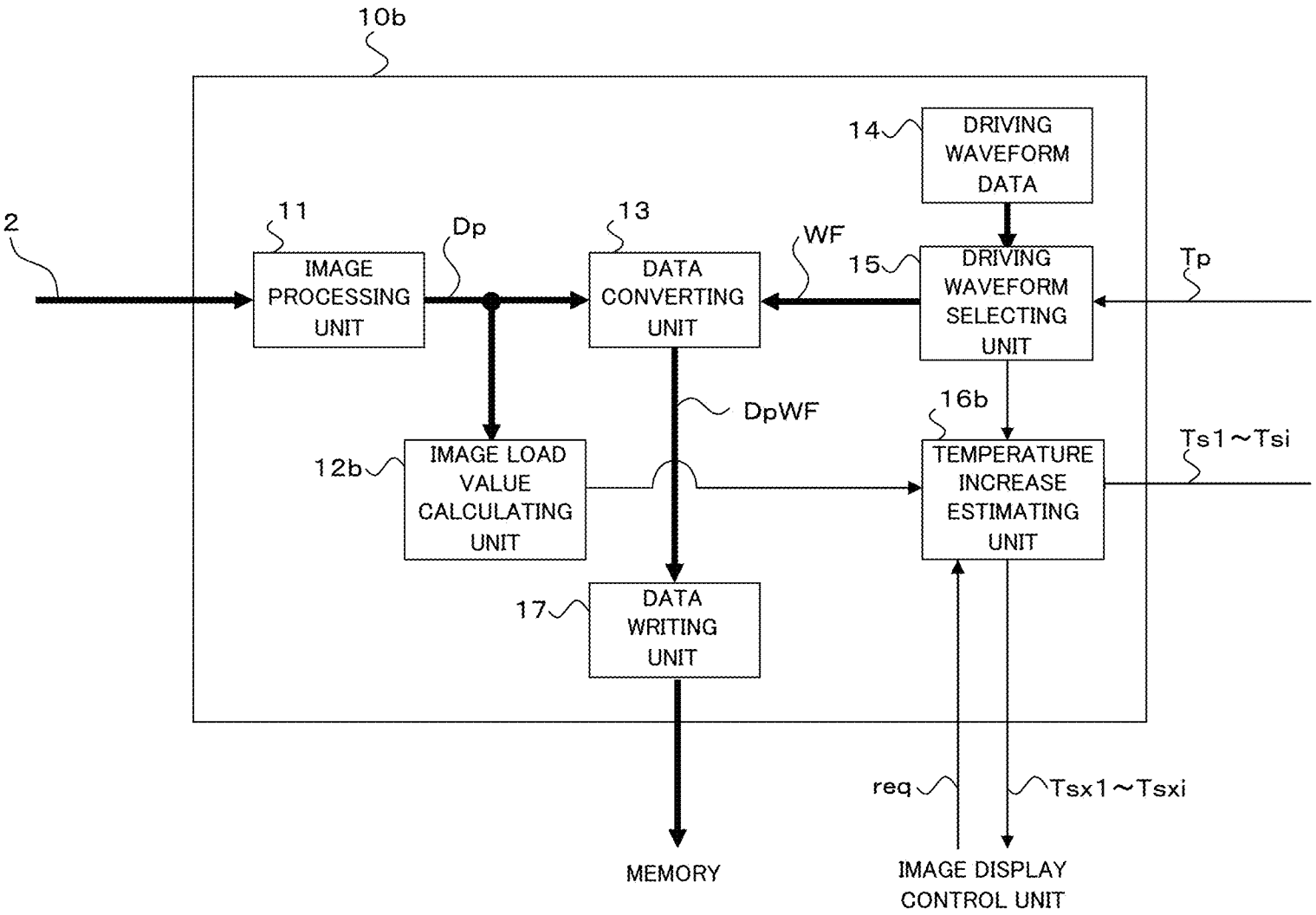
FIG. 27 is a block diagram of a temperature predicting unit according to the third embodiment.

FIG. 27 is a block diagram of a temperature predicting unit 10*b* according to the third embodiment. The temperature predicting unit 10*b* differs from that of the first embodiment in that an image load value calculating unit 12*b* and a temperature increase estimating unit 16*b* are equipped with a function of supporting the i source drivers of the display panel 70*b* (a description of the same components as in the first embodiment is omitted).

The image load value calculating unit 12*b* has a function of dividing the input gradation data Dp of the 4×6 matrix form into data corresponding to the display unit 91, the display unit 92, . . . , the display unit 90*i* and has a function of calculating the image load values from the divided gradation data Dp and i calculated image load values to the temperature increase estimating unit 16*b*.

The temperature increase estimating unit 16*b* has a function of estimating source driver temperatures Tsx1, Tsx2, . . . , Tsxi after the image update based on the i image load values, information of the driving waveform, and source driver temperatures Ts1, Ts2, . . . , Tsi and has a function of updating the temperatures Tsx1 to Tsxi according to the request signal req input from the image display control unit and outputting the updated temperatures Tsx1 to Tsxi to the image display control unit 20.

Figure 28:
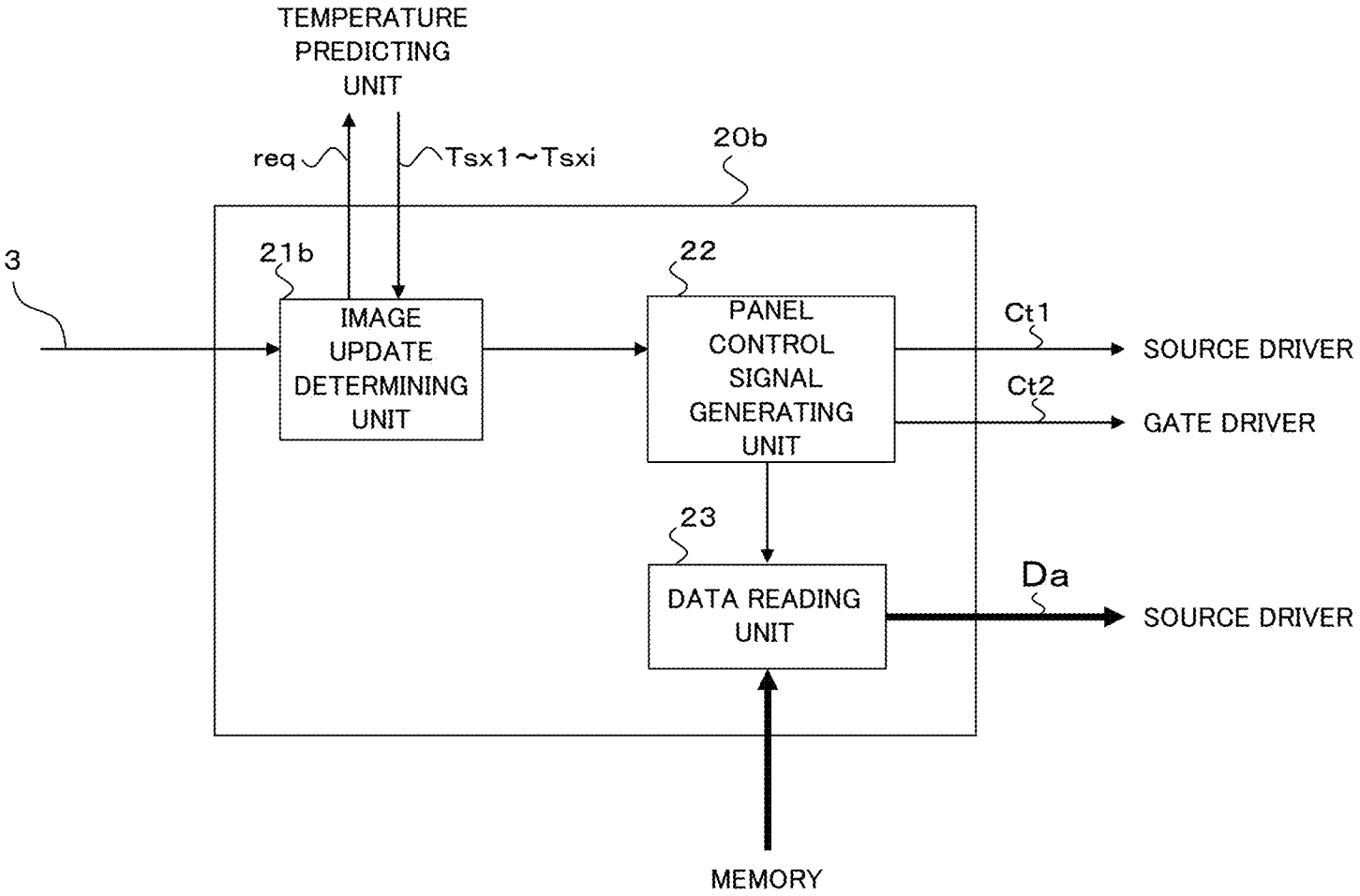
FIG. 28 is a block diagram of an image display control unit according to the third embodiment.

FIG. 28 is a block diagram of an image display control unit 20*b* according to the third embodiment. The image display control unit 20*b* differs from that of the first embodiment in that an image update determining unit 21*b* is provided (a description of the same components as in the first embodiment is omitted).

The image update determining unit 21*b* has a function of comparing the temperatures Tsx1 to Tsxi input from the temperature predicting unit 10*b* with a temperature that is set in advance when the image update signal 3 is input from the application processor 1, transferring a signal to start an operation to the panel control signal generating unit 22 when all the temperatures Tsx1 to Tsxi are lower than the set temperature, and transferring the request signal req to the temperature predicting unit 10*b* at predetermined time intervals when any of the temperatures Tsx1 to Tsxi is higher than the set temperature.

[Description of Operation]

In the operation of the temperature predicting unit 10*b* of the third embodiment, the image load values are calculated for the gradation data Dp divided to correspond to the display unit 91, the display unit 92, . . . , the display unit 90*i* as described above, and a range of a group of pixels serving as a target is different, but the calculation method is the same as in the first embodiment. Further, the temperatures Tsx1 to Tsxi after the image update for the source drivers are estimated based on the calculated image load values, but the estimation method of each temperature is the same as in the first embodiment.

Figure 29:
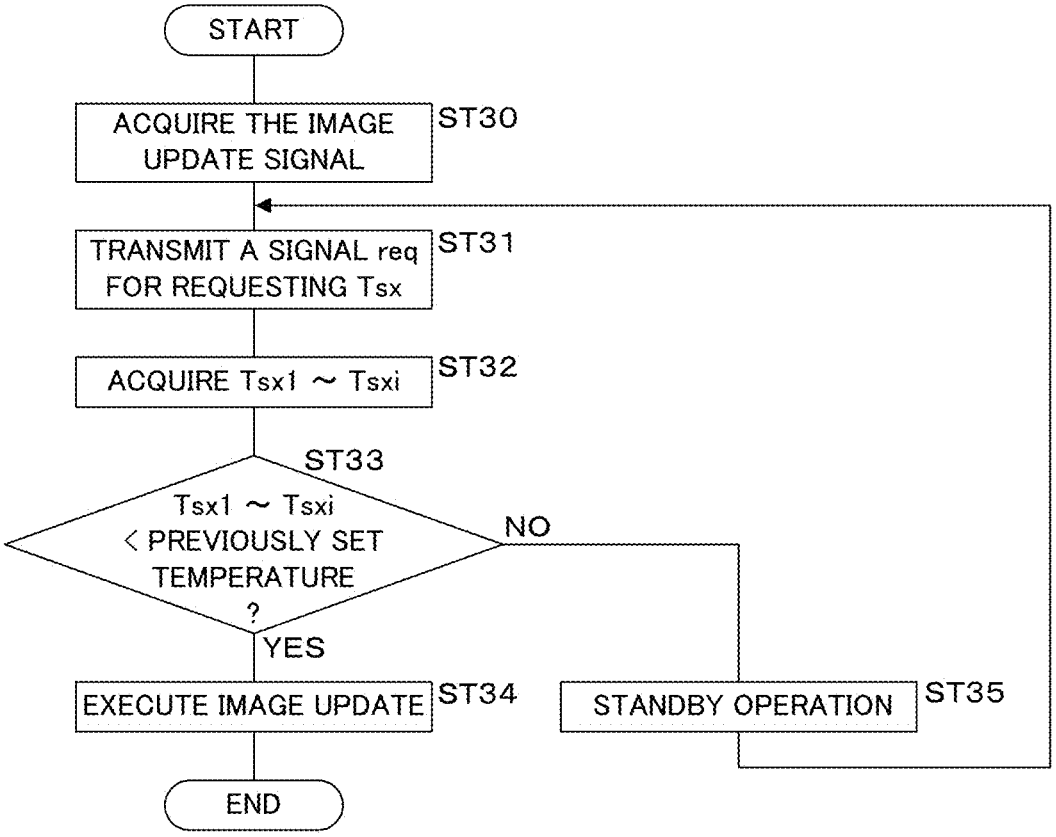
FIG. 29 is a flowchart for describing an operation of an image display control unit.

FIG. 29 is a flowchart for describing an operation of the image display control unit 20*b*. The image update determining unit 21*b* acquires the image update signal, similarly to step ST10 of the first embodiment (step ST30). The image update determining unit 21*b* transmits the request signal req (step ST31). Upon receiving the request signal req, the temperature predicting unit 10*b* (see FIG. 27) acquires the current source driver temperatures Ts1 to Tsi, calculates the source driver temperature Tsx1 to Tsxi after the image update, and transmits the calculated source driver temperature Tsx1 to Tsxi after the image update to the image display control unit 20*b* (see FIG. 28). The transmitted temperatures Tsx1 to Tsxi are acquired by the image update determining unit 21*b* (step ST32). Then, the image update determining unit 21*b* (see FIG. 28) determines whether or not all the acquired temperatures Tsx1 to Tsxi are lower than the previously set temperature (step ST33). When the determination result of step ST33 is NO, the image update is not performed, and an standby operation is performed until the determination result of step ST33 is YES (step ST35). When the determination result of step ST33 is YES, the image update is performed (step ST34).

As described above, the display device with the memory function according to the present invention can be applied to the display panel including a plurality of source drivers. By performing the operation as described above, it is possible to maintain all a plurality of source driver temperatures to be equal to or lower than the set temperature.

Figure 30:
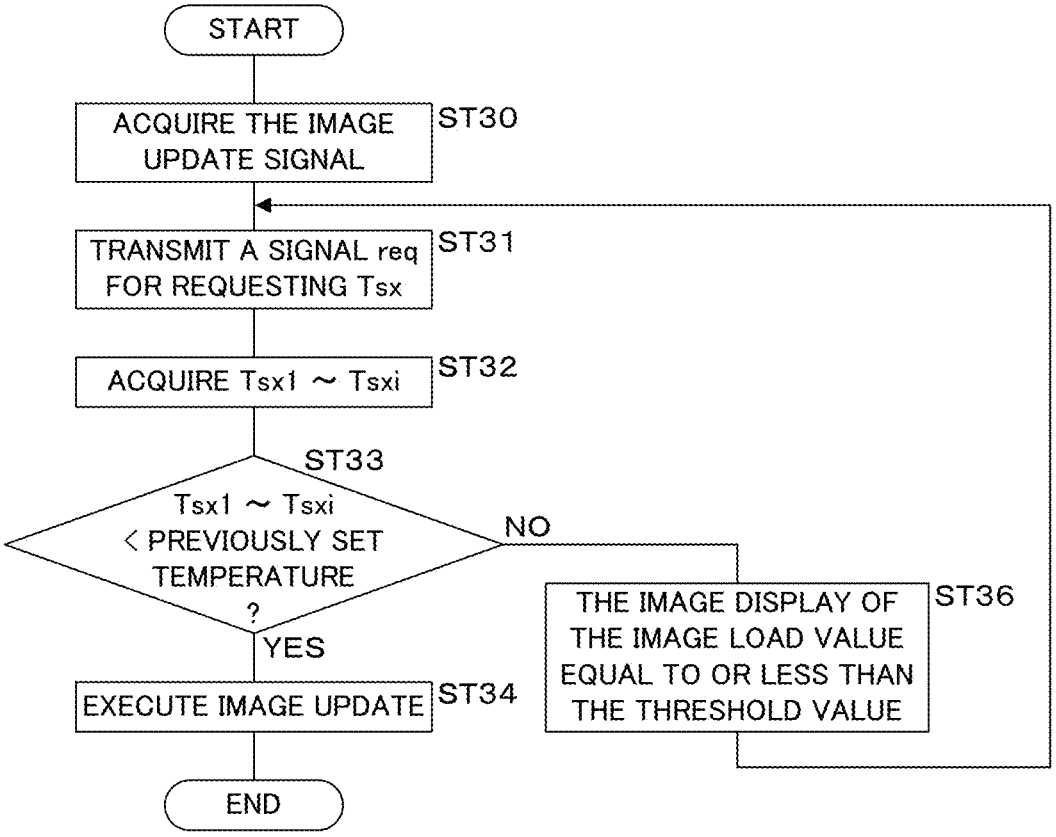
FIG. 30 is a flowchart illustrating a modified example of the third embodiment.
Figure 31:
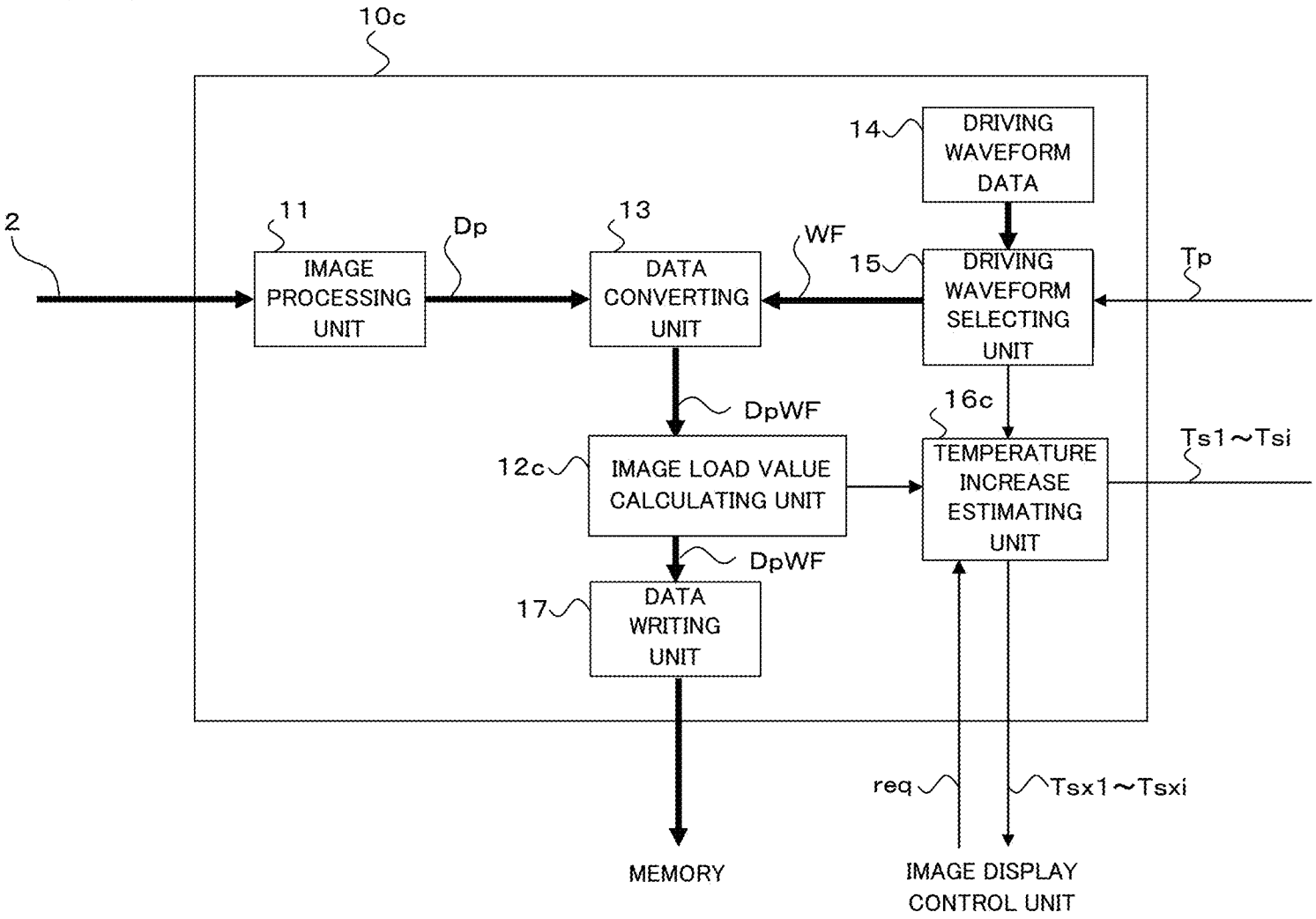
FIG. 31 is a block diagram illustrating a configuration of a temperature predicting unit according to the second embodiment when the display panel with the memory function (FIG. 26) described in the third embodiment is used.

The modified example of the first embodiment can be applied to the third embodiment. FIG. 30 is a flowchart illustrating a modified example of the third embodiment. The third embodiment has been described in connection with the example compared with the first embodiment but can be applied to the second embodiment. FIG. 31 is a block diagram illustrating a configuration of a temperature predicting unit 10*c* according to the third embodiment when the display panel 70*b* with the memory function (FIG. 26) described above in the third embodiment is used. In the configuration of the second embodiment, an image load value calculating unit 12*c* may be equipped with a function of copping the i source drivers of the display panel 70*b* with the memory function. In other words, the image load value calculating unit 12*c* has a function of dividing the input DpWF into data corresponding to the display unit 91, the display unit 92, . . . , the display unit 90*i* and has a function of calculating the image load values from the divided DpWF and outputting i calculated image load values to the temperature increase estimating unit 16*c*. As the temperature increase estimating unit, the temperature increase estimating unit 16*b* described above in the third embodiment may be used.

Fourth Embodiment

Next, a display device with a memory function according to a fourth embodiment of the present invention will be described. In the first embodiment, the source driver 150 is equipped with the temperature sensor 30 to acquire the temperature Ts of the source driver 150. However, the present invention can be implemented even by a configuration using temperature characteristics data of the source driver and a timer instead of the temperature sensor 30. The fourth embodiment in which the source driver is not equipped with the temperature sensor will be described.

[Description of Configuration]

Figure 32:
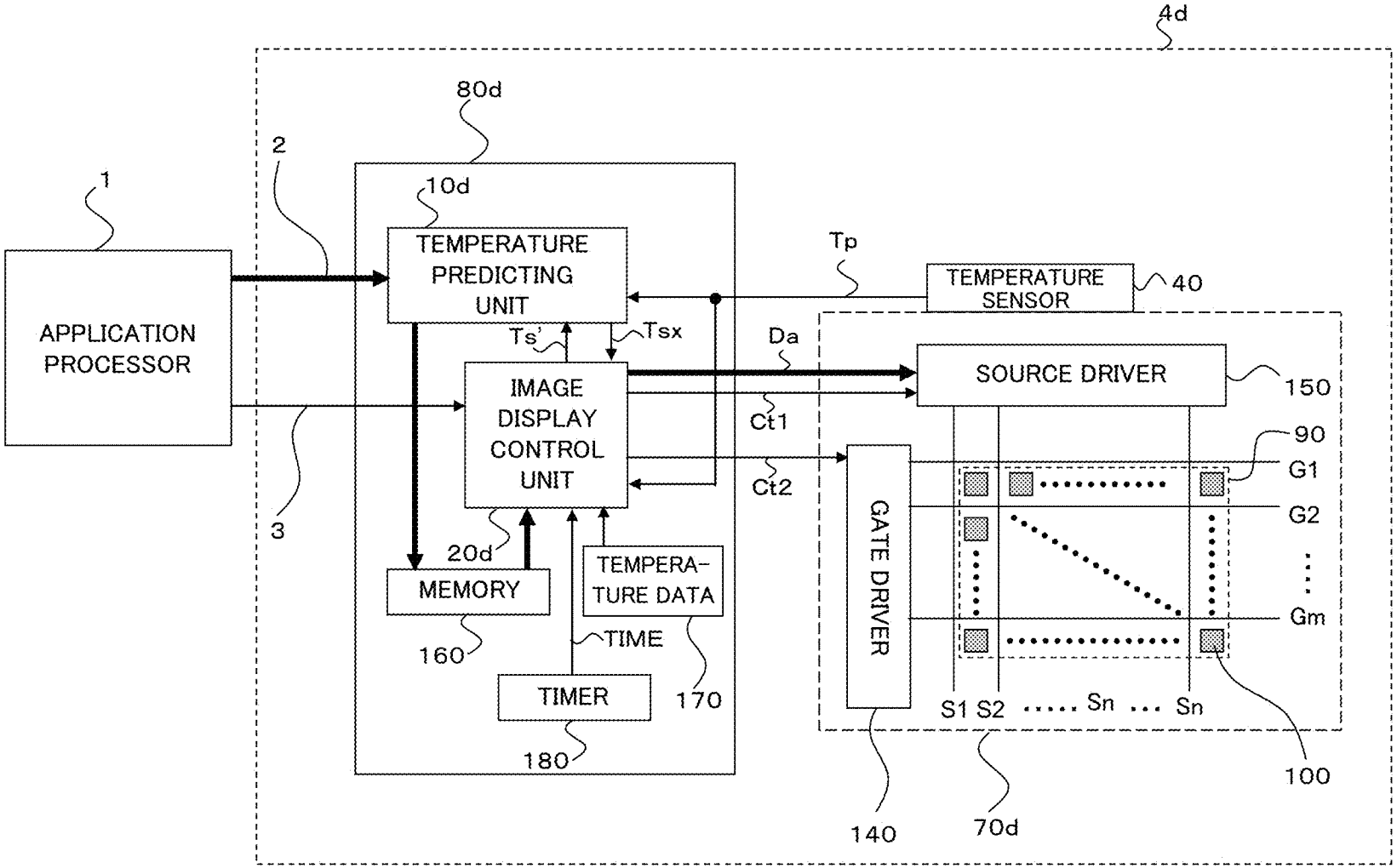
FIG. 32 is a block diagram for describing a configuration of a display device with a memory function according to a fourth embodiment.

FIG. 32 is a block diagram for describing a configuration of the display device with the memory function according to the fourth embodiment. As illustrated in FIG. 32, the display panel 70*d* with the memory function according to the fourth embodiment is not equipped with the temperature sensor that measures the temperature of the source driver 150. The remaining configuration is the same as in the first embodiment.

A display panel controller 80*d* includes temperature data 170 for providing information of temperature drop characteristics of the source driver 150 and a timer (a elapsed time measuring unit) 180 that provides time information in addition to that of the first embodiment, and provides respective information to an image display control unit 20*d*. The temperature Tp of the display panel 70*d* with the memory function is input both a temperature predicting unit 10*d* and the image display control unit 20*d*. The image display control unit 20*d* has a function of calculating a source driver temperature Ts' based on information input from the timer 180 and the temperature data 170 and the display panel temperature Tp and has a function of transmitting the source driver temperature Ts' to the temperature predicting unit 10*d*. The image display control unit 20 of the first embodiment has a function of transmitting the request signal req to the temperature predicting unit 10 (FIG. 3) but in the fourth embodiment, the image display control unit 20*d* performs both the transmission of the temperature Ts' and the transmission of the request signal req. The remaining components of the display panel controller 80*d* that have not been described above are the same as those of the first embodiment, and thus a description thereof is omitted.

Figure 33:
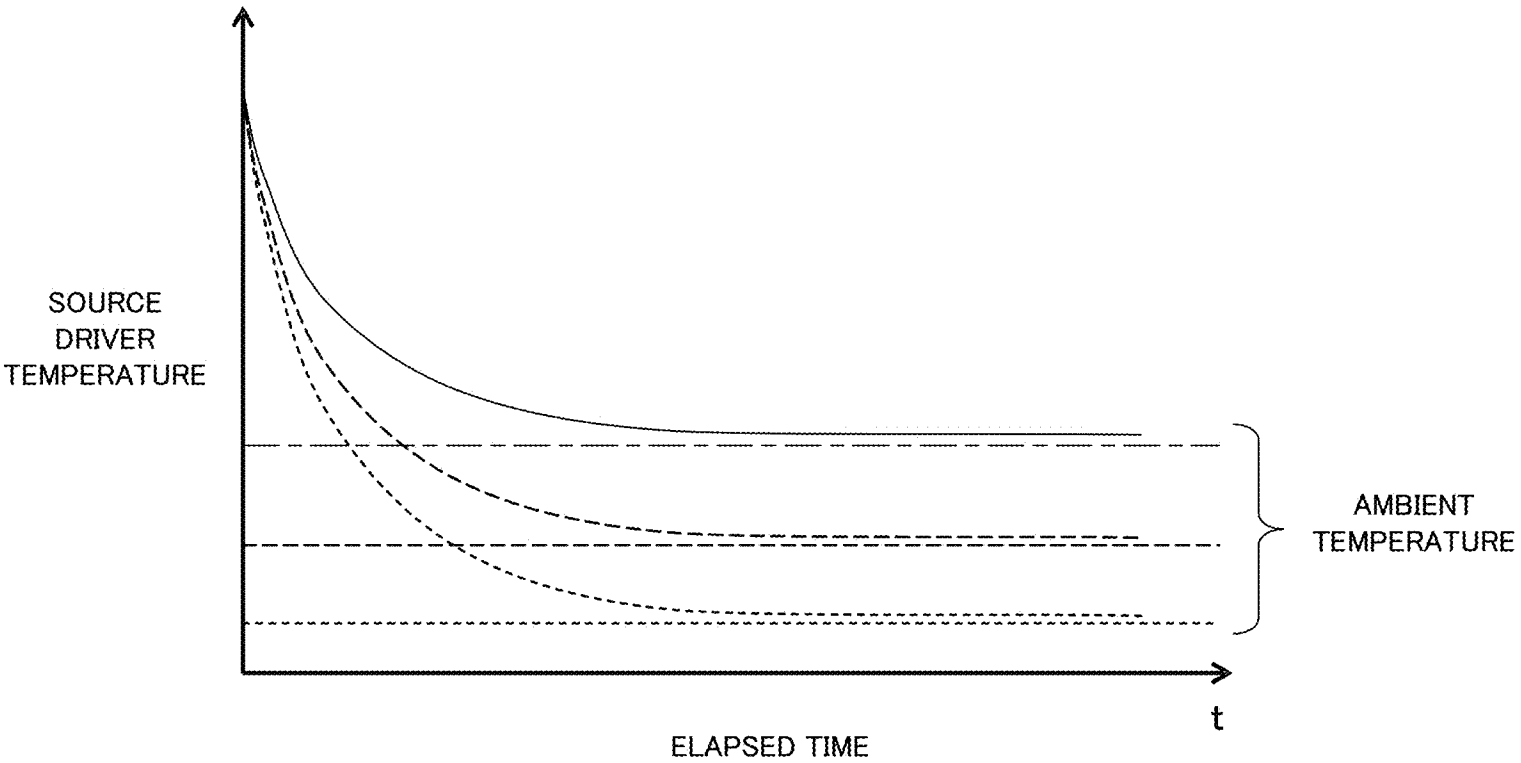
FIG. 33 is a graph illustrating a relation between a source driver temperature and an elapsed time.

Here, the temperature data 170 will be described. In the source driver employed in the display panel with the memory function according to the present invention, when the image update ends, the source driver need not be operated during a period of time until the next image update is performed, and the supply of the signal and the electric power is stopped during this period of time, and there is no heat generation in the source driver. FIG. 33 is a graph illustrating a relation between the source driver temperature and the elapsed time. In the graph illustrated in FIG. 33, a vertical axis indicates the source driver temperature, and a unit is ° C. A horizontal axis indicates the elapsed time, and a unit is a second. A solid line is a downward curve of the source driver temperature when the ambient temperature is high. A dotted line is a downward curve of the source driver temperature when the ambient temperature is the normal temperature (for example, 23° C.). An alternate long and short dash line is a downward curve of the source driver temperature when the ambient temperature is low. Thus, the temperature of the source driver increased according to the image update operation drops toward the ambient temperature according to the elapsed time when the image update ends as illustrated in FIG. 33. The temperature data 170 is data obtained by measuring the drop characteristics of the source driver temperature according to the passage of time for each ambient temperature, deciding table data or a coefficient, and converting it into a function. In other words, the elapsed time is an elapsed time after the image update operation. Specifically, the elapsed time is a time elapsed until the temperature is calculated after the image is updated. The temperature data 170 is temperature drop characteristics data indicating the relation between the elapsed time and the source driver temperature. In other words, when the source driver temperature after the image update and the ambient temperature are decided, the source driver temperature after the image update according to the elapsed time can be calculated with reference to the temperature data 170. Here, the ambient temperature can be measured by the temperature sensor 40.

Figure 34:
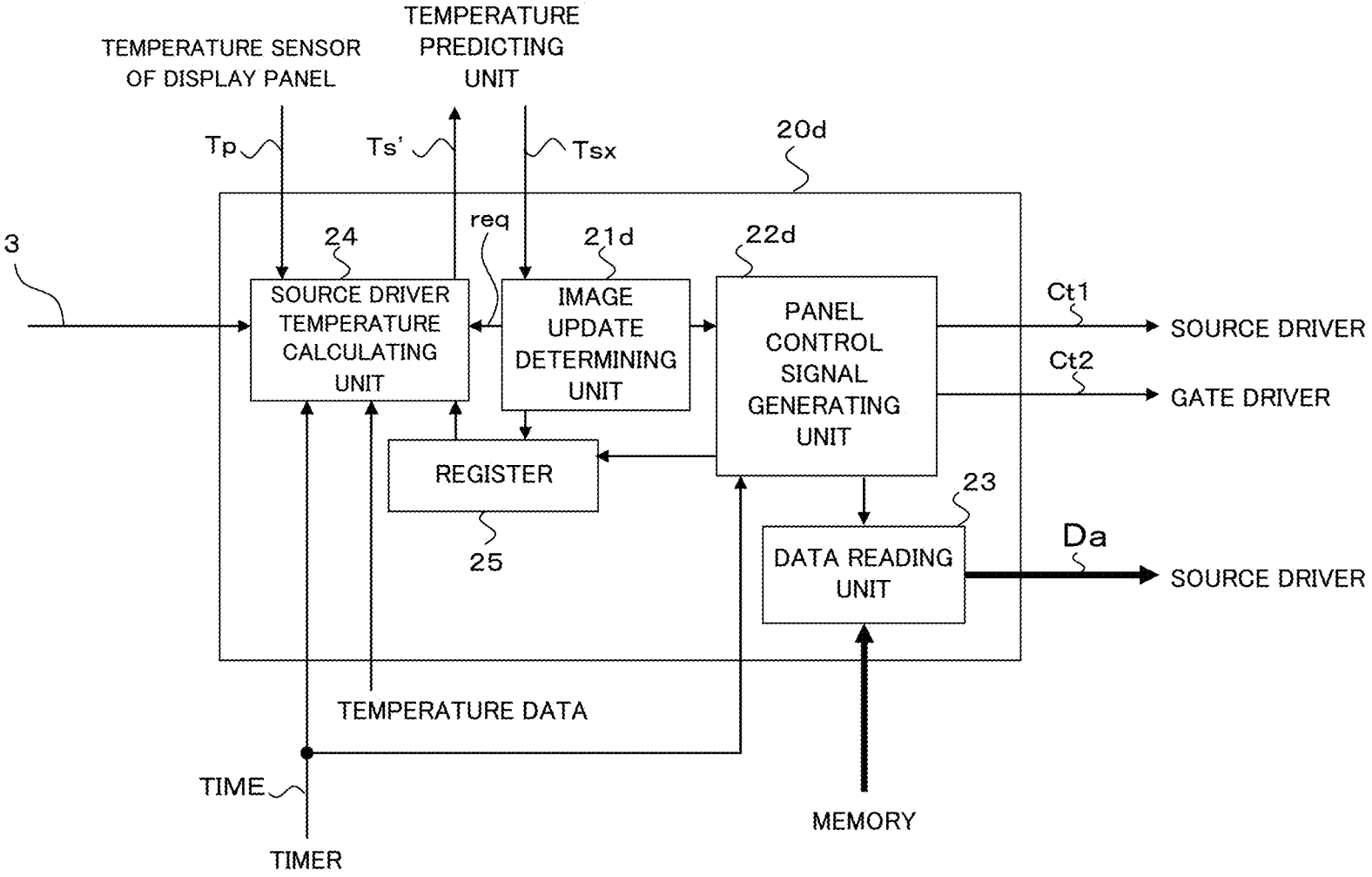
FIG. 34 is a block diagram illustrating an image display control unit according to the fourth embodiment.

FIG. 34 is a block diagram illustrating the image display control unit 20*d* according to the fourth embodiment. Compared with the image display control unit 20 (FIG. 7) of the first embodiment, a source driver temperature calculating unit 24 and a register 25 are added, and the image update signal 3 is input to the source driver temperature calculating unit 24. The source driver temperature calculating unit 24 has a function of calculating the source driver temperature Ts' based on the information input from the temperature data 170, the temperature Tp of the display panel, a source driver temperature PreTsx that is not stored in the register 25 and estimated at the time of image update, and time information TIME input from the timer and a function of transmitting the source driver temperature Ts' to the temperature predicting unit 10*d*. The image update determining unit 21*d* has a function of storing the estimated the temperature Tsx at the time of image update in the register 25 as the source driver temperature PreTsx in addition to a function of comparing the temperature Tsx input from the temperature predicting unit 10*d* with a previously set temperature and instructing the panel control signal generating unit to perform the image update according to the comparison result. A transmission destination of the request signal req from the image update determining unit 21*d* is the source driver temperature calculating unit 24. The panel control signal generating unit 22*d* has a function of storing a time at which the image update ends in the register 25 as an additional function. The remaining components of the image display control unit 20*d* that have not described above are the same as those of the first embodiment, and thus a description thereof is omitted.

The temperature predicting unit 10*d* of the fourth embodiment has substantially the same configuration as the temperature predicting unit 10 (FIG. 6) according to the first embodiment, and thus a description thereof is omitted. In the temperature predicting unit 10*d* of the fourth embodiment, instead of the temperature Ts, the temperature Ts' transmitted from the image display control unit 20*d* is input to the temperature increase estimating unit 16. Further, the temperature predicting unit 10*d* has a function of updating the temperature Tsx according to the input of the temperature Ts' instead of the signal req and outputting the updated temperature Tsx to the image display control unit 20*d*.

[Description of Operation]

In an operation of the temperature predicting unit 10*d* of the fourth embodiment, compared with the first embodiment, the temperature Ts' calculated by the image display control unit 20*d* instead of the temperature Ts acquired from the temperature sensor is used as the current source driver temperature necessary for estimating the temperature Tsx of the source driver after the image update as described above, and the temperature Tsx is updated according to the input of the temperature Ts' instead of the signal req. The remaining operations such as the calculation of the image load value are the same as those of the first embodiment, and thus a description thereof is omitted.

Figure 35:
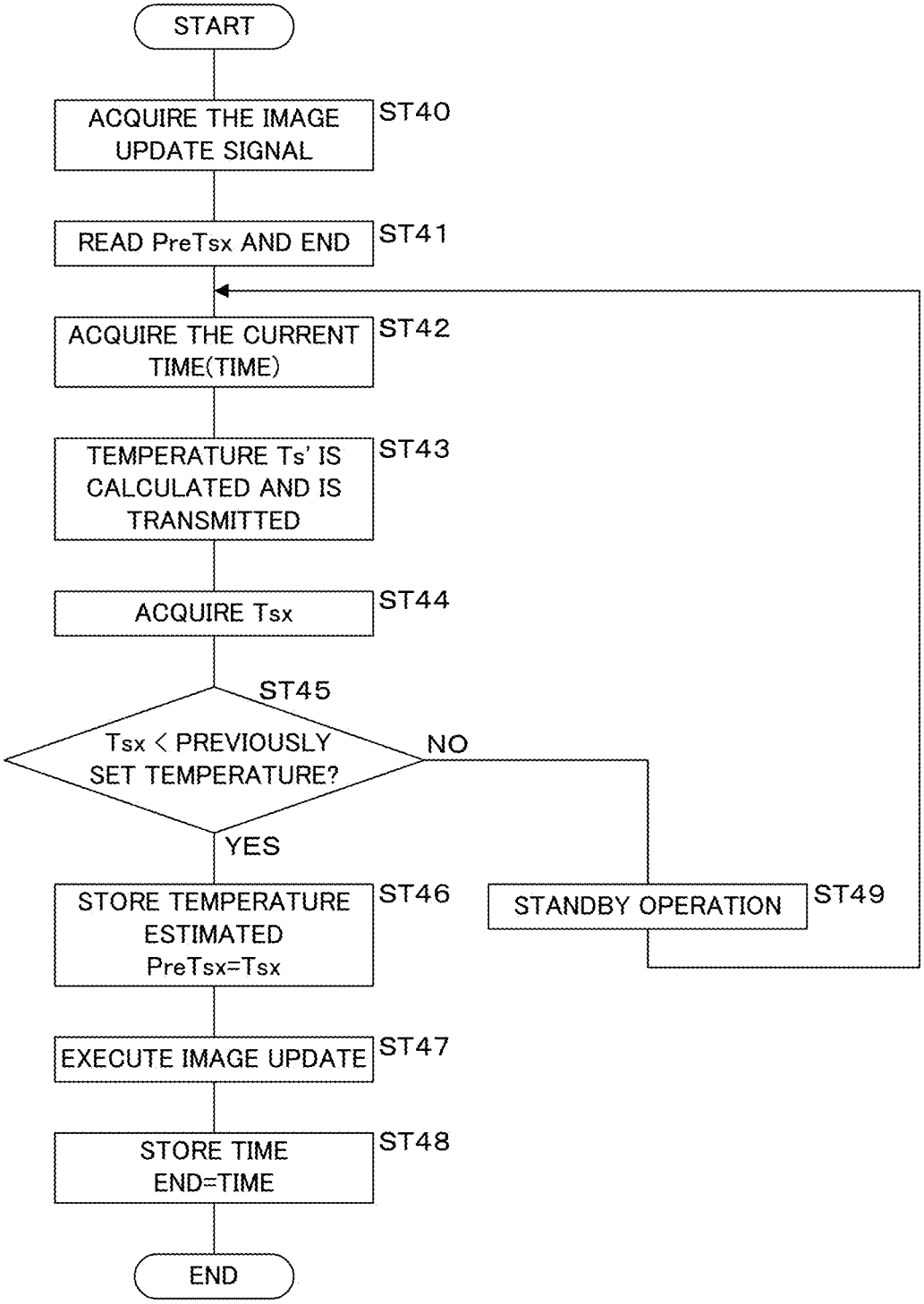
FIG. 35 is a flowchart for describing an operation of an image display control unit.

Next, an operation of the image display control unit 20*d* according to the fourth embodiment will be described with reference to FIG. 35. FIG. 35 is a flowchart for describing an operation of the image display control unit 20*d*.

The source driver temperature calculating unit 24 acquires the image update signal 3 from the application processor 1 (step ST40). The temperature PreTsx (the source driver temperature after the previous image update) and a time END (an end time of the previous image update) are read from the register 25 (step ST41).

Subsequently to step ST41 (or upon receiving the signal req), the source driver temperature calculating unit 24 acquires the current time TIME from the timer 180 (step ST42).

Then, the display panel temperature Tp input to the source driver temperature calculating unit 24 is used as the ambient temperature, and the current source driver temperature Ts' is calculated based on the temperature PreTsx and the elapsed time acquired by the time END and the time TIME using the temperature data 170. The calculated temperature Ts' is transmitted to the temperature predicting unit 10*d* (step ST43). At the time of an initial operation (there is no previous image update), the temperature Tp is included as the temperature Ts' and transmitted.

Upon the temperature Ts', the temperature predicting unit 10*d* calculates the source driver temperature Tsx after the image update, and transmits the source driver temperature Tsx after the image update to the image display control unit 20*d*. The transmitted temperature Tsx is acquired by the image update determining unit 21*d* (step ST44).

The image update determining unit 21*d* determines whether or not the acquired temperature Tsx is lower than a previously set temperature (step ST45).

When the determination result of step ST45 is NO, the image update determining unit 21*d* is on standby during a certain period of time without transmitting the signal to instruct the image update to the panel control signal generating unit 22*d* (step ST49). Then, the process returns to step ST42. The image update determining unit 21*d* repeats the process of ST42 to 45 until the determination result of step ST45 is YES.

When the determination result of step ST45 is YES, the image update determining unit 21*d* stores the temperature Tsx used in the determination in the register 25 as the temperature PreTsx (step ST46).

Subsequently to step ST46, the signal to instruct the image update is output from the image update determining unit 21*d* to the panel control signal generating unit 22*d*, and the image update is performed according to this signal (step ST47).

When the image update ends, the panel control signal generating unit 22*d* acquires the current time TIME from the timer 180, and stores the acquired time TIME in the register 25 as the image update end time END (step ST48).

As described above, by configuring and operating the display device with the memory function, even in the fourth embodiment in which the source driver is not equipped with the temperature sensor, the temperature of the source driver 150 can be maintained to be equal to or lower than the set temperature. Since the temperature sensor need not be installed in the source driver 150, in the fourth embodiment, in addition to the effects of the first embodiment, the cost reduction effect coming from a reduction in the number of parts and the effect that the degree of freedom of housing design (for example, a compact housing) are obtained.

The modified example of the first embodiment can be applied to the fourth embodiment, and the same effects as the effects described in the modified example of the first embodiment are obtained. The fourth embodiment has been described focusing on the different points from the first embodiment, but the same modification as the above-described modification of the first embodiment can be applied to the second embodiment and the third embodiment, and the effects of the fourth embodiment described above can be added. Particularly, when the fourth embodiment is applied to the third embodiment in which a plurality of source drivers are arranged, the effect is increased since a plurality of temperature sensors can be reduced.

Fifth Embodiment

Next, a display device with a memory function according to a fifth embodiment of the present invention will be described. As described above in the first embodiment, the driving waveform has been described as being selected according to the display panel temperature Tp and used. This driving waveform is referred to as a "first driving waveform." In the fifth embodiment, in addition to the configurations of the above embodiments, a second driving waveform capable of suppressing an increase in the temperature of the source driver after the image update when compared with the first driving waveform is further provided, and a function of estimating the source driver temperature based on image data to be displayed next and the second driving waveform is provided. Further, a function of comparing the source driver temperature Tsx estimated based on the second driving waveform with a previously set temperature and determining whether or not the image update can be performed when the source driver temperature Tsx estimated based on the image data and the first driving waveform is higher than a previously set temperature, and it is determined that the image update is non-executable, and performing the image update based on the second driving waveform when the image update can be performed is provided.

A specific example of the second driving waveform capable of suppressing an increase in the temperature of the source driver after the image update when compared with the first driving waveform will be described below with reference to the drawings. As described above in the first embodiment, in the source driver, compared to when the same voltage is applied to the neighboring pixel electrode, when different voltages are applied to the neighboring pixel electrode, a large current is necessary, an amount of generated heat is also large, and the temperature increase ΔT is also high. Thus, for example, the driving waveform that is small in the change in the voltage of the source line within the same frame can be used as the second driving waveform.

Figure 36:
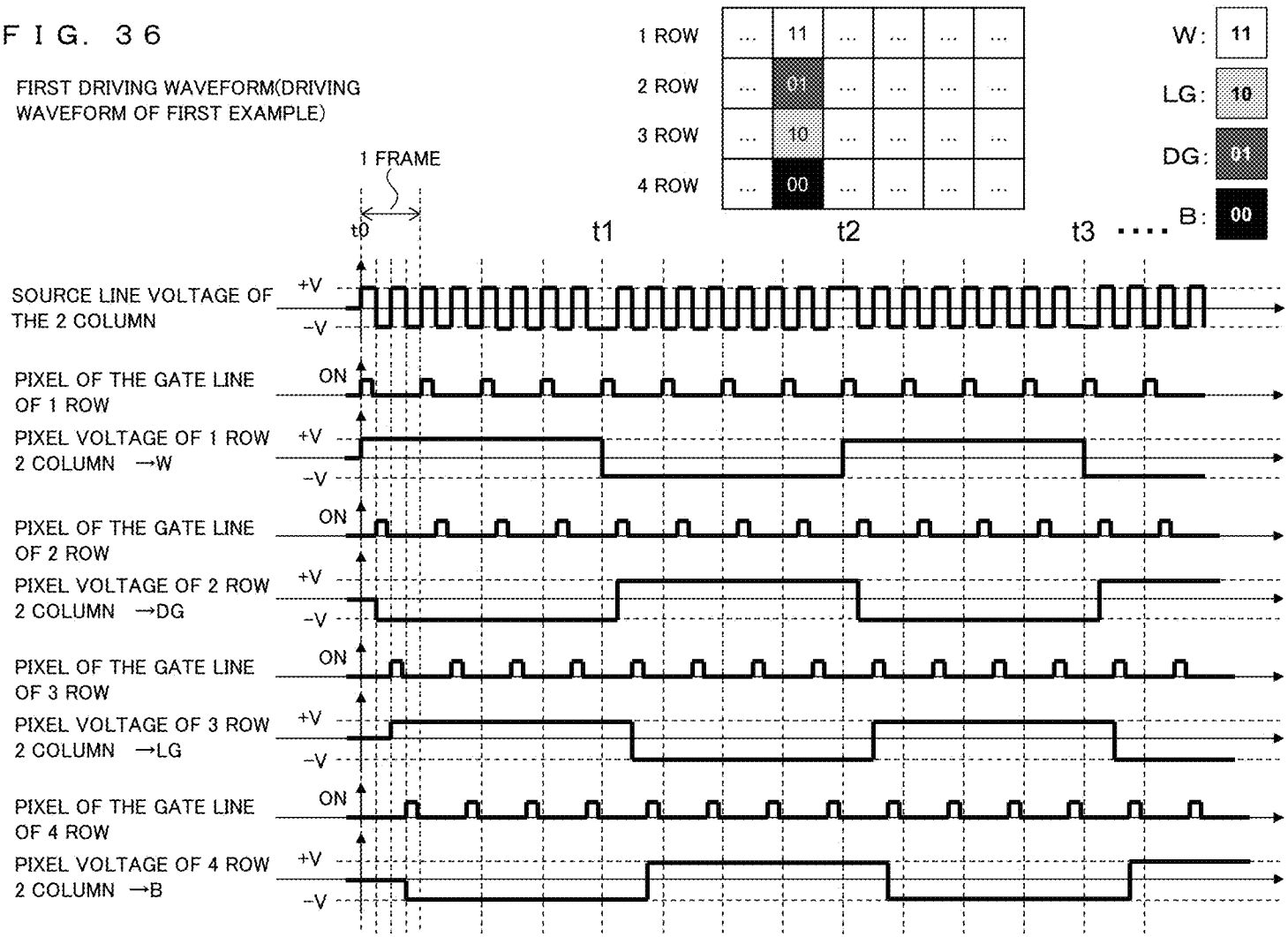
FIG. 36 is a timing chart illustrating a change in a source line voltage of a first driving waveform and a change in a pixel voltage in a fifth embodiment.

The second driving waveform and the change in the voltage of the source line will be described with reference to FIGS. 36 to 39. FIG. 36 is a diagram for describing the change in the voltage of the source in the image update using the first example of the driving waveform illustrated in FIG. 9 as the first driving waveform. A display panel example in which the image update is performed and a timing chart of a voltage of a corresponding source line, an ON timing of the gate line, and a pixel voltage are illustrated. The description will proceed with an example in which the display panel is configured with 4×6 pixels, and pixels in a second column are updated to display W (white), DG (dark gray), LG (light gray), and B (black) in order from a pixel in a first row. In the timing chart illustrated in FIG. 36, a horizontal axis indicates a time, similarly to FIG. 9, and t0, t1, t2, and t3 are identical to those in FIG. 9. In FIG. 36, for the sake of convenience of description, each of periods of time of t0 to t1, t1 to t2, and t2 to t3 is configured with 4 frames. As illustrated in FIG. 36, a source line voltage of the second column changes from +V to −V or from −V to +V several times within the same frame.

Next, FIGS. 37A to 37D illustrate the first example of the second driving waveform. Similarly to FIG. 9, it is an example of the monochrome 4-gradation display, FIGS. 37A to 37D illustrate the voltage waveforms applied to the pixels that display W (white), LG (light gray), DG (dark gray), and B (black) next at the time of image update. A vertical axis indicates a voltage, a unit is V, a horizontal axis indicates a time in which a frame is a minimum unit, and an image update period of time is configured with L frames ranging from a frame 1 starting from t0 to the frame L. The concept of the reset period of time and the set period of time is the same as in [Description of operation] of the first embodiment, and a description thereof is omitted. The driving waveform illustrated in FIG. 37 is designed so that +V and −V do not overlap within the same frame period in all gradations. For example, in FIG. 9, during the period of time of t0 to t1, W and LG have +V, DG and B have −V, and during the period of time of t1 to t2, W and LG have −V, DG and B have +V, whereas in FIG. 37, during the period of time of t0 to t1, W and LG have +V, DG and B have 0 V, and during the period of time of t1 to t2, W and LG have 0 V, and DG and B have −V. In other words, in FIG. 37, in the period of time in which +V and −V overlap in FIG. 9, either of +V and −V is to 0 V, and a period of time in which a voltage set to 0 V is applied is shifted. As described above with reference to FIG. 8, when 0 V is applied to the pixel, the movement of the particles is stopped, and the reflection rate is maintained due to the memory function. In other words, applying of 0 V to the pixel functions holding of the display state. Since the driving waveform of FIG. 37 is designed to be identical to that of FIG. 9 when the period of time in which 0 V is applied is omitted from each voltage waveform, the display state of each pixel when the image update period of time ends ideally becomes the same display state when the driving waveform of FIG. 9 is used. In the second driving waveform illustrated in FIG. 37, the period of time in which 0 V is applied is added so that +V and −V do not overlap, and thus the image update period of time is larger than that of the driving waveform illustrated in FIG. 9.

Figures 37A, 37B, 37C, 37D:
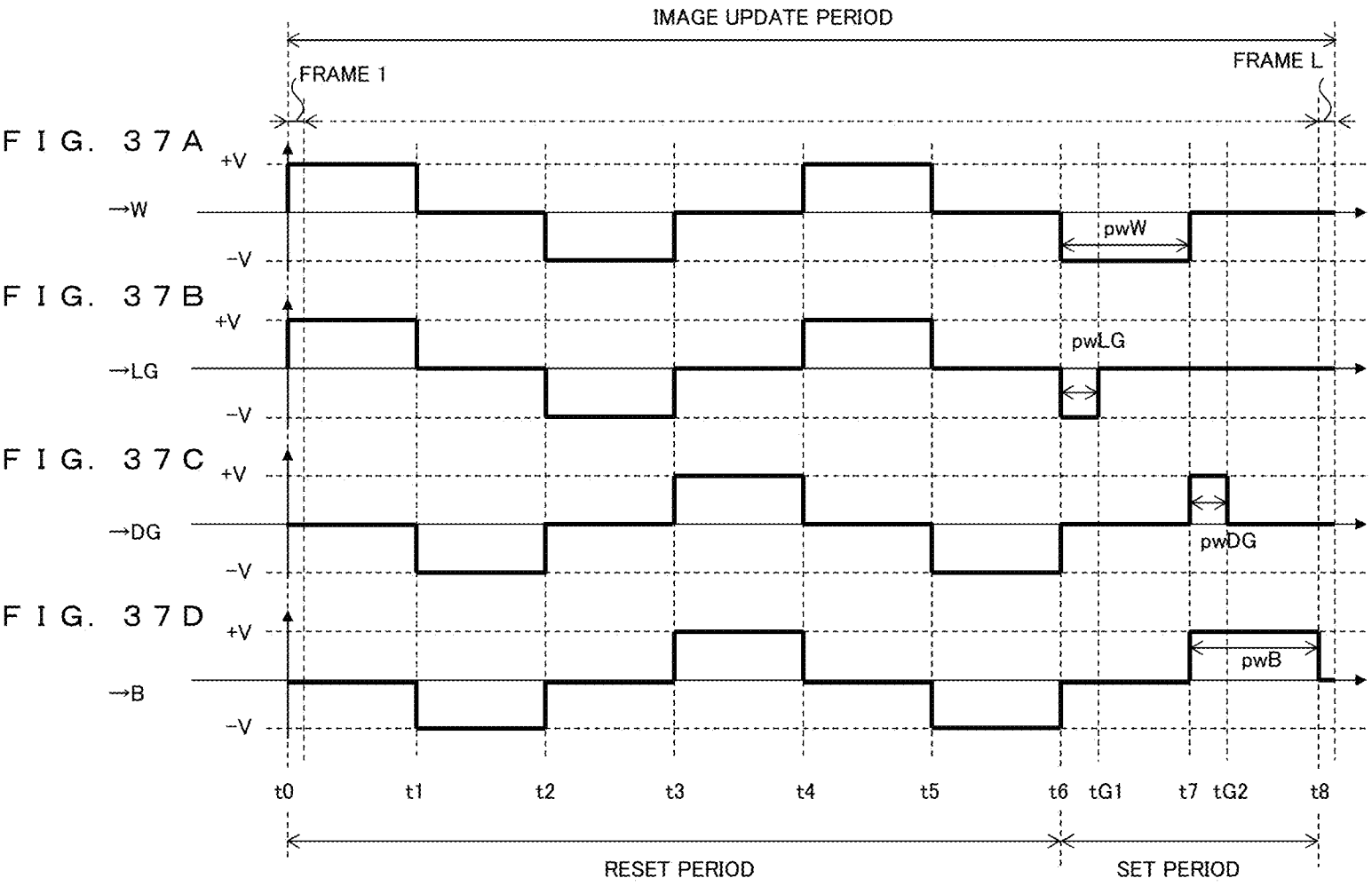
FIGS. 37A to 37D are diagrams illustrating an example of a second driving waveform.
Figure 38:
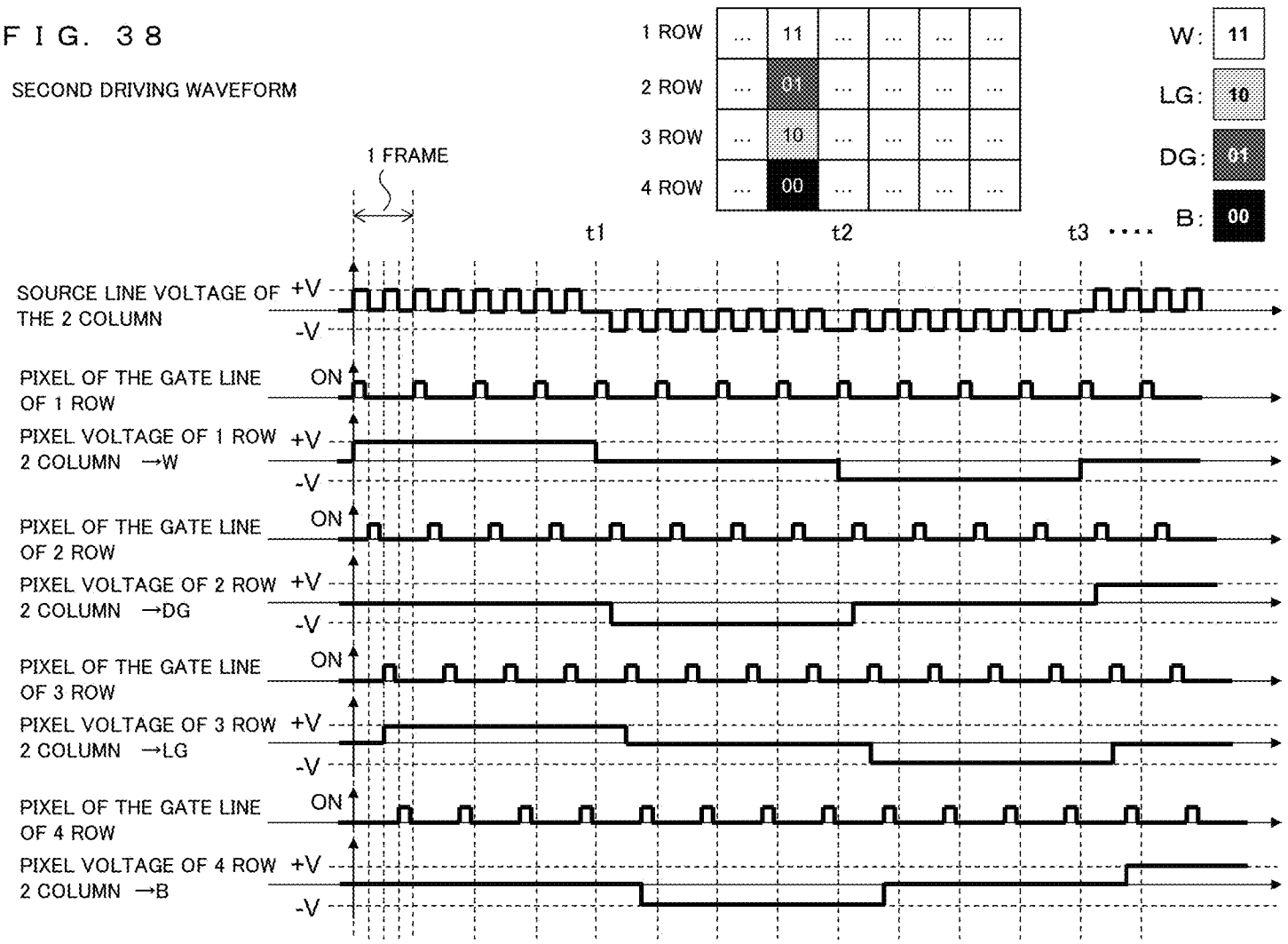
FIG. 38 is a timing chart illustrating a change in a source line voltage of a second driving waveform and a change in a pixel voltage in the fifth embodiment.
Figures 39A, 39B, 39C, 39D:
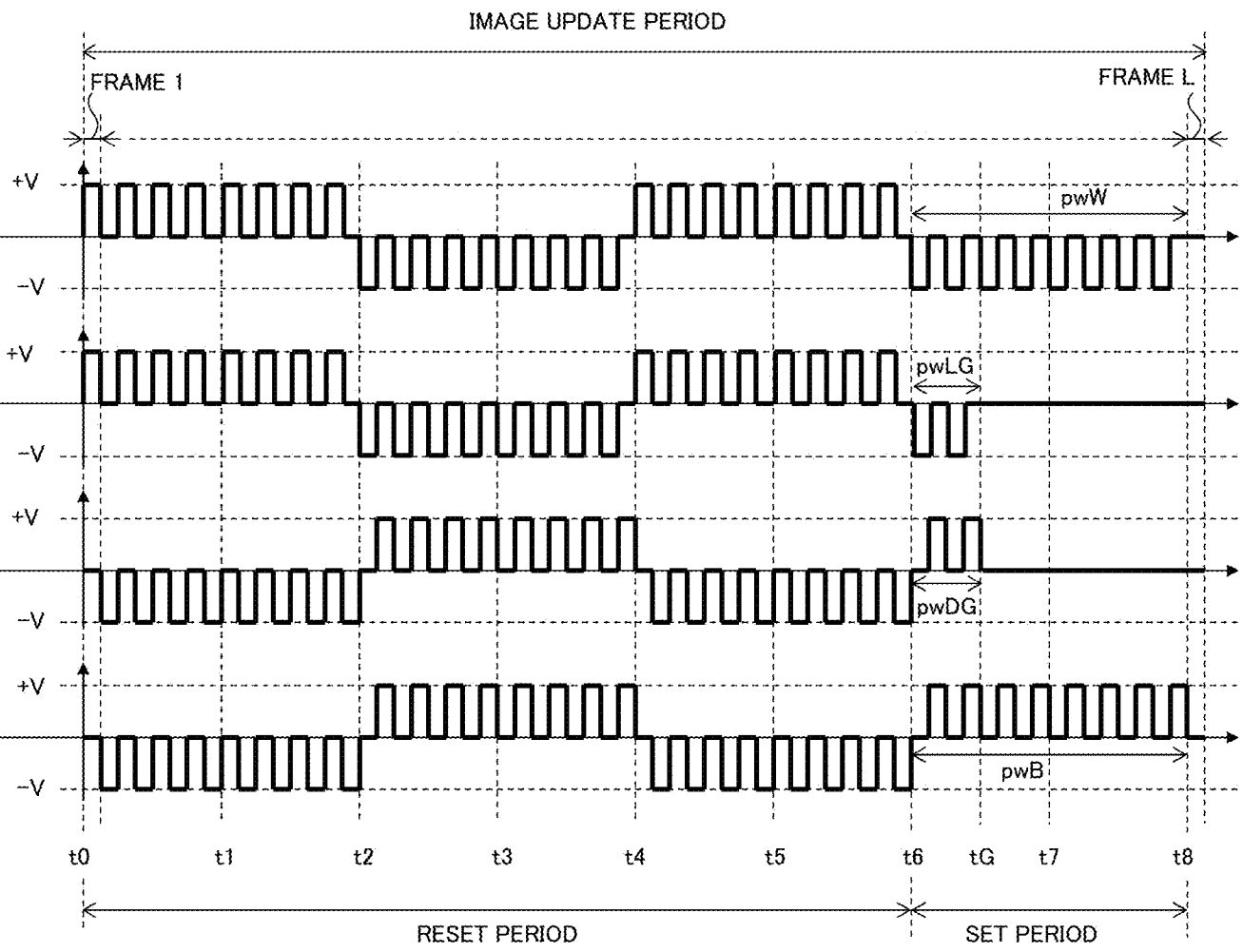
FIGS. 39A to 39D are diagrams illustrating an example of the second driving waveform.

FIG. 38 is a diagram for describing the change in the voltage of the source line in the image update using the first example of the second driving waveform illustrated in FIG. 37. The same display panel example as that of FIG. 36 and a timing chart of a voltage of a corresponding source line, an ON timing of the gate line, and a pixel voltage are illustrated. In the timing chart illustrated in FIG. 38, a horizontal axis indicates a time, similarly to FIG. 37, and t0, t1, t2, and t3 are identical to those in FIG. 37. As illustrated in FIG. 38, a source line voltage of a second column changes from 0 to +V, from +V to 0, from 0 to −V, or from −V to 0 within the same frame. In other words, unlike FIG. 36, there is no change from +V to −V or from −V to +V, and in other words, the change in the voltage of the source line is small within the same frame. Thus, the driving waveform of FIGS. 37A to 37D can suppress the source driver output current within the unit time, an amount of generated heat, and the temperature increase ΔT of the source driver to be smaller than the driving waveform of FIG. 9. In other words, the driver changes the voltage of the source line between a voltage having the same polarity and a reference voltage within the same frame. The reference voltage is, for example, 0 V, and used as a reference in the driving waveform.

FIGS. 39A to 39D illustrate a second example of the second driving waveform. The driving waveform illustrated in FIGS. 39A to 39D is designed so that +V and −V do not overlap within the same frame period in all gradations, similarly to FIG. 37, but a method of shifting the period of time in which +V and −V overlap in FIG. 9 is different from that of FIG. 37. In FIGS. 39A to 39D, for the driving waveform of FIG. 9, a period of time in which 0 V is applied is added while shifting +V and −V in units of frames. Even in the driving waveform of FIGS. 39A to 39D, similarly to the driving waveform of FIG. 37, the driver changes the voltage of the source line between the voltage having the same polarity and the reference voltage within the same frame. Thus, the driving waveform of FIGS. 39A to 39D can suppress the source driver output current within the unit time and the temperature increase ΔT of the source driver to be smaller than the driving waveform of FIG. 9.

A configuration and operation of the display device with the memory function according to the fifth embodiment of the present invention will be described below.

Figure 40:
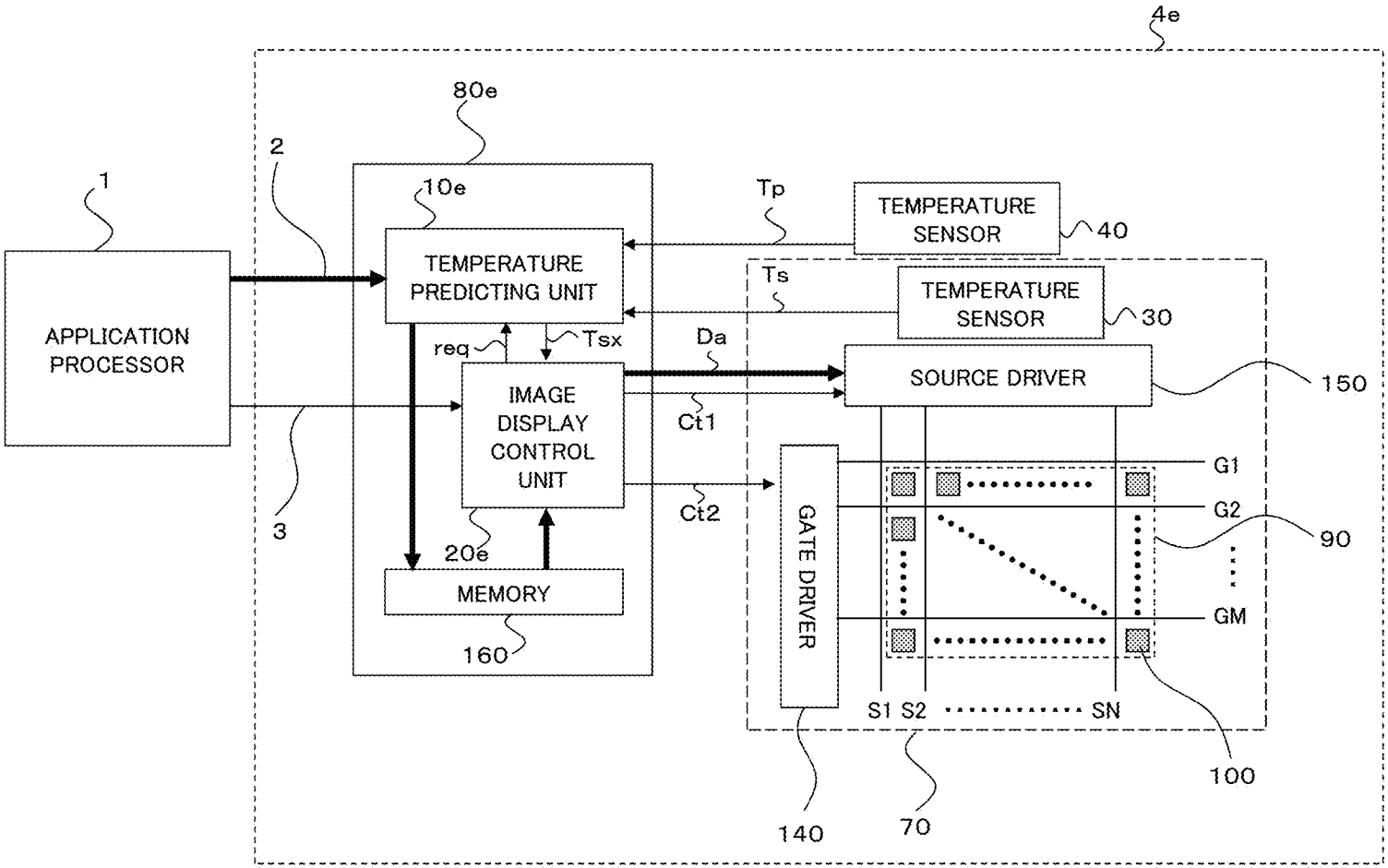
FIG. 40 is a block diagram for describing a configuration of a display device with a memory function according to the fifth embodiment.
Figure 41:
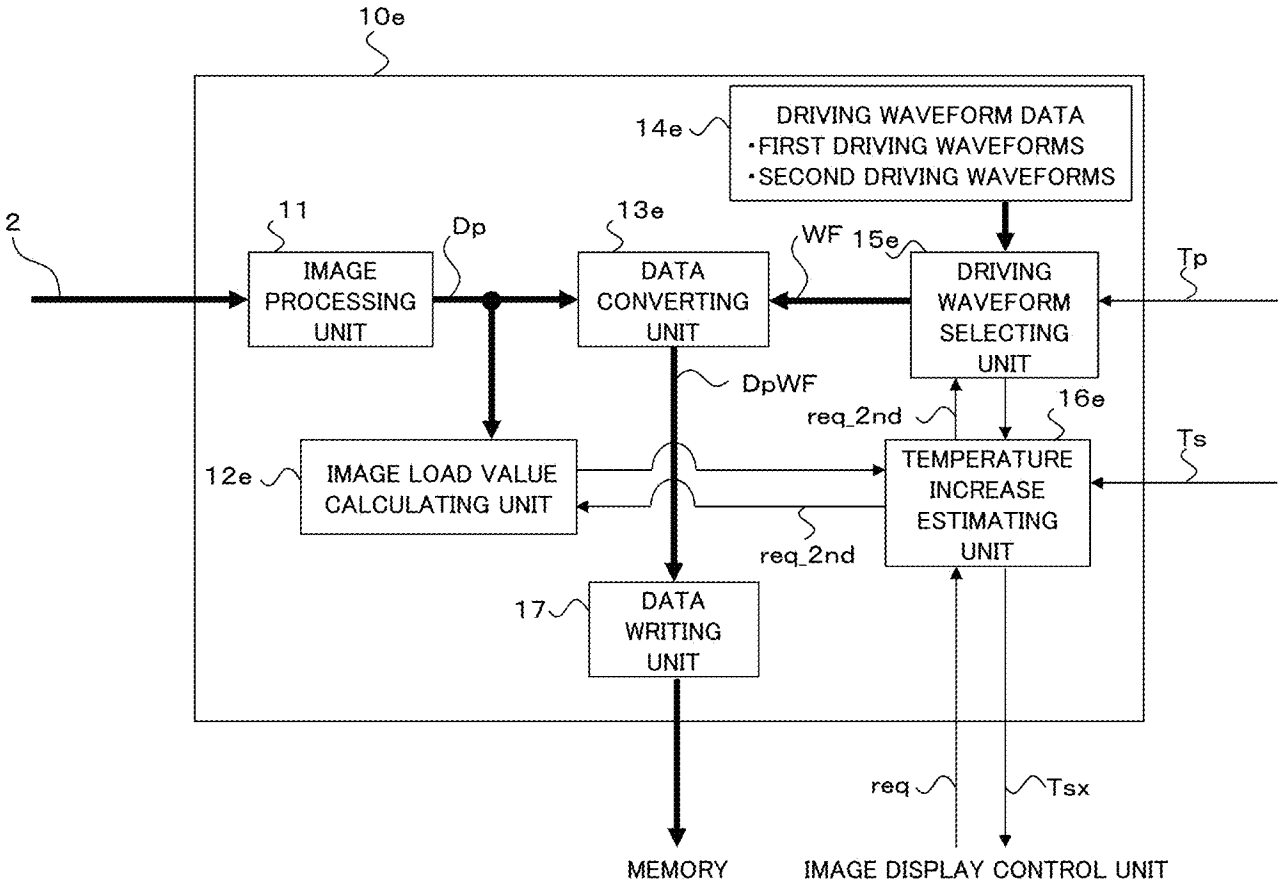
FIG. 41 is a block diagram of a temperature predicting unit according to the fifth embodiment.
Figure 42:
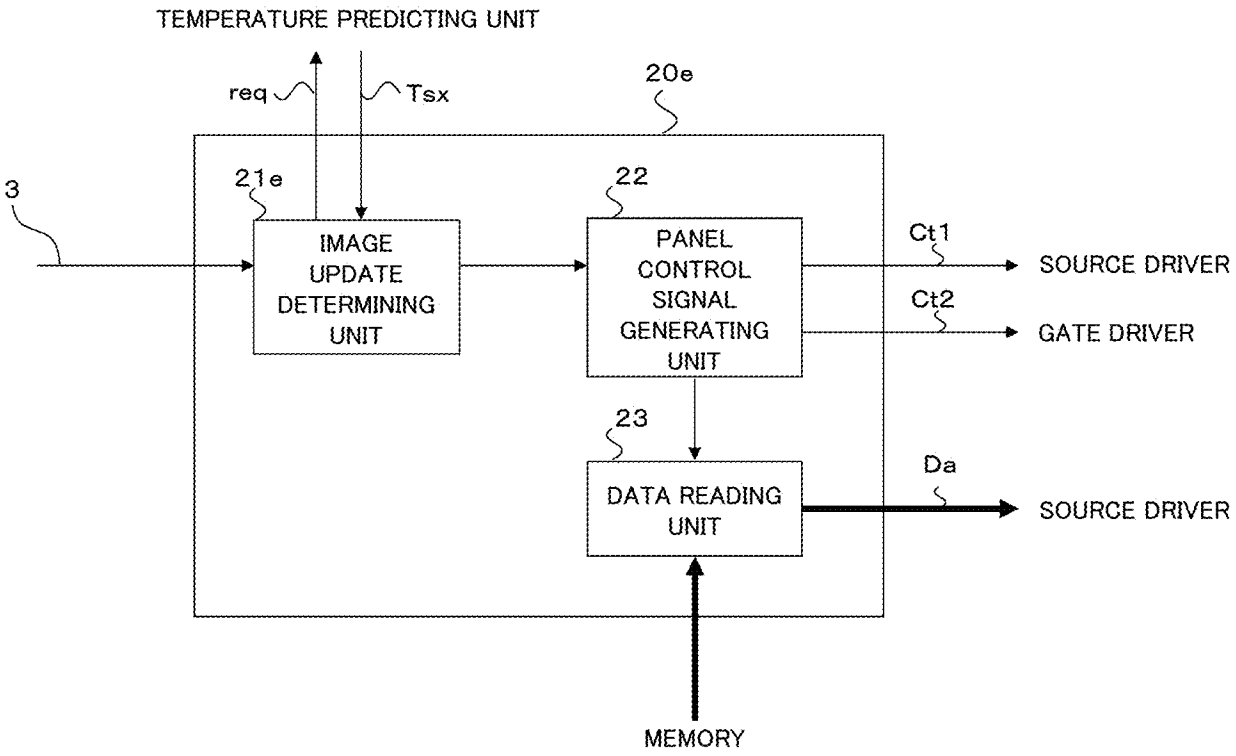
FIG. 42 is a block diagram of an image display control unit according to the fifth embodiment.

First, distinctive functions of the fifth embodiment in which the image update is performed using the second driving waveform will be described in connection with a first example applied to the first embodiment. FIG. 40 is a block diagram for describing a configuration of a first example of the fifth embodiment. A display panel controller 80*e* is equipped with a function of performing the image update using the second driving waveform. Thus, configurations of the display panel controller 80*e* and a temperature predicting unit 10*e* and an image display control unit 20*e* included in the display panel controller 80*e* are different from those of the first embodiment (FIG. 3), but the remaining components are the same. FIG. 41 and FIG. 42 illustrate exemplary configurations of the temperature predicting unit 10*e* and the image display control unit 20*e* according to the first example of the fifth embodiment, respectively.

As illustrated in FIG. 41, the temperature predicting unit 10*e* according to the first example of the fifth embodiment includes an image processing unit 11, an image load value calculating unit 12*e*, a data converting unit 13*e*, driving waveform data 14*e*, a driving waveform selecting unit 15*e*, a temperature increase estimating unit 16*e*, and a data writing unit 17. As illustrated in FIG. 42, the image display control unit 20*e* according to the first example of the fifth embodiment includes an image update determining unit 21*e*, a panel control signal generating unit 22, and a data reading unit 23.

The image update determining unit 21*e* illustrated in FIG. 42 has a function of comparing the temperature Tsx input from the temperature predicting unit 10*e* with a temperature that is set in advance according to a specification of the source driver 150 when the image update signal 3 is input from the application processor 1, transferring a signal to start an operation to the panel control signal generating unit 22 when the temperature Tsx is lower than the set temperature, similarly to the first embodiment. The image update determining unit 21*e* further has a function of requesting the temperature predicting unit 10*e* to transmit the temperature Tsx according to the second driving waveform through the request signal req in order to determine the image update according to the second driving waveform when the temperature Tsx is higher than the set temperature, comparing the temperature Tsx according to the second driving waveform obtained as a result with a previously set temperature, transmitting a signal to start an operation to the panel control signal generating unit 22 when the temperature Tsx according to the second driving waveform is lower than the set temperature, and transmitting the Tsx request signal req to the temperature predicting unit 10*e* at predetermined time intervals when the temperature Tsx according to the second driving waveform is higher than the set temperature as a distinctive function of the fifth embodiment.

The temperature increase estimating unit 16*e* illustrated in FIG. 41 has a function of estimating the source driver temperature Tsx after the display operation (image update) of the input image data 2 ends based on the image load value calculated by the image load value calculating unit 12*e*, the information of the driving waveform, and the source driver temperature Ts and a function of updating the temperature Tsx according to the request signal req input from the image display control unit 20*e* and outputting the updated temperature Tsx to the image display control unit 20*e*, similarly to the first embodiment. The temperature increase estimating unit 16*e* further has a function of transmitting a request signal req_2nd in order to cause the driving waveform selecting unit 15*e* to select the second driving waveform and cause the image load value calculating unit 12*e* to calculate an image load according to the second driving waveform when the temperature Tsx according to the second driving waveform is requested from the image display control unit 20*e* through the request signal req and a function of estimating the source driver temperature Tsx after the display operation (image update) of the input image data 2 ends according to the second driving waveform based on the image load value according to the second driving waveform calculated by the image load value calculating unit 12*e*, the information of the second driving waveform, and the source driver temperature Ts as a distinctive function of the fifth embodiment.

The driving waveform data (storage unit) 14*e* illustrated in FIG. 41 stores a second driving waveform group in addition to a first driving waveform group described above in the first embodiment. Here, the driving waveform group is, for example, a general term of the three driving waveforms, that is, the driving waveform (the high temperature) used when the display panel temperature is 39° C. to 20° C., the driving waveform (the normal temperature) used when the display panel temperature is 19° C. to 8° C., and the driving waveform (the low temperature) used when the display panel temperature is 7° C. to 0° C.

The driving waveform selecting unit 15*e* illustrated in FIG. 41 has a function of selecting the optimal driving waveform WF from the first driving waveform group of the driving waveform data 14*e* according to the display panel temperature Tp and outputting the selected optimal driving waveform WF to the data converting unit 13*e* and a function of outputting the information of the selected driving waveform to the temperature increase estimating unit 16*e*, similarly to the first embodiment. The driving waveform selecting unit 15*e* further has a function of selecting the optimal driving waveform WF from the second driving waveform group of the driving waveform data 14*e* according to the display panel temperature Tp and outputting the selected optimal driving waveform WF to the data converting unit 13*e* when the request signal req_2nd is received from the temperature increase estimating unit 16*e* and a function of outputting the information of the selected driving waveform to the temperature increase estimating unit 16*e* as a distinctive function of the fifth embodiment.

The data converting unit 13*e* illustrated in FIG. 41 has a function of converting the gradation data Dp into the chronological voltage data of the frame unit based on the driving waveform WF selected from the first driving waveform group and a function of outputting the converted data DpWF to the data writing unit 17, similarly to the first embodiment. The data converting unit 13*e* further has a function of converting the gradation data Dp into the chronological voltage data of the frame unit based on the driving waveform WF selected from the second driving waveform group when the driving waveform WF selected from the second driving waveform group is input from the driving waveform selecting unit 15*e* and a function of outputting the converted data DpWF to the data writing unit 17 as a distinctive function of the fifth embodiment. The data converting unit 13*e* may have a function of reading Dp from the memory since the gradation data Dp to be converted is the same.

The data writing unit 17 illustrated in FIG. 41 has a function of storing the data DpWF output from the data converting unit 13*e* in the memory 160, similarly to the first embodiment. Thus, when the data DpWF converted based on the driving waveform WF selected from the second driving waveform group is input, the data writing unit 17 writes the data DpWF according to the second driving waveform in the memory 160.

The image load value calculating unit 12*e* illustrated in FIG. 41 has a function of calculating the image load value based on the gradation data Dp in the first driving waveform and outputting the calculated value to the temperature increase estimating unit 16*e*, similarly to the first embodiment. The image load value calculating unit 12*e* further has a function of calculating the image load value based on the gradation data Dp in the second driving waveform and outputting the calculated value to the temperature increase estimating unit 16*e* when the request signal req_2nd is received from the temperature increase estimating unit 16*e* as a distinctive function of the fifth embodiment. The calculation of the image load value in the second driving waveform can be performed, for example, using Formulas (1) and (2), similarly to the method described in the first embodiment. For the coefficients J and K used in Formula (1), the coefficients used for the calculation of the image load in the first driving waveform may be stored as J1 and K1, the coefficients used for the calculation of the image load in the second driving waveform may be stored as J2 and K2, and the image load value may be calculated using the corresponding coefficients in individual cases. The coefficients J2 and K2 may be decided by causing a display device 4*e* that is actually used to display a basic image pattern and measuring the temperature increase ΔT of the source driver 150 at the time of image update as described above in the first embodiment.

The distinctive functions of the fifth embodiment have been described with reference to FIGS. 41 and 42, but the remaining configuration is the same as in the first embodiment, and thus a description thereof is omitted.

Figure 43:
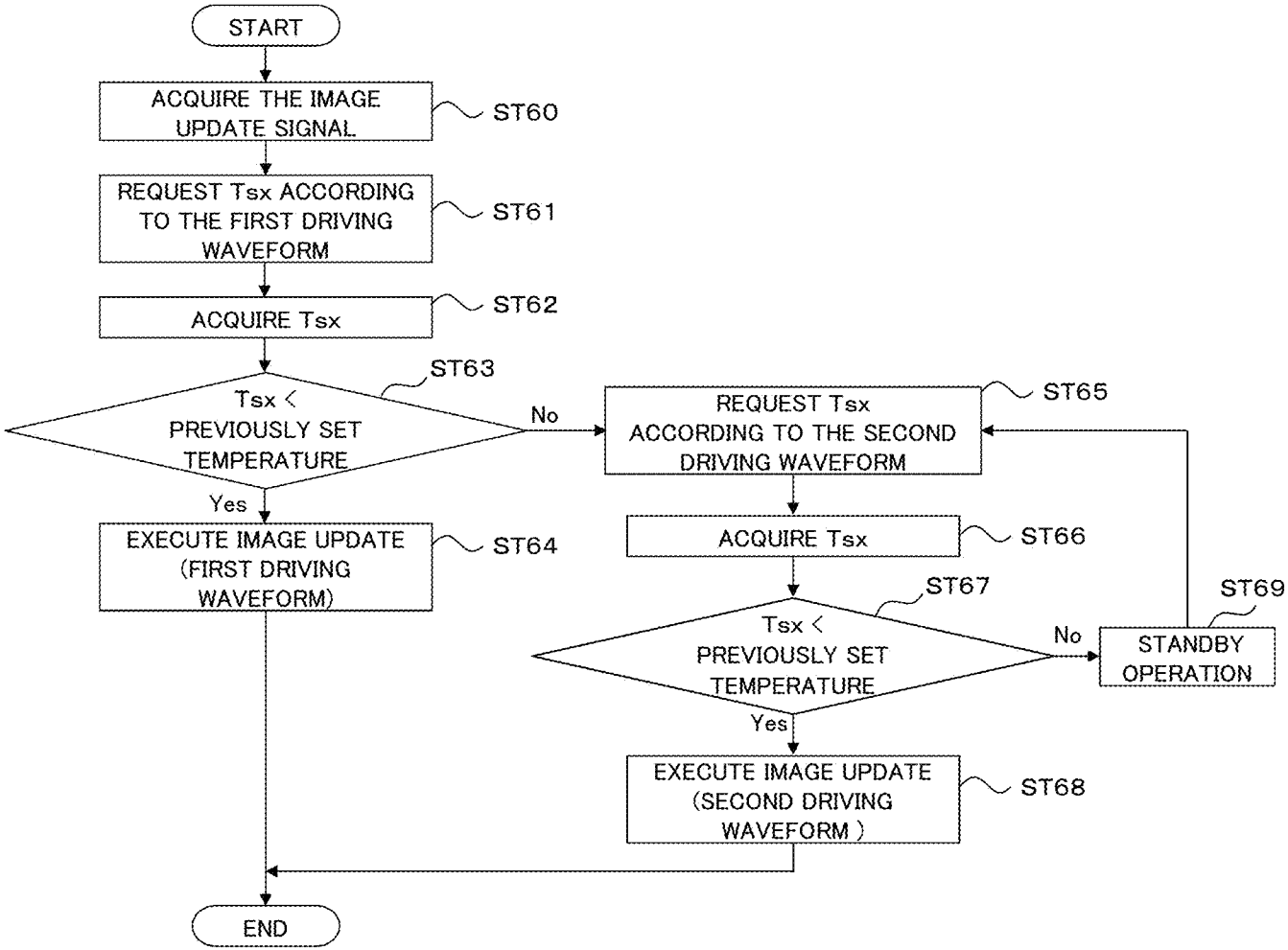
FIG. 43 is a flowchart for describing an operation of an image display control unit.

An operation of the display panel controller 80*e* illustrated in FIG. 40 will be described with reference to FIGS. 40 to 43. FIG. 43 is a flowchart for describing an operation of the image display control unit 20*e*.

As illustrated in FIG. 43, the image update determining unit 21*e* (see FIG. 42) acquires the image update signal 3 to instruct the image update from the application processor 1 (step ST60). The image update determining unit 21*e* requests the temperature predicting unit 10*e* to transmit the source driver temperature Tsx after the image update according to the first driving waveform through the request signal req (step ST61). Upon receiving the request, the temperature predicting unit 10*e* (see FIG. 40) acquires the current source driver temperature Ts through the temperature increase estimating unit 16*e* (see FIG. 41), calculates the source driver temperature Tsx after the image update based on the image load value and the driving waveform selected from the first driving waveform group, and transmits the calculated source driver temperature Tsx after the image update to the image display control unit 20*e* (see FIG. 42). The transmitted temperature Tsx is acquired by the image update determining unit 21*e* (step ST62). Then, the image update determining unit 21*e* determines whether or not the acquired temperature Tsx is lower than a previously set temperature (step ST63). When the determination result of step ST63 is YES, the signal to instruct the operation is output from the image update determining unit 21*e* to the panel control signal generating unit 22 (see FIG. 42), the signal and the voltage (ct1 and ct2) for controlling the source driver and the gate driver are output according to this signal, the data reading unit 23 (see FIG. 42) reads data forming an image from the memory 160 in synchronization with the control signal, and Da is output according to the specification of the source driver 150. At this time, since the data stored in the memory 160 is DpWF according to the first driving waveform, the image update based on the first driving waveform is performed (step ST64). When the determination result of step ST63 is NO, the image update determining unit 21*e* requests the temperature predicting unit 10*e* to transmit the source driver temperature Tsx after the image update according to the second driving waveform through the request signal req (step ST65). Upon receiving this request, the temperature increase estimating unit 16*e* (see FIG. 41) of the temperature predicting unit 10*e* transmits the request signal req_2nd, and thus the driving waveform selecting unit 15*e* selects the second driving waveform, and the image load value calculating unit 12*e* calculates the image load according to the second driving waveform. Thereafter, the temperature predicting unit 10*e* acquires the current source driver temperature Ts in the temperature increase estimating unit 16*e*, calculates the source driver temperature Tsx after the image update based on the image load value and the driving waveform selected from the second driving waveform group, and transmits the source driver temperature Tsx after the image update to the image display control unit 20*e*. The transmitted temperature Tsx is acquired by the image update determining unit 21*e* (step ST66). Then, the image update determining unit 21*e* determines whether or not the source driver temperature Tsx according to the acquired second driving waveform is lower than a previously set temperature (step ST67). When the determination result of step ST67 is YES, the signal to instruct the operation is output from the image update determining unit 21*e* to the panel control signal generating unit 22, the signal and the voltage (ct1 and ct2) for controlling the source driver and the gate driver are output according to this signal, the data reading unit 23 reads data forming an image from the memory 160 in synchronization with the control signal, and Da is output according to the specification of the source driver 150. At this time, since the data stored in the memory 160 is DpWF according to the second driving waveform, the image update based on the second driving waveform is performed (step ST68). When the determination result of step ST67 is NO, an standby operation is performed during a predetermined period of time without performing the image update (step ST69). After the standby operation, the image update determining unit 21*e* requests the temperature predicting unit 10*e* to transmit the source driver temperature Tsx after the image update according to the second driving waveform again (step ST65).

Figure 44:
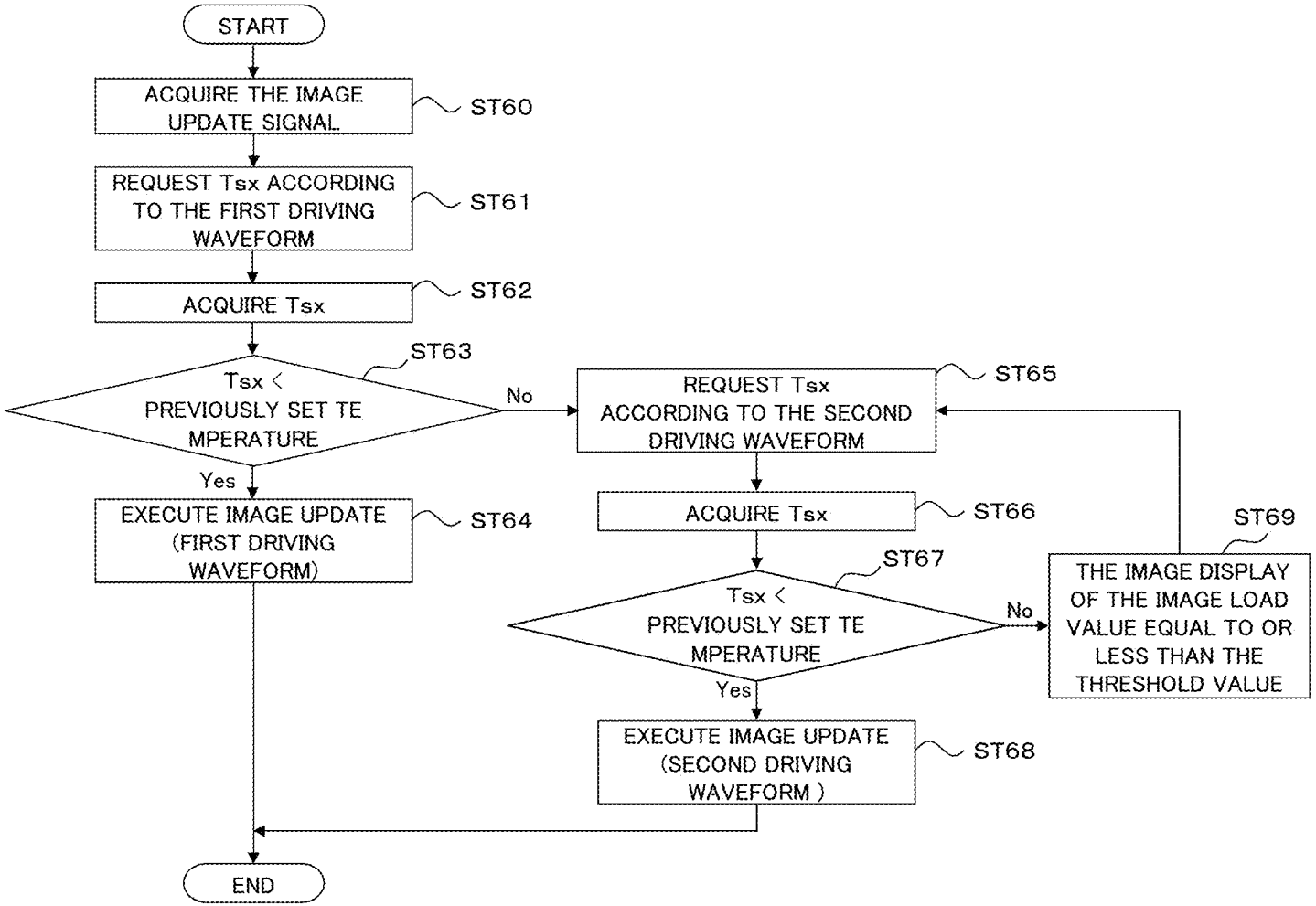
FIG. 44 is a flowchart for describing an operation of an image display control unit.

The operation of the image display control unit 20*e* according to the first example of the fifth embodiment has been described above with reference to the flowchart of FIG. 43, but it is an example of the operation, and the present invention is not limited to that of FIG. 43. For example, the same concept as in the modified example of the first embodiment may be applied, and when the determination result of step ST67 is NO, the image display of the image load value equal to or less than the threshold value may be performed. Further, when the determination result of step ST67 is NO, similarly to the modified example of the first embodiment, the image display of the smallest image load value among the image load values equal to or less than the threshold value may be performed. FIG. 44 is a flowchart when the image display of the image load value equal to or less than the threshold value is performed. In FIG. 43 and FIG. 44, after the standby operation is performed during a predetermined period of time or after the image display of the image load value equal to or less than the threshold value is performed (step ST69), the temperature predicting unit 10*e* is requested to transmit the source driver temperature Tsx after the image update according to the second driving waveform again (step ST65), but the transmission of the source driver temperature Tsx after the image update according to the first driving waveform may be requested (step ST61).

As described above, by configuring and operating the display device with the memory function, similarly to the first embodiment, it is possible to maintain the temperature of the source driver 150 to be equal to or less than the set temperature without deteriorating the display image quality. Thus, by setting an appropriate temperature based on the specification of the source driver as the set temperature, it is possible to prevent the image quality deterioration, the performance degradation of the source driver, and the breakdown of the source driver which are caused by the operation failure occurring when the operation guarantee temperature of the source driver is exceeded, it is possible to implement the reliable high-quality display device with the memory function. Further, the period of time until the image update is completed is long, but since the image update based on the second driving waveform can be performed, it is possible to prevent the user's confusion when the display screen does not react immediately.

Figure 45:
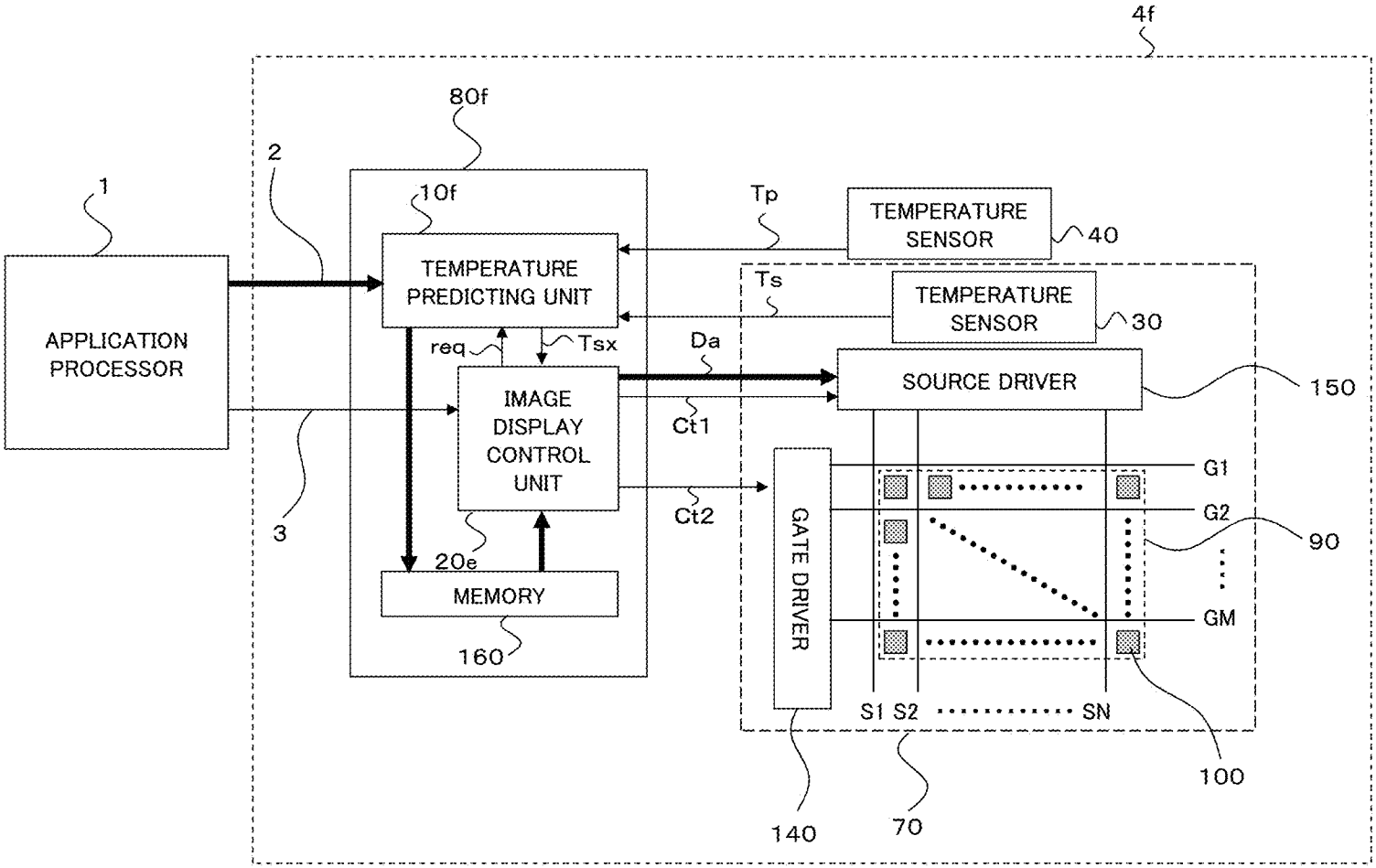
FIG. 45 is a block diagram for describing a configuration of a display device with a memory function according to the fifth embodiment.

Next, the distinctive functions of the fifth embodiment will be described in connection with a second example applied to the second embodiment. FIG. 45 is a block diagram for describing a configuration of a second example of the fifth embodiment. As described above, the first embodiment and the second embodiment differ in the calculation of the image load value, and the same applies to the first example of FIG. 40 and the second example of FIG. 45. Thus, a configuration of the second example of FIG. 45 differs from that of the first example of FIG. 40 only in a temperature predicting unit 10*f*, but the remaining components are the same, and thus a description thereof is omitted.

Figure 46:
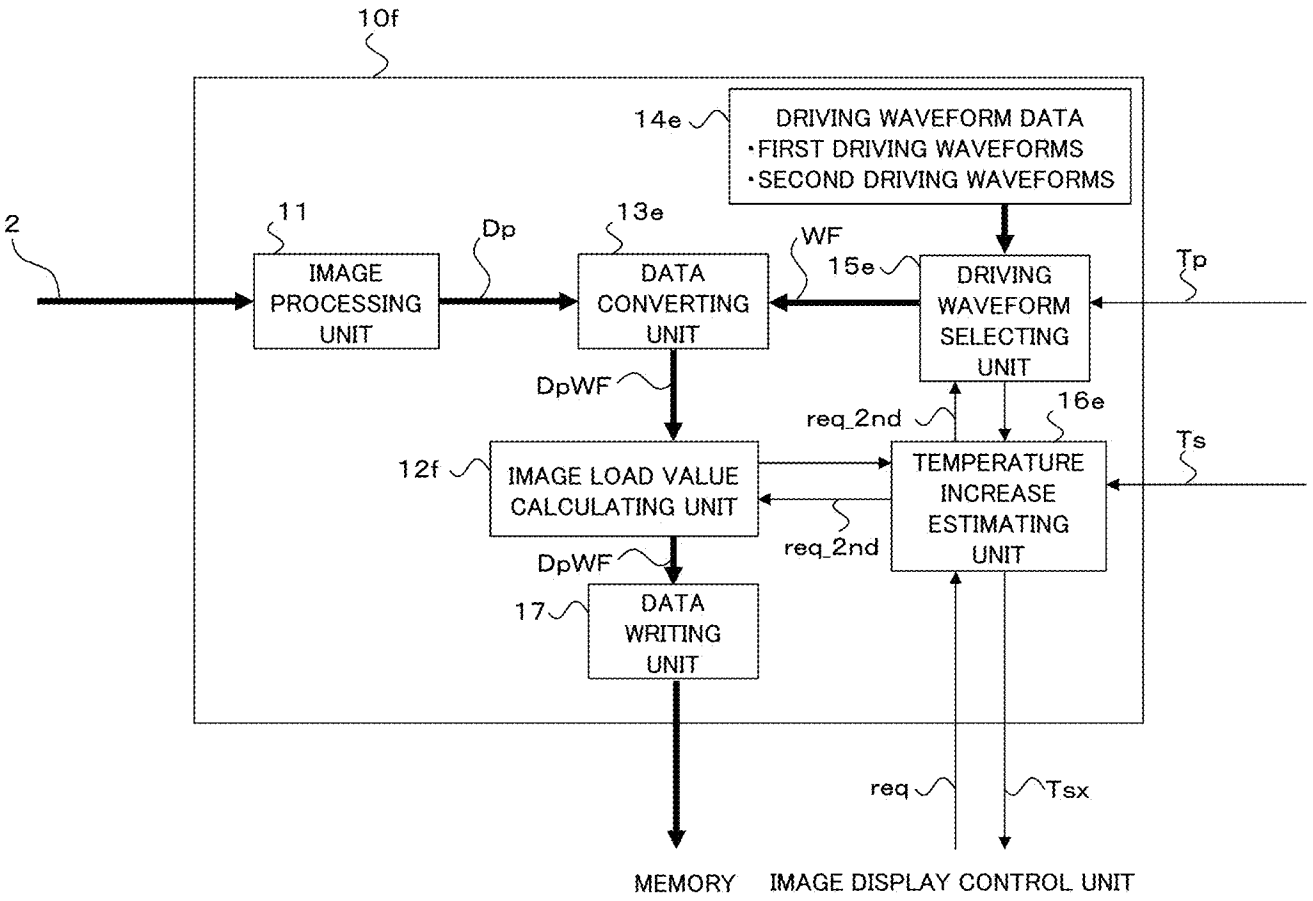
FIG. 46 is a block diagram of a temperature predicting unit according to the fifth embodiment.

FIG. 46 is a block diagram of a temperature predicting unit 10*f* according to the second example of the fifth embodiment. As illustrated in FIG. 46, an image processing unit 11, a data converting unit 13*e*, a driving waveform data 14*e*, a driving waveform selecting unit 15*e*, a temperature increase estimating unit 16*e*, and a data writing unit 17 that configure the temperature predicting unit 10*f* have the same functions as in the first example (FIG. 41). An image load value calculating unit 12*f* illustrated in FIG. 46 has a function of calculating the image load value PLV based on the voltage map in each frame of DpWF using Formulas (5) and (6) and outputting the calculated value to the temperature increase estimating unit 16*e* when DpWF converted based on the gradation data Dp and the driving waveform WF selected from the first driving waveform group in the data converting unit 13*e* is input, similarly to the second embodiment. The image load value calculating unit 12*f* further has function of calculating the image load value PLV based on the voltage map in each frame of DpWF using Formulas (5) and (6) and outputting the calculated value to the temperature increase estimating unit 16*e* when the request signal req_2nd is received from the temperature increase estimating unit 16*e*, and DpWF converted based on the gradation data Dp and the driving waveform WF selected from the second driving waveform group in the data converting unit 13*e* is input as a distinctive function of the fifth embodiment. The calculation of the image load value in the second driving waveform may be performed, for example, such that for the coefficients used in Formula (5), the coefficients used in the case of the first driving waveform are stored as J1 and K1, the coefficients used in the case of the second driving waveform are stored as J2 and K2, and the image load value is calculated using the corresponding coefficients in individual cases, similarly to the first example of the fifth embodiment. Further, a value obtained by dividing the image load value PLV calculated by Formula (6) by the number L of frames, that is, a value obtained by temporal averaging may be used as the image load value.

The remaining configuration of the second example of the fifth embodiment is the same as the configuration of the first example of the fifth embodiment. An operation according to the second example of the fifth embodiment differs from that of the first example only in the calculation method of the image load value, and an operation of the image display control unit 20*e* in a display panel controller 80*f* is the same as in the first example, and thus the operation of the second example of the fifth embodiment is the same as the operations of the first example and the modified example thereof (FIG. 43 and FIG. 44).

Figure 47:
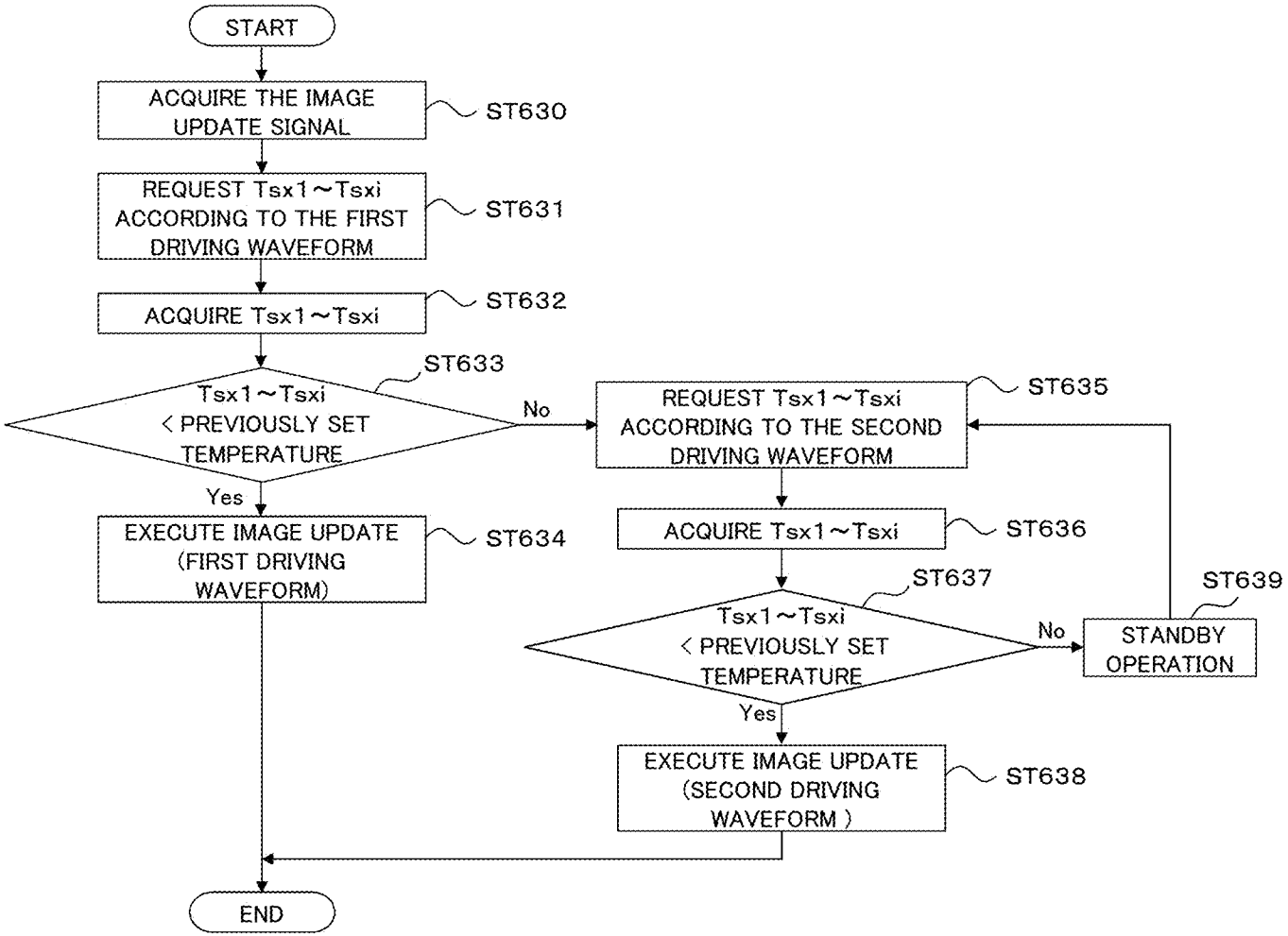
FIG. 47 is a flowchart for describing an operation of an image display control unit.
Figure 48:
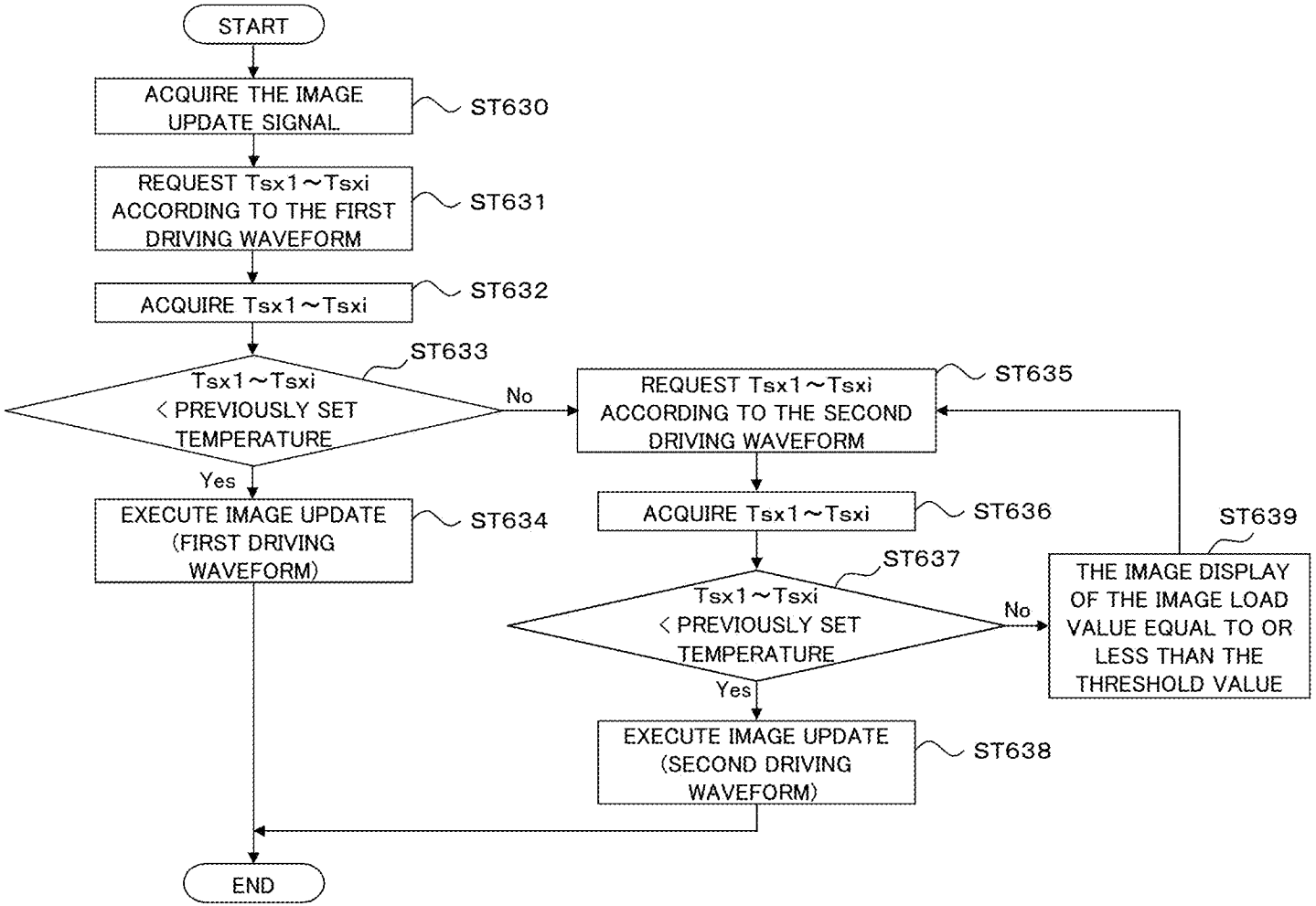
FIG. 48 is a flowchart for describing an operation of an image display control unit.

The distinctive functions of the fifth embodiment can be applied to the third embodiment using the display panel equipped with the i source drivers (a third example). In the third example of the fifth embodiment, the components of the first example of the fifth embodiment or the second example of the fifth embodiment may be appropriately combined according to the concept of the configuration and operation described in the third embodiment. Thus, a detailed description is omitted. FIGS. 47 and 48 are flowcharts for describing an operation according to the third example of the fifth embodiment. The distinctive functions of the fifth embodiment can be applied to the fourth embodiment using the temperature characteristics data of the source driver and the timer instead of the temperature sensor that obtains the temperature Ts of the source driver 150. The components of the first example of the fifth embodiment or the second example of the fifth embodiment may be appropriately combined according to the concept of the configuration and operation described in the fourth embodiment.

Sixth Embodiment

Next, a display device with a memory function according to a sixth embodiment of the present invention will be described. The sixth embodiment is the same as the fourth embodiment in the operation of calculating the image load value based on the image data to be displayed next, estimating the temperatures Tsx or Tsx1 to Tsxi of the driver after the image update operation based on the temperature acquired by the temperature acquiring unit before the image update and the calculated image load value, comparing the temperature Tsx or Tsxi with the set temperature that is set in advance, and performing the image update when the temperature Tsx is lower than the set temperature or when all the temperatures Tsx1 to Tsxi are lower than the set temperature but differs from the fourth embodiment in an operation when the temperature Tsx is equal to or higher than the set temperature or at least one of the temperatures Tsx1 to Tsxi is equal to or higher than the set temperature.

In the sixth embodiment, when the temperature Tsx is equal to or higher than the set temperature or at least one of the temperatures Tsx1 to Tsxi is equal to or higher than the set temperature, it is determined whether or not a source line time division image update is performed.

An image update in which each source driver outputs a voltage according to image data to 1/Q source lines in one frame is referred to as a "source line time division image update." If the number of source lines to which one source driver outputs a voltage according to image data in a first frame is indicated by 1/Q (Q is a natural number), an operation of causing an output of remaining (Q−1)/Q of the source lines to be 0 V or a high impendence (which is hereinafter indicated by HI-Z), outputting the voltage according to the image data to any one source line to which 0 V or HI-Z is output in the previous frame in the next frame, and causing an output of the (Q−1)/Q of the source lines including the source line to which the voltage according to the image data is output in the previous frame to be 0 V or HI-Z is performed, and the same operation is repeated in subsequent frames to complete the image update.

Since the output of the (Q−1)/Q of the source lines per source driver within one frame period is 0 V or HI-Z, different voltages are not to the neighboring pixels in the column direction among the pixels arranged along the source lines. Thus, even in the case of the image data having the high image load value in the normal image update (Q=1), in the source line time division image update, it is possible to reduce the image load value thereof and suppress heat generation of the source driver.

A basic operation of the source line time division image update will be described below with reference to FIGS. 49 to 51.

Figure 49:
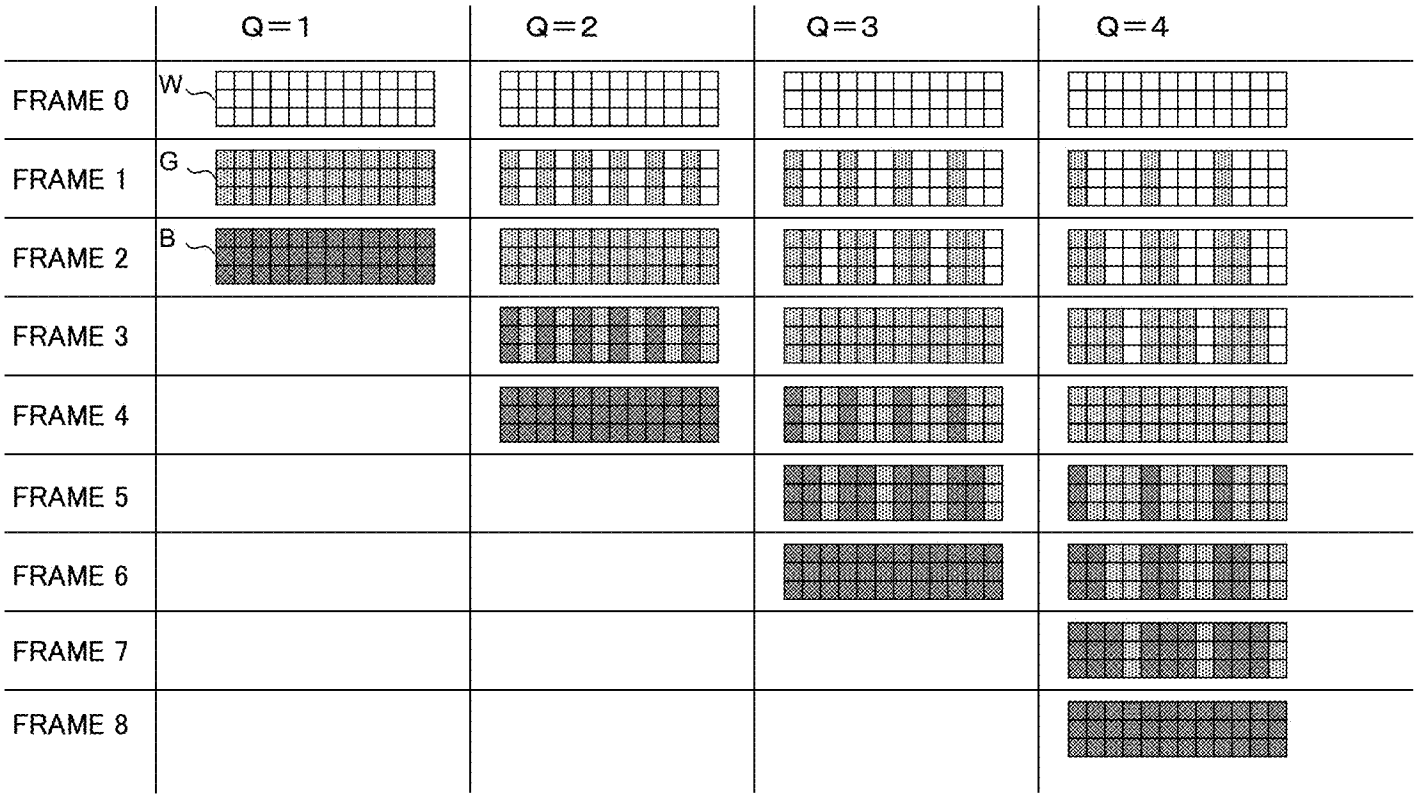
FIG. 49 is a diagram for describing a concept of a display operation according to a sixth embodiment.

FIG. 49 is a diagram for describing a concept of the display operation in the source line time division image update according to a division number Q, and a form in which display of all pixels of a screen configured with 3×12 pixels changes from white (W) to gray (G) and then black (B) according to image data causing the entire screen to display black (B) is illustrated for each elapsed frame. Here, the pixels in each column are connected to the same source lines, and a total of 12 source lines are driven by one source driver. FIGS. 50A to 51D illustrate an applied voltage and a reflection rate of pixels according to an elapsed time t in a predetermined column of pixels illustrated in FIG. 49. In the actual display panel, the voltage is applied to the pixels in the order of rows (so-called line sequential driving), and thus in upper and lower pixels of the display unit, a temporal deviation occurs in the display state and the reflection rate change, but in FIGS. 49 to 51D, for the sake of convenience of description (in order to simplify the drawings), the deviation in the display state and the reflection rate change between the pixels of respective rows is not expressed, and a uniform expression is used. Further, for the sake of convenience of description, the display state of the pixel is assumed to change from white (W) to black (B) as +V is applied during two frame periods.

Figure 50A:
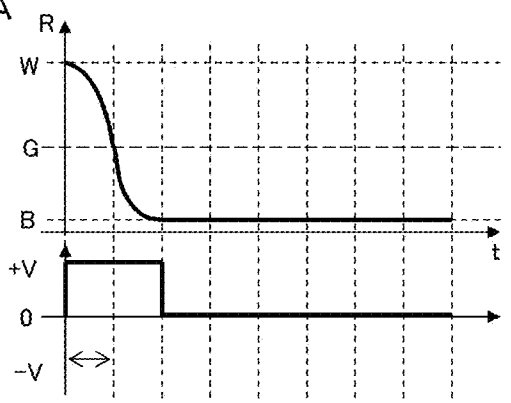
FIGS. 50A to 50D are diagrams illustrating an applied voltage and a reflection rate of pixels according to an elapsed time.
Figure 50B:
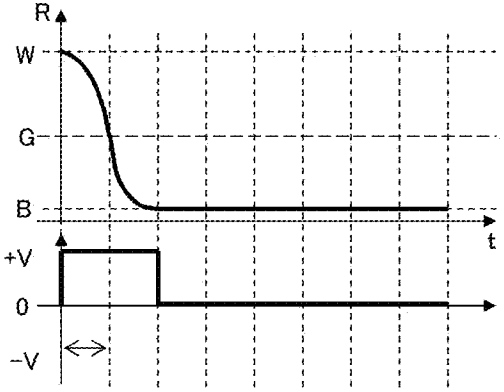

When Q=1 (when the source line time division is not performed), the source driver outputs the voltage +V according to the image data of black (B) to 1/1 of the source lines (all the source lines) in the frame 1, and thus the reflection rate of a column of pixels connected with the source lines becomes gray (G) as illustrated in FIGS. 50A and 50B, and the display state of all the pixels of the screen becomes gray (G) as illustrated in FIG. 49. In the frame 2, similarly to the frame 1, the voltage +V according to the image data is output to all the source lines, and thus the reflection rate of all the pixels of the screen becomes black (B), and the display state becomes black (B).

Figure 50C:
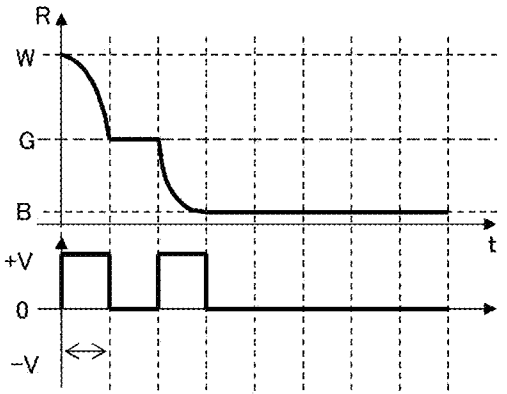
Figure 50D:
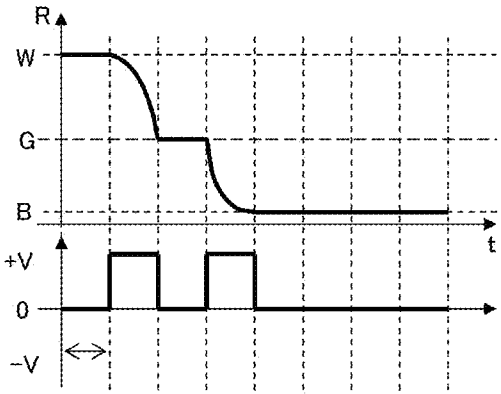

When Q=2, the source driver outputs the voltage +V according to the image data of black (B) to ½ of the source lines (source lines of odd-numbered columns) in the frame 1, and thus the reflection rate of the pixels of the odd-numbered columns connected with the source lines becomes gray (G) as illustrated in FIG. 50C, but 0 V is output to the remaining source line (the source lines of the even-numbered columns) regardless of the image data, and thus the reflection rate of the pixels of the even-numbered columns connected with the source lines is maintained to be white (W) without change as illustrated in FIG. 50D. Thus, in the frame 1, the screen display state of the pixels in the odd-numbered columns becomes gray (G), and the screen display state of the pixels in the even-numbered columns becomes white (W) as illustrated in FIG. 49. In the frame 2, the source driver outputs the voltage +V according to the image data of black (B) to the source lines to which 0 V is output in the frame 1, that is, the source lines of the even-numbered columns, and outputs 0 V to the remaining source lines of the odd-numbered columns, regardless of the image data. Thus, the reflection rate of the pixels in the even-numbered columns becomes gray (G) as illustrated in FIG. 50D, and the reflection rate of the pixels of the odd-numbered columns is maintained to be gray (G) as illustrated in FIG. 50C. Thus, in the frame 2, the display state of all the pixels of the screen becomes gray (G) as illustrated in FIG. 49. In the frame 3, the source driver outputs the voltage +V according to the image data of black (B) to the source lines of the odd-numbered columns to which 0 V is output in the frame 2, and outputs 0 V to the remaining source lines of the even-numbered columns regardless of the image data. Thus, the reflection rate of the pixels of the odd-numbered columns becomes black (B) as illustrated in FIG. 50C, and the reflection rate of the pixels in the even-numbered columns is maintained to be gray (G) without change as illustrated in FIG. 50D. Thus, in the frame 3, the screen display state of the pixels in the odd-numbered columns becomes black (B), and the screen display state of the pixels in the even-numbered columns becomes gray (G) as illustrated in FIG. 49. In the frame 4, the source driver outputs the voltage +V according to the image data of black (B) to the source lines of the even-numbered columns to which 0 V is output in the frame 3, and outputs 0 V to the remaining source lines of the odd-numbered columns regardless of the image data. Thus, the reflection rate of the pixels in the even-numbered columns becomes black (B) as illustrated in FIG. 50D, and the reflection rate of the pixels of the odd-numbered columns is maintained to be black (B) without change as illustrated in FIG. 50C. Thus, in the frame 4, the display state of all the pixels of the screen becomes black (B) as illustrated in FIG. 49.

Figure 51A:
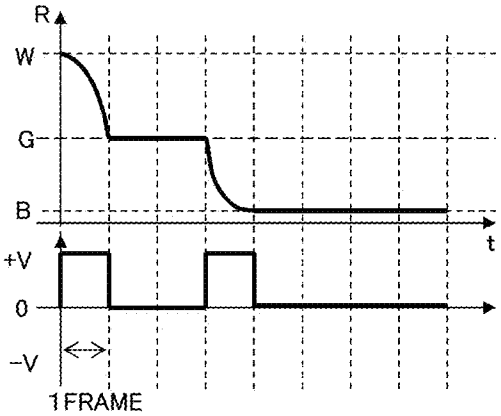
FIGS. 51A to 51D are diagrams illustrating an applied voltage and a reflection rate of pixels according to an elapsed time.
Figure 51B:
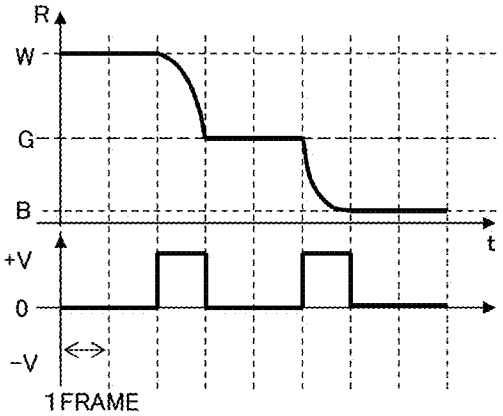

When Q=3, in the frame 1, the source driver outputs the voltage +V according to the image data of black (B) to ⅓ of the source lines (for example, the source lines of the 1st, 4th, 7th, and 10th columns), and outputs 0 V to the source lines of the remaining columns regardless of the image data. In the reflection rate of the pixel, as described above in the case of Q=2, the reflection rate of the pixels to which +V is applied changes, but the reflection rate of the pixels to which 0 V is applied does not change. FIG. 51A illustrate the applied voltage and the reflection rate of the pixels in the 1st column, and FIG. 51B illustrates the applied voltage and the reflection rate of the pixels in the 12th column. Thus, in the frame 1, the screen display state of the pixels in the 1st, 4th, 7th, and 10th columns becomes gray (G), and the pixels in the remaining columns becomes white (W) as illustrated in FIG. 49. In the frame 2, the source driver outputs the voltage +V according to the image data of black (B) to ⅓ (for example, the source lines of the 2nd, 5th, 8th, and 11th columns) of a total number of source lines to which 0 V is output in the frame 1, and outputs 0 V to the source lines of the remaining columns regardless of the image data. Since the reflection rate of the pixels to which +V is applied changes, and the reflection rate of the pixels to which 0 V is applied does not change, and thus in the frame 2, the screen display state of the pixels in the 1st, 2nd, 4th, 5th, 7th, 8th, 10th, and 11th columns becomes gray (G), and the screen display state of the pixels in the remaining columns becomes white (W) as illustrated in FIG. 49. In the frame 3, the source driver outputs the voltage +V according to the image data of black (B) to the source lines (the source lines of the 3rd, 6th, 9th, and 12th columns) to which the voltage according to the image data is not output in the frame 1 and the frame 2 among the source lines to which 0 V is output in the frame 2, and outputs 0 V to the source lines of the remaining columns regardless of the image data. Since the reflection rate of the pixels to which +V is applied changes, and the reflection rate of the pixels to which 0 V is applied does not change, in the frame 3, the display state of all the pixels of the screen becomes gray (G). In the frame 4, similarly to the frame 1, the source driver outputs the voltage +V according to the image data of black (B) to ⅓ (for example, the source lines of the 1st, 4th, 7th, and 10th columns) of the source lines, and outputs 0 V to the source lines of the remaining columns regardless of the image data. Since the reflection rate of the pixels to which +V is applied changes, and the reflection rate of the pixels to which 0 V is applied does not change, in the frame 4, the screen display state of the pixels in the 1st, 4th, 7th, and 10th columns becomes black (B), and the screen display state of the pixels in the remaining columns becomes gray (G) as illustrate din FIG. 49. In the frame 5, similarly to the frame 2, the source driver outputs the voltage +V according to the image data of black (B) to ⅓ (for example, the source lines of the 2nd, 5th, 8th, and 11th columns) of a total number of source lines to which 0 V is output in the previous frame (the frame 4), and outputs 0 V to the source lines of the remaining columns regardless of the image data. Thus, the screen display state of the pixels in the 1st, 2nd, 4th, 5th, 7th, 8th, 10th, and 11th columns becomes black (B), the screen display state of the pixels in the remaining columns becomes gray (G) as illustrated in FIG. 49. In the frame 6, the source driver outputs the voltage +V according to the image data of black (B) to the source lines (the source lines of the 3rd, 6th, 9th, and 12th columns) to which the voltage according to the image data is not output in the frame 4 and the frame 5 among the source lines to which 0 V is output in the previous frame (the frame 5), and outputs 0 V to the source lines of the remaining columns regardless of the image data. Thus, in the frame 6, the display state of all the pixels of the screen becomes black (B).

Figure 51C:
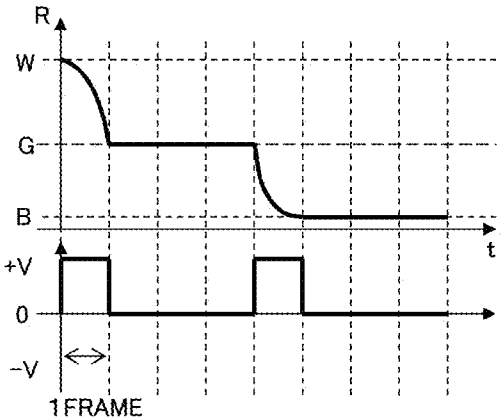
Figure 51D:
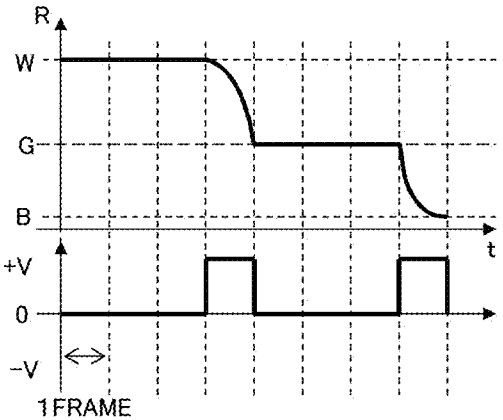

When Q=4, in the frame 1, the source driver outputs the voltage +V according to the image data of black (B) to ¼ (for example, the source lines of the 1st, 5th, and 9th columns) of the source lines, and outputs 0 V to the source lines of the remaining columns regardless of the image data. FIG. 51C illustrates the applied voltage and the reflection rate of the pixels in the 1st column, and FIG. 51D illustrates the applied voltage and the reflection rate of the pixels in the 12th column. Since the reflection rate of the pixels to which +V is applied changes, and the reflection rate of the pixels to which 0 V is applied does not change, in the frame 1, the screen display state of the pixels in the 1st, 5th, and 9th columns becomes gray (G), and the screen display state of the pixels in the remaining columns becomes white (W) as illustrated in FIG. 49. In the frame 2, the source driver outputs the voltage +V according to the image data of black (B) to ¼ (for example, the source lines of the 2nd, 6th, and 10th columns) of a total number of the source lines to which 0 V is output in the frame 1, and outputs 0 V to the source lines of the remaining columns regardless of the image data. In the frame 2, the screen display state of the pixels in the 1st, 2nd, 5th, 6th, 9th, and 10th columns becomes gray (G), and the screen display state of the pixels in the remaining columns becomes white (W) as illustrated in FIG. 49. In the frame 3, the source driver outputs the voltage +V according to the image data of black (B) to ¼ (for example, the source lines of the 3rd, 7th, and 11th columns) of total number of source lines to which 0 V is output in the frame 1 and the frame 2, that is, a total number of source lines to which the voltage according to the image data is not output, and outputs 0 V to the source lines of the remaining columns regardless of the image data. In the frame 3, the screen display state of the pixels in the 1st, 2nd, 3rd, 5th, 6th, 7th, 9th, 10th, and 11th columns becomes gray (G), and the screen display state of the pixels in the remaining columns becomes white (W) as illustrated in FIG. 49. In the frame 4, the source driver outputs the voltage +V according to the image data of black (B) to the source lines to which 0 V is output in the frame 1, the frame 2, and the frame 3, that is, the source lines to which the voltage according to the image data is not output (the source lines of the 4th, 9th, and 12th columns), and outputs 0 V to the source lines of the remaining columns regardless of the image data. In the frame 4, the screen display state of all the pixels becomes gray (G) as illustrated in FIG. 49. The operation in the subsequent frames 4 to 8 is basically the repetition of the operation in the frames 1 to 4, and thus a description thereof is omitted. In the frame 8, the screen display state of all the pixels becomes black (B) as illustrated in FIG. 49.

The examples in which the division number Q ranges from 2 to 4 have been described above, but the value of Q is not limited thereto, and any other value may be used. As described above with reference to FIGS. 36 to 38, in the source line time division image update, an operation that is completed in one frame in the normal image update (Q=1) is completed throughout Q frames. Thus, the number of frames necessary until the source line time division image update is completed is Q times that the image update period of time described above in the first to fourth embodiments.

An configuration and operation of the display device with the memory function according to the sixth embodiment of the present invention will be described below with reference to the drawings.

First, distinctive functions of the sixth embodiment in which the source line time division image update is performed will be described in connection with a first exemplary configuration applied to the first embodiment.

Figure 52:
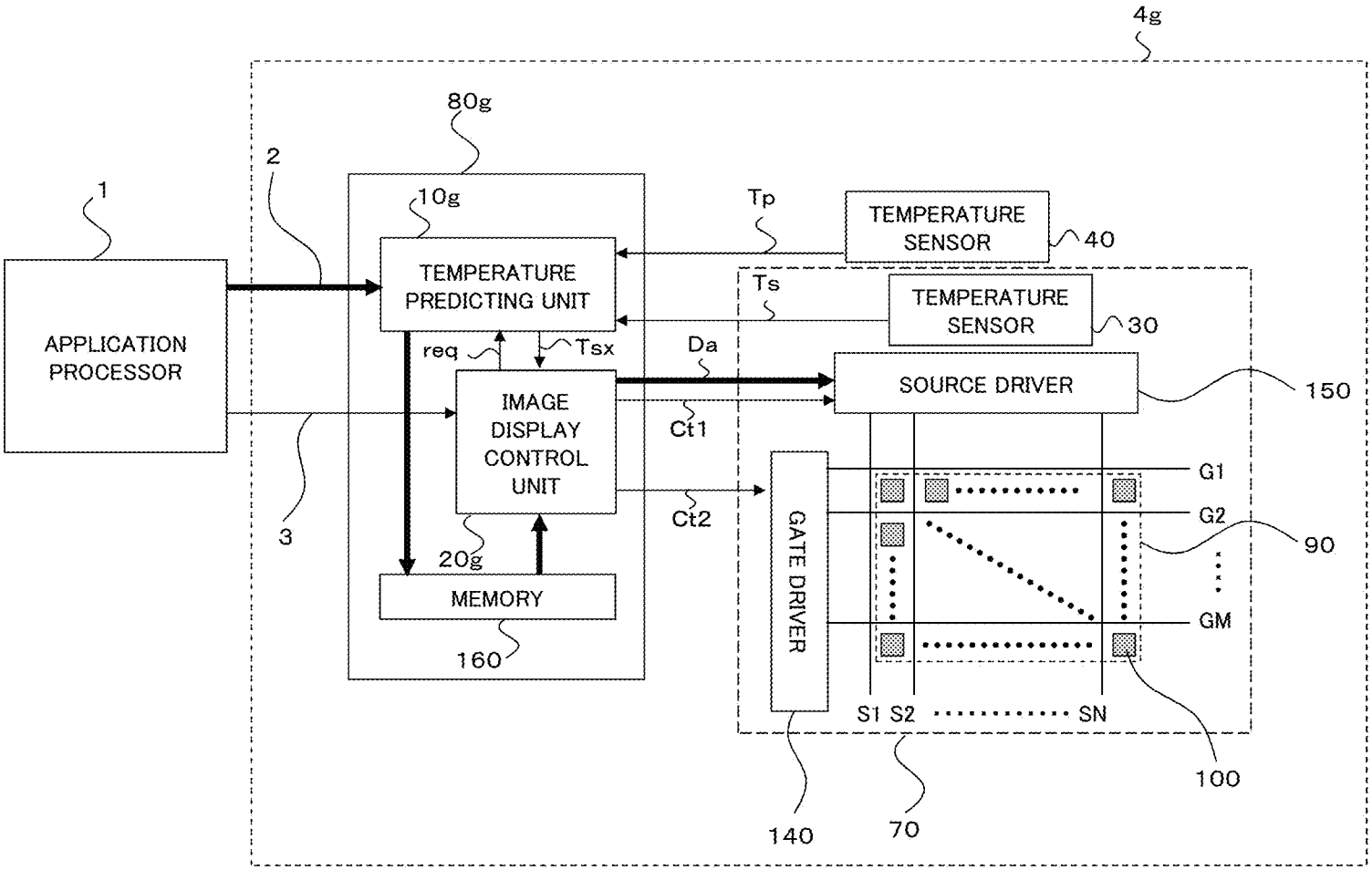
FIG. 52 is a block diagram for describing a configuration of a display device with a memory function according to the sixth embodiment.
Figure 53:
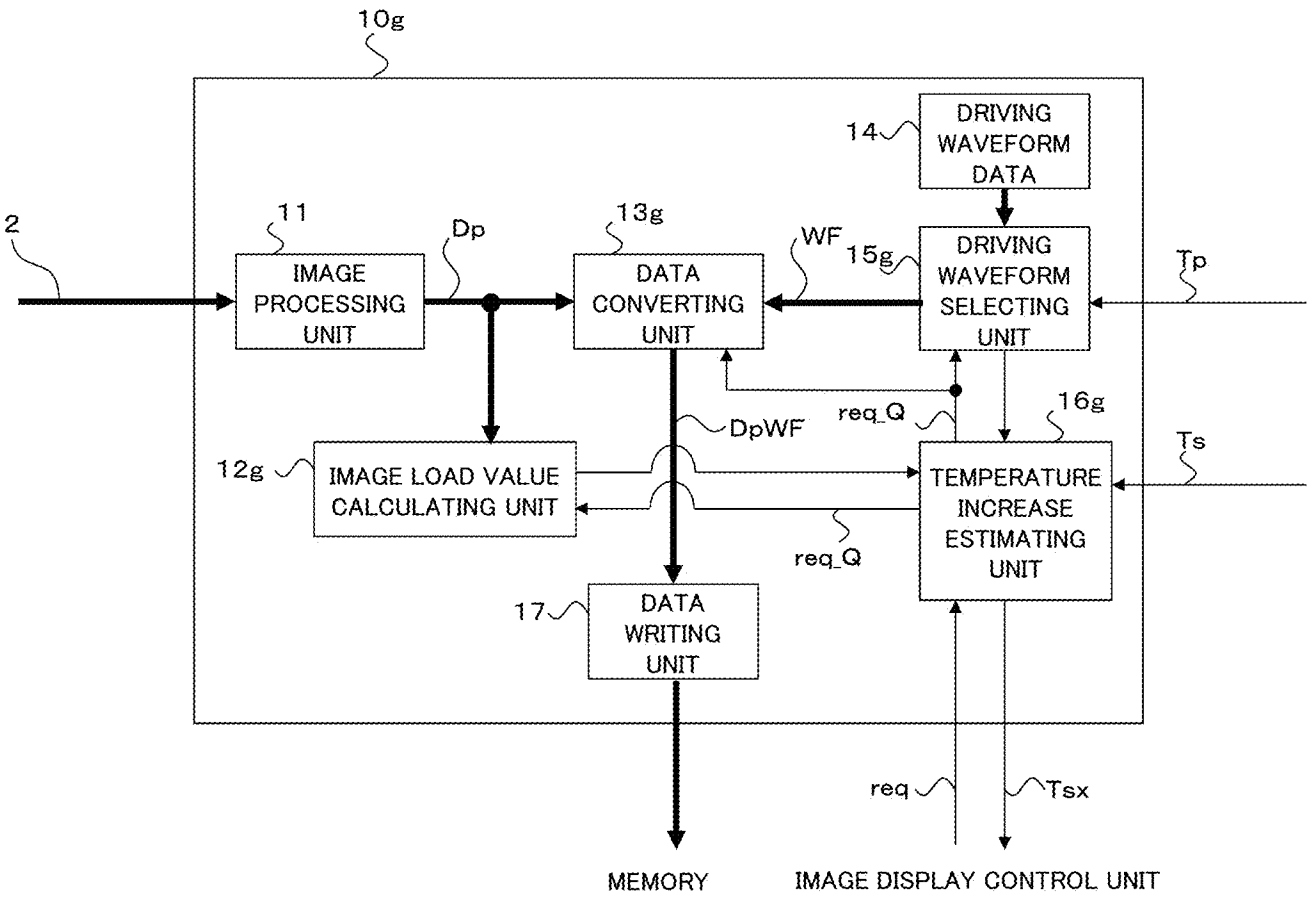
FIG. 53 is a block diagram of a temperature predicting unit according to the sixth embodiment.
Figure 54:
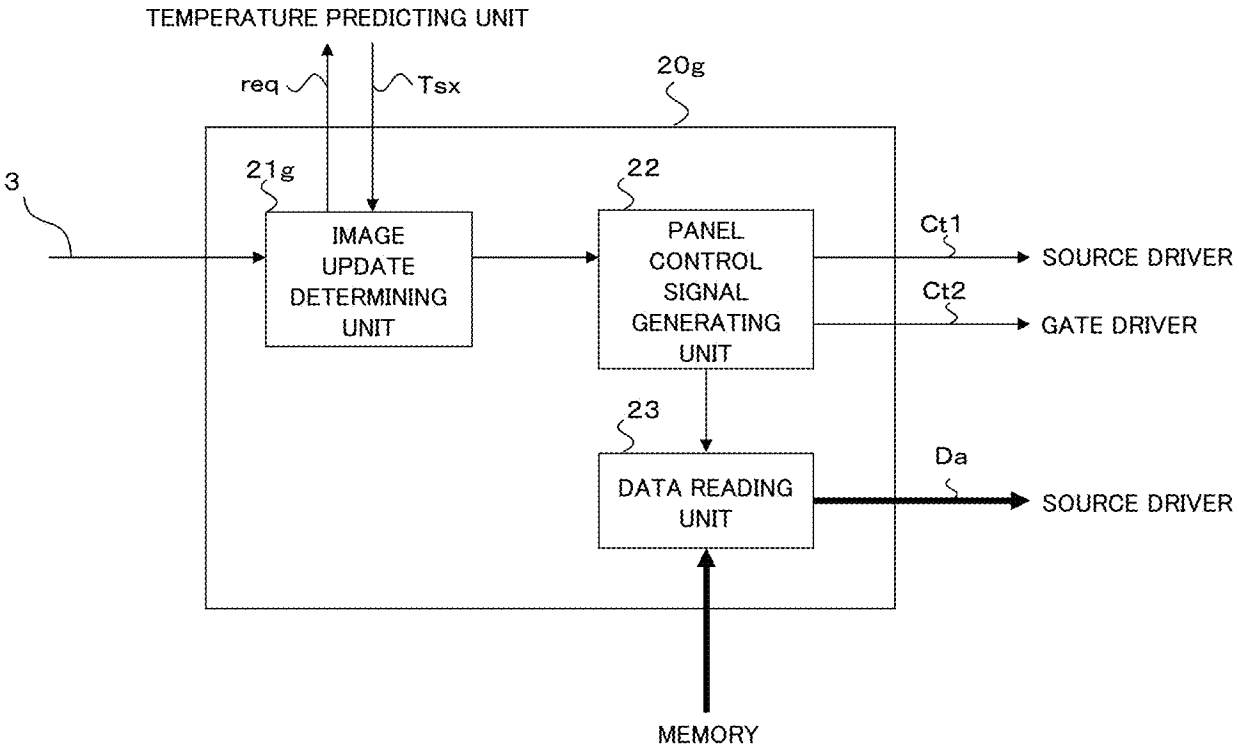
FIG. 54 is a block diagram of an image display control unit according to the sixth embodiment.

FIG. 52 is a block diagram for describing the first exemplary configuration of the sixth embodiment. A display panel controller 80*g* has a function of performing the source line time division image update. Thus, components except the display panel controller 80*g* and a temperature predicting unit 10*g* and an image display control unit 20*g* included in the display panel controller 80*g* are the same as in the first embodiment (FIG. 3). FIGS. 53 and 54 illustrate the temperature predicting unit 10*g* and the image display control unit 20*g* according to the first exemplary configuration of the sixth embodiment, respectively. The temperature predicting unit 10*g* includes an image processing unit 11, an image load value calculating unit 12*g*, a data converting unit 13*g*, driving waveform data 14, a driving waveform selecting unit 15*g*, a temperature increase estimating unit 16*g*, and a data writing unit 17. The image display control unit 20*g* includes an image update determining unit 21*g*, a panel control signal generating unit 22, and a data reading unit 23.

The image update determining unit 21*g* illustrated in FIG. 54 has a function of comparing the temperature Tsx input from the temperature predicting unit 10*g* with a temperature that is set in advance according to a specification of the source driver 150 when an image update signal 3 is input from the application processor 1, and transferring the signal to start an operation to the panel control signal generating unit 22 when the temperature Tsx is lower than the set temperature, similarly to the first embodiment. The image update determining unit 21*g* further has a function of requesting the temperature predicting unit 10*g* to transmit the temperature Tsx at the time of source line Q division in order to determine the source line time division image update through the request signal req when the temperature Tsx is higher than the set temperature, comparing the temperature Tsx at the time of source line Q division obtained as a result with a previously set temperature, transferring the signal to start an operation to the panel control signal generating unit 22 when the temperature Tsx at the time of source line Q division is lower than the set temperature, and requesting the temperature predicting unit 10*g* to transmit the temperature Tsx at predetermined time intervals when the temperature Tsx at the time of source line Q division is higher than the set temperature as the distinctive function of the sixth embodiment.

The temperature increase estimating unit 16*g* illustrated in FIG. 53 has a function of estimating the source driver temperature Tsx after the display operation (image update) of the input image data 2 ends based on the image load value calculated by the image load value calculating unit 12*g*, the information of the driving waveform, and the source driver temperature Ts and a function of updating the temperature Tsx according to the request signal req input from the image display control unit 20*g* and outputting the updated temperature Tsx to the image display control unit 20*g*, similarly to the first embodiment. The temperature increase estimating unit 16*g* further has a function of transmitting the signal req_Q for causing the driving waveform selecting unit 15*g* to select the driving waveform again, causing the data converting unit 13*g* to perform conversion into DpWF corresponding to Q division, and causing the image load value calculating unit 12*g* to calculate the image load at the time of source line Q division when transmission of the temperature Tsx at the time of source line Q division is requested from the image display control unit 20*g* through the request signal req and a function of estimating the source driver temperature Tsx after the source line time division image update of the input image data 2 ends based on the image load value at the time of source line Q division calculated by the image load value calculating unit 12*g*, the information of the driving waveform, and the source driver temperature Ts as the distinctive function of the sixth embodiment.

The driving waveform selecting unit 15*g* illustrated in FIG. 53 has a function of selecting the optimal driving waveform WF from the first driving waveform group of the driving waveform data 14 according to the display panel temperature Tp and outputting the selected optimal driving waveform WF to the data converting unit 13*g* and a function of outputting the information of the selected driving waveform to the temperature increase estimating unit 16*g*, similarly to the first embodiment. The driving waveform selecting unit 15*g* further has a function of selecting the optimal driving waveform WF from the driving waveform data 14 according to the display panel temperature Tp again and outputting the selected optimal driving waveform WF to the data converting unit 13*g* when a request signal req_Q is received from the temperature increase estimating unit 16g and a function of outputting the information of the selected driving waveform to the temperature increase estimating unit 16g as a distinctive function of the fifth embodiment.

The data converting unit 13g illustrated in FIG. 53 has a function of converting the gradation data Dp into the chronological voltage data of the frame unit based on the selected driving waveform WF and a function of outputting the converted data DpWF to the data writing unit 17, similarly to the first embodiment. The data converting unit 13g further has a function of performing conversion into the data DpWF corresponding to the source line time division image update according to the value of Q when the signal req_Q is received as the distinctive function of the sixth embodiment. Specifically, in conversion of a certain frame based on the driving waveform WF, conversion into data designating an output voltage of WF according to Dp is performed on the pixels in 1/Q of columns of an image in which a voltage corresponding to the gradation data Dp is written, conversion into data designating an output of 0 V is performed on the pixels in the remaining columns, and conversion of a next frame WF is performed after a column of pixels in which a voltage is written sequentially proceeds by Q columns. Thus, the data amount of the data DpWF corresponding to the source line time division image update is Q times that of the normal image update (Q=1). The converted data DpWF corresponding to the source line time division image update is also output to the data writing unit 17 and stored in the memory 160 through the data writing unit 17. Thus, in the example of FIG. 53, the data DpWF corresponding to the source line time division image update is overwritten in the memory 160. Since the same gradation data Dp is converted by the data converting unit 13g even in the source line time division image update, the data converting unit 13g may has a function of reading Dp from the memory.

Figure 55:
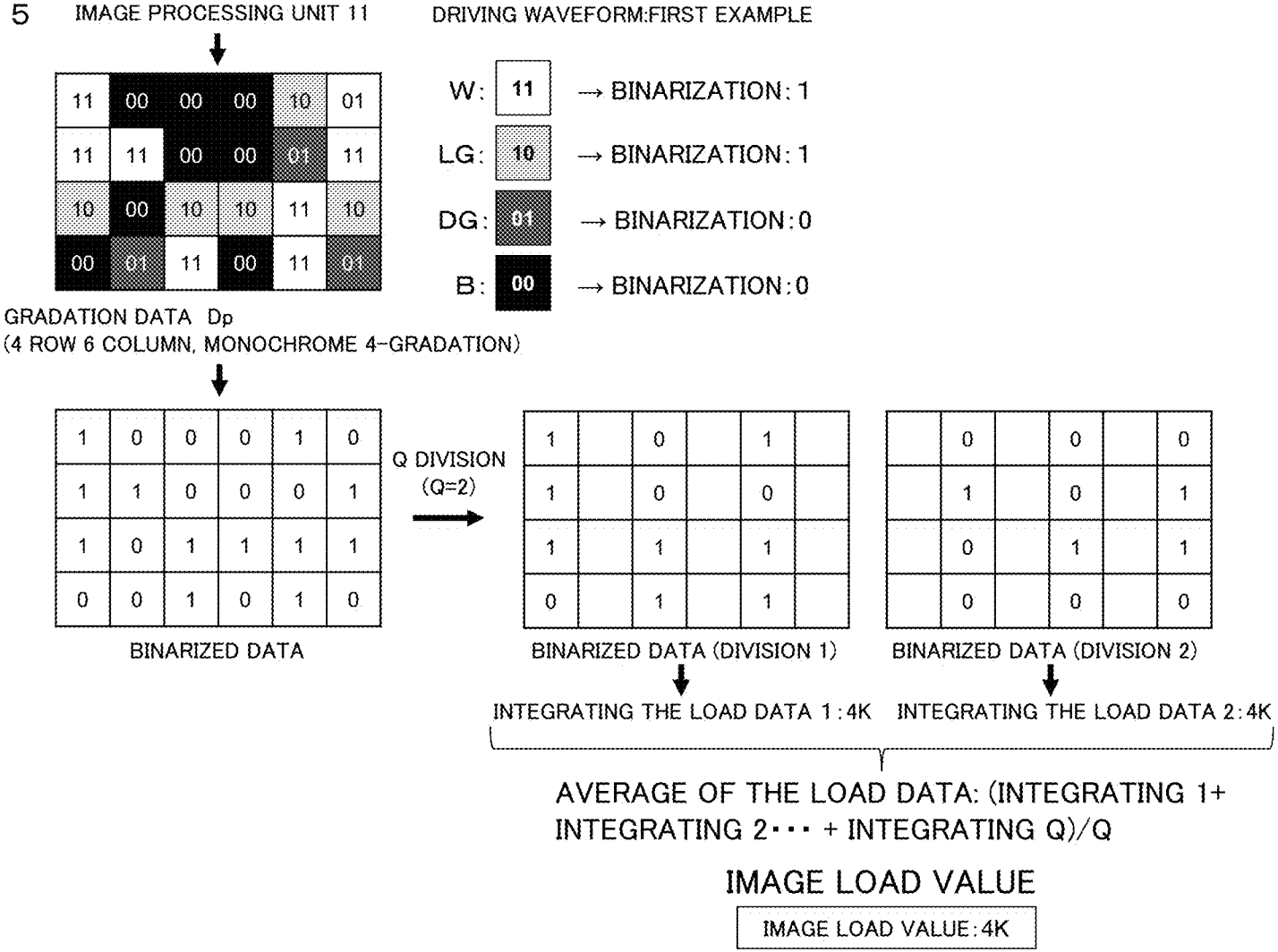
FIG. 55 is an explanatory diagram illustrating a specific example of a process of calculating an image load value in an image load value calculating unit illustrated in FIG. 54.

The image load value calculating unit 12g illustrated in FIG. 53 has a function of calculating the image load value based on the gradation data Dp and outputting the calculated value to the temperature increase estimating unit 16g, similarly to the first embodiment. The image load value calculating unit 12g further has a function of calculating the image load value based on the gradation data Dp in the source line time division image update according to the value of Q and outputting the calculated value to the temperature increase estimating unit 16g when the request signal req_Q is received from the temperature increase estimating unit 16g as a distinctive function of the fifth embodiment. For example, the image load value may be calculated based on the calculation method described above in the first embodiment by replacing the binary data into time division data. FIG. 55 illustrates a calculation example of the image load value in the source line time division image update.

In FIG. 55, similarly to FIG. 12 used for the description of the first embodiment, the first example of the driving waveform illustrated in FIG. 9 is used. Similarly to FIG. 12, the display panel 70 with the memory function is configured with 4×6 pixels, and performs the monochrome 4-gradation display, and the display image example, that is, the pattern of the gradation data Dp is the same as those of FIG. 12 as illustrated in FIG. 55 FIG. 12. Thus, the gradation value of the gradation data Dp and the binary data converted according to the driving waveform are the same as those of FIG. 12 as well. In the calculation of the image load value in the source line time division image update, the binary data is divided into Q as illustrated in FIG. 55 (divided into two in FIG. 55), and integration of the load data of the respective divided binary data, that is, integration of the load data of the binary data (division 1), the binary data (division 2) in the example of FIG. 55 is performed. As described above with reference to FIG. 12 in the first embodiment, in the calculation of the load data from the binary data, neighboring data in the horizontal direction is compared, and J is obtained when the neighboring data is different, whereas neighboring data in the vertical direction is compared, and K is obtained when the neighboring data is different. In the method of the first embodiment, in the specific example of FIG. 13, the load data in which there is a voltage difference of 30 V between +V=15 [V] and −V=−15 [V] is extracted based on the relation in which different voltages are applied when the binary data is different. However, in the source line time division image update, since 0 V is applied to the pixels in the column to which the voltage according to the image data is output and the neighboring pixel in the horizontal direction, there is no voltage difference of 30 V. In this regard, as illustrated in FIG. 55, in the integration of the load data of the respective divided binary data, all the comparison results in the horizontal direction can be set to 0 as an example. Thus, as illustrated in FIG. 55, load data integration 1 of the binary data (division 1) becomes 4K, and load data integration 2 of the binary data (division 2) becomes 4K. A value obtained by adding and averaging the load data integrated values is preferably used as the image load value. In the example of FIG. 55, the image load value at the time of source line time division image update (Q=2) is 4K. As described above in the fifth embodiment, for the coefficients J and K, the coefficients used for the calculation of the image load value for individual cases may be decided by measurement in advance and stored, for example, such that the coefficients used when the source line time division image update is not performed (Q=1) are stored as J1 and K1, the coefficients used when the source line time division image update is performed (Q=2) are stored as J2 and K2, and the coefficients used when the source line time division image update is performed (Q=3) are stored as J3 and K3, and the coefficients may be used in the individual cases.

The configuration of the sixth embodiment has been described above focusing on the distinctive function of the sixth embodiment, but the remaining configuration is the same as in the first embodiment, and thus a description thereof is omitted.

Figure 56:
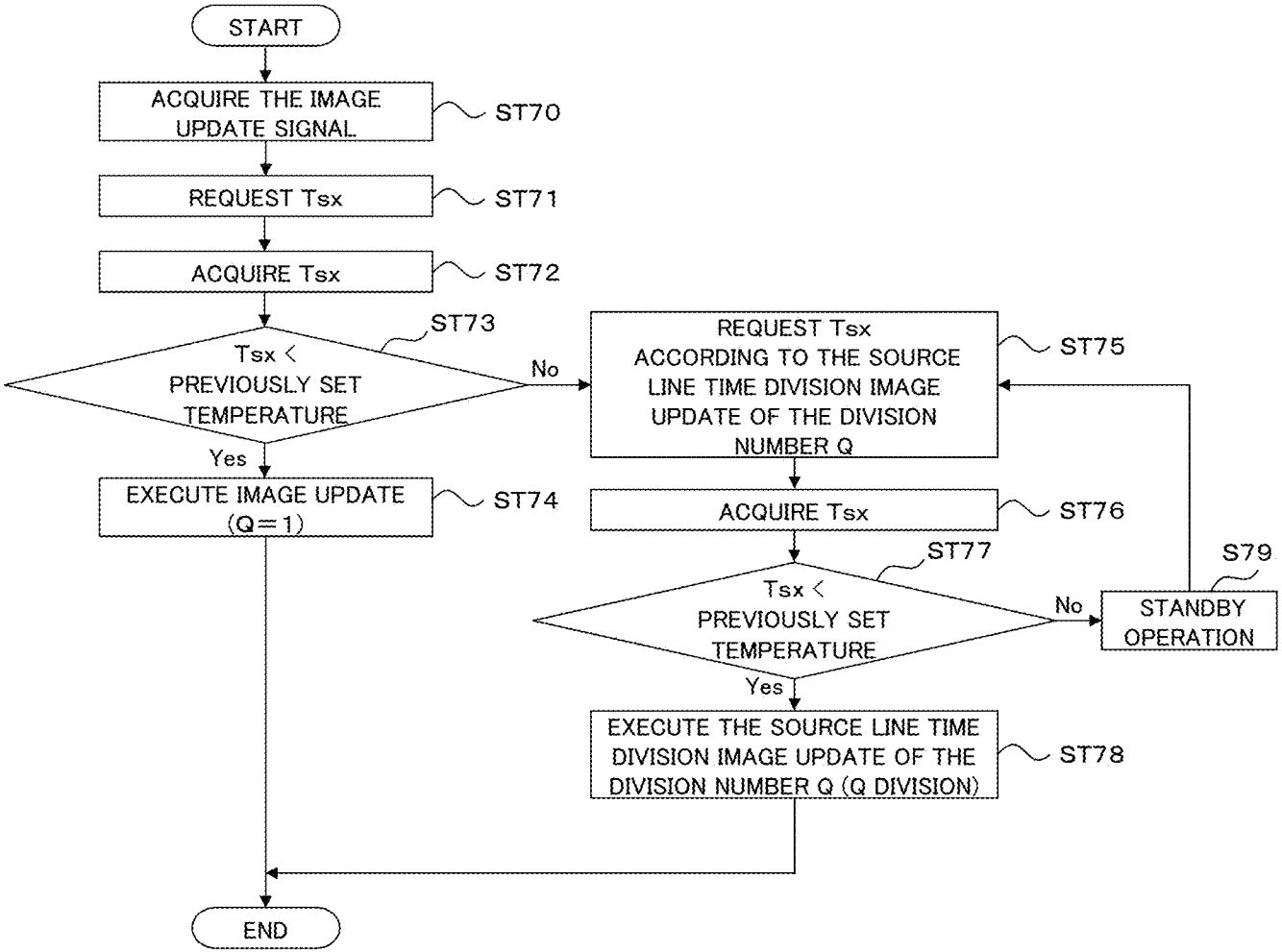
FIG. 56 is a flowchart for describing an operation of an image display control unit.

An operation of the display panel controller 80g illustrated in FIG. 52 will be described with reference to FIGS. 52, 53, 54, and 56. FIG. 56 is a flowchart for describing an operation of the image display control unit 20g.

As illustrated in FIG. 56, the image update determining unit 21g (see FIG. 54) acquires the image update signal 3 to instruct the image update from the application processor 1 (step ST70). the image update determining unit 21g request the temperature predicting unit 10g to transmit the source driver temperature Tsx after the image update through the request signal req (step ST71). Upon receiving the request, the temperature predicting unit 10g (see FIG. 52) acquires the current source driver temperature Ts in the temperature increase estimating unit 16g (see FIG. 53), calculates the source driver temperature Tsx after the image update based on the image load value and the selected driving waveform, and transmits the source driver temperature Tsx after the image update to the image display control unit 20g (see FIG. 54). The transmitted temperature Tsx is acquired by the image update determining unit 21g (step ST72). Then, the image update determining unit 21g determines whether or not the acquired temperature Tsx is lower than a previously set temperature (step ST73). When the determination result of step ST73 is YES, the signal to instruct the operation is output from the image update determining unit 21*g* to the panel control signal generating unit 22 (see FIG. 54), the signal and the voltage (ct1 and ct2) for controlling the source driver and the gate driver are output according to this signal, the data reading unit 23 (see FIG. 54) reads data forming an image from the memory 160 in synchronization with the control signal, and Da is output according to the specification of the source driver 150. At this time, since the data stored in the memory 160 is DpWF that does not corresponds to the source line time division image update, the normal image update (Q=1) is performed (step ST74). When the determination result of step ST73 is NO, the image update determining unit 21*g* requests the temperature predicting unit 10*g* to transmit the source driver temperature Tsx after the source line time division image update of the division number Q through the request signal req (step ST75). Upon receiving this request, the temperature increase estimating unit 16*g* (see FIG. 53) of the temperature predicting unit 10*g* transmits the request signal req_Q including the division number Q to the driving waveform selecting unit 15*g*, the data converting unit 13*g*, and the image load value calculating unit 12*g*. The driving waveform selecting unit 15*g* and the data converting unit 13*g* that have received the signal req_Q generate DpWF corresponding to the source line time division image update of the division number Q, and the data writing unit 17 stores DpWF in the memory 160. The image load value calculating unit 12*g* that has received the signal req_Q calculates the image load value corresponding to the source line time division image update of the division number Q, and inputs the calculated image load value to the temperature increase estimating unit 16*g*. Thereafter, the temperature increase estimating unit 16*g* acquires the current source driver temperature Ts, calculates the source driver temperature Tsx after the source line time division image update of the division number Q based on the input image load value at the time of source line time division image update of the division number Q and the information of the driving waveform input from the driving waveform selecting unit 15*g*, and transmits the calculated source driver temperature Tsx after the source line time division image update of the division number Q to the image display control unit 20*g*. The transmitted temperature Tsx is acquired by the image update determining unit 21*g* (step ST76). Then, the image update determining unit 21*g* determines whether or not the acquired source driver temperature Tsx after the source line time division image update of the division number Q is lower than a previously set temperature (step ST77). When the determination result of step ST77 is YES, the signal to instruct the operation is output from the image update determining unit 21*g* to the panel control signal generating unit 22, the signal and the voltage (ct1 and ct2) for controlling the source driver and the gate driver are output according to this signal, the data reading unit 23 reads data forming an image from the memory 160 in synchronization with the control signal, and Da is output according to the specification of the source driver 150. At this time, since the data stored in the memory 160 is DpWF corresponding to the source line time division image update of the division number Q, the source line time division image update of the division number Q is performed (step ST78). When the determination result of step ST77 is NO, a standby operation is performed during a predetermined period of time without performing the image update (step ST79). After the standby operation, the image update determining unit 21*g* requests the temperature predicting unit 10*g* to transmit the source driver temperature Tsx after the image update according to the second driving waveform again (step ST75).

Figure 57:
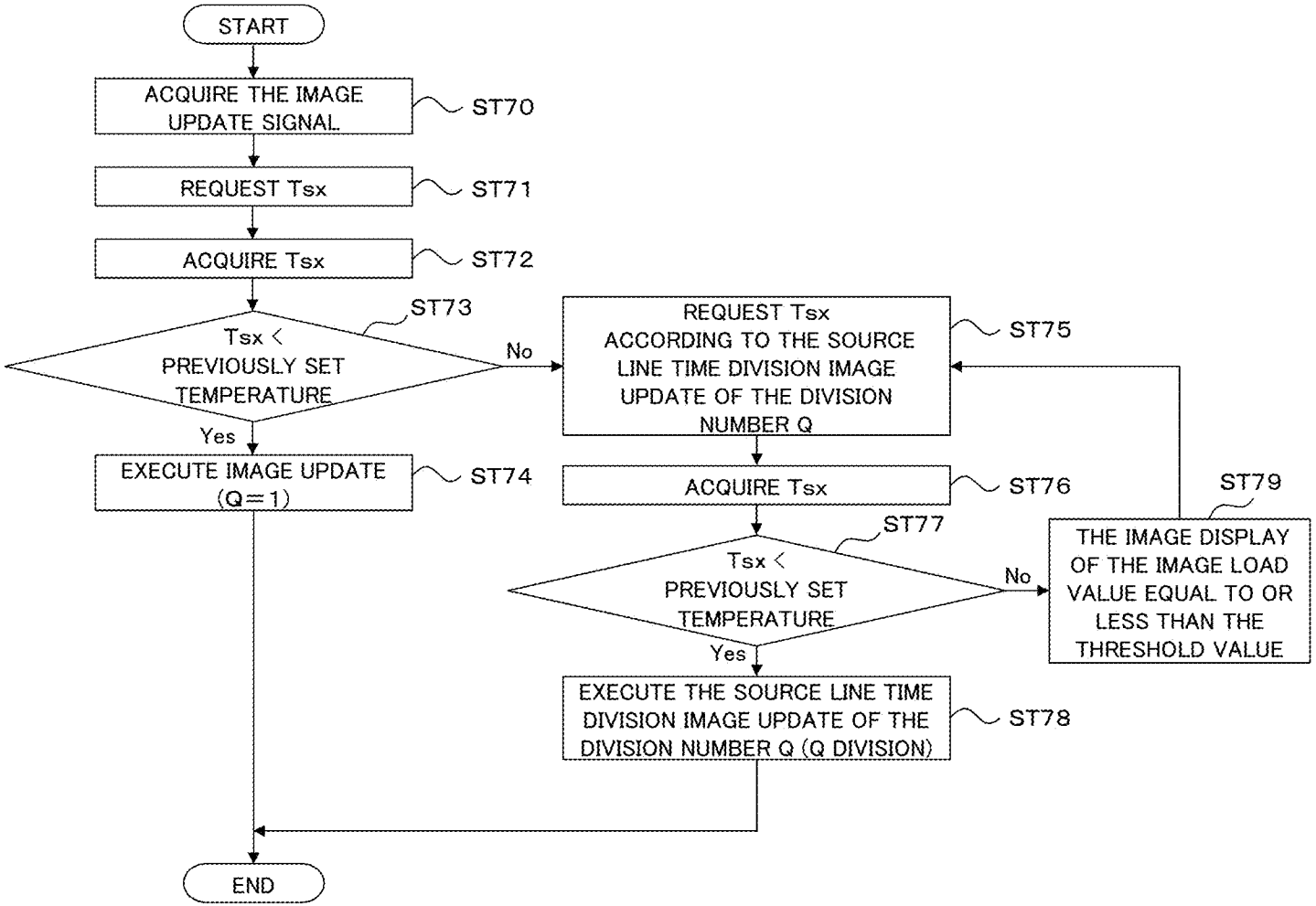
FIG. 57 is a flowchart for describing an operation of an image display control unit.
Figure 58:
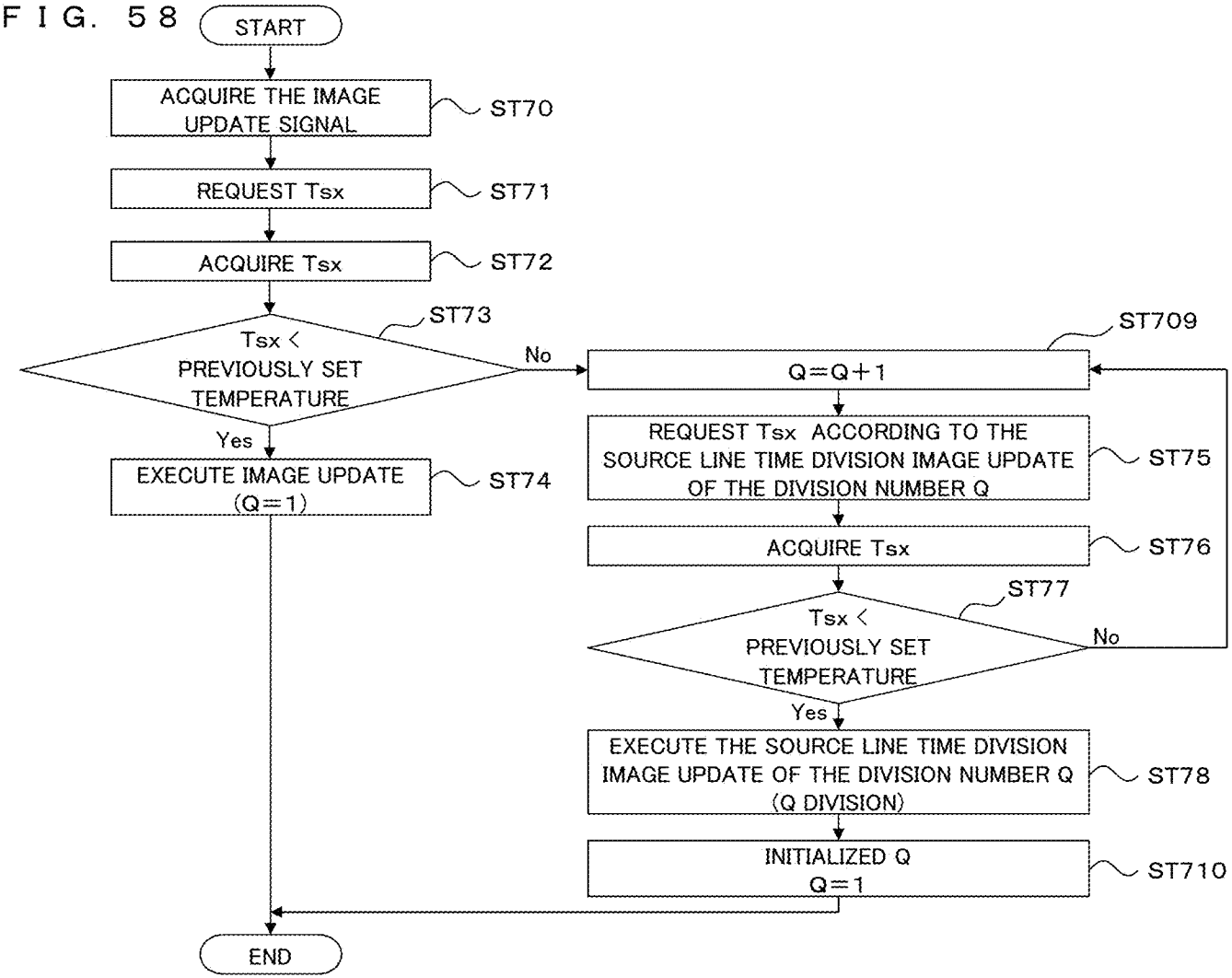
FIG. 58 is a flowchart for describing an operation of an image display control unit.

The operation of the image display control unit 20*g* in the first exemplary configuration of the sixth embodiment has been described with reference to the flowchart of FIG. 56, but it is an example of the operation, and the present invention is not limited to FIG. 56. For example, the same concept as that of the modified example of the first embodiment may be applied, and when the determination result of step ST77 is NO, the image display of the image load value equal to or less than the threshold value may be performed. Further, when the determination result of step ST77 is NO, similarly to the modified example of the first embodiment, the image display of the smallest image load value among the image load values equal to or less than the threshold value may be performed. FIG. 57 is a flowchart when the image display of the image load value equal to or less than the threshold value is performed. In FIG. 56 and FIG. 57, after the standby operation is performed during a predetermined period of time or after the image display of the image load value equal to or less than the threshold value is performed (step ST79), the temperature predicting unit 10*g* is requested to transmit the source driver temperature Tsx after the source line time division image update of Q division again (step ST75), but the transmission of the source driver temperature Tsx after the normal image update (Q=1) may be requested. In this case, after step ST79, the process preferably proceeds to step ST71. Further, when the temperature Tsx after the source line time division image update of the division number Q is equal to or higher than the set temperature, the division number Q may be changed. An example of the operation in this case is illustrated in a flowchart of FIG. 58. In FIG. 58, the same processes as in FIGS. 56 and 57 are indicated by the same steps, and thus a description thereof is omitted. As illustrated in FIG. 58, when the determination result of step ST73 is NO, the image update determining unit 21*g* changes Q from 1 to 2. In other words, the process of adding 1 to the current value of Q is performed (step ST709). Thereafter, the image update determining unit 21*g* requests the temperature predicting unit 10*g* to transmit the source driver temperature Tsx after the source line time division image update of the division number Q through the request signal req (step ST75). When the determination result of step ST77 is YES, the source line time division image update of the division number Q is executed (step ST78), and the value of Q after execution is initialized to an initial value, that is, 1 (ST710). When the determination result of step ST77 is NO, the process proceeds to step ST709, and 1 is added to the current value of Q. As the division number Q increases, the image update period of time increases, and the increase in the source driver temperature according to the source line time division image update decreases, and thus when the value of Q increases until the condition that the temperature Tsx falls below the set temperature is satisfied, the source line time division image update is executed.

As described above, by configuring and operating the display device with the memory function, similarly to the first embodiment, it is possible to maintain the temperature of the source driver 150 to be equal to or less than the set temperature without deteriorating the display image quality. Thus, by setting an appropriate temperature based on the specification of the source driver as the set temperature, it is possible to prevent the image quality deterioration, the performance degradation of the source driver, and the breakdown of the source driver which are caused by the operation failure occurring when the operation guarantee temperature of the source driver is exceeded, it is possible to implement the reliable high-quality display device with the memory function. Further, the period of time until the image update is completed is long, but since the source line time division image update can be performed, it is possible to prevent the user's confusion when the display screen does not react immediately.

Figure 59:
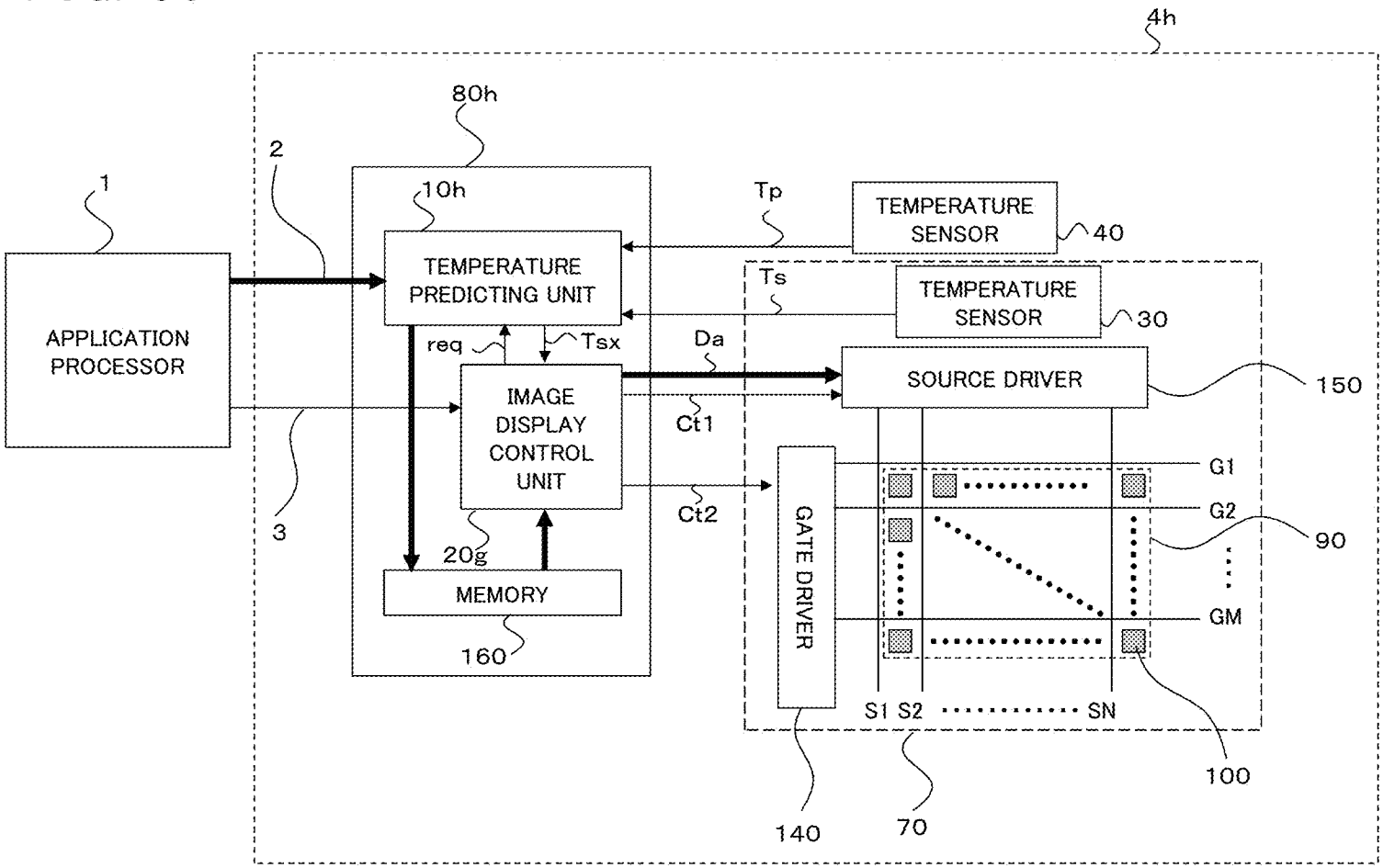
FIG. 59 is a block diagram for describing a configuration of a display device with a memory function according to the sixth embodiment.

Next, the distinctive function of the sixth embodiment will be described in connection with a second exemplary configuration applied to the second embodiment. FIG. 59 is a block diagram for describing the second exemplary configuration of the sixth embodiment. As described above, the first embodiment and the second embodiment are in the relation in which the calculation of the image load value is different, and a relation between the first exemplary configuration (FIG. 52) and the second exemplary configuration (FIG. 59) of the sixth embodiment is the same as well. Thus, the second exemplary configuration illustrated in FIG. 59 differs from that of the first exemplary configuration of FIG. 52 only in a temperature predicting unit 10*h*, but the remaining components are the same, and thus a description thereof is omitted.

Figure 60:
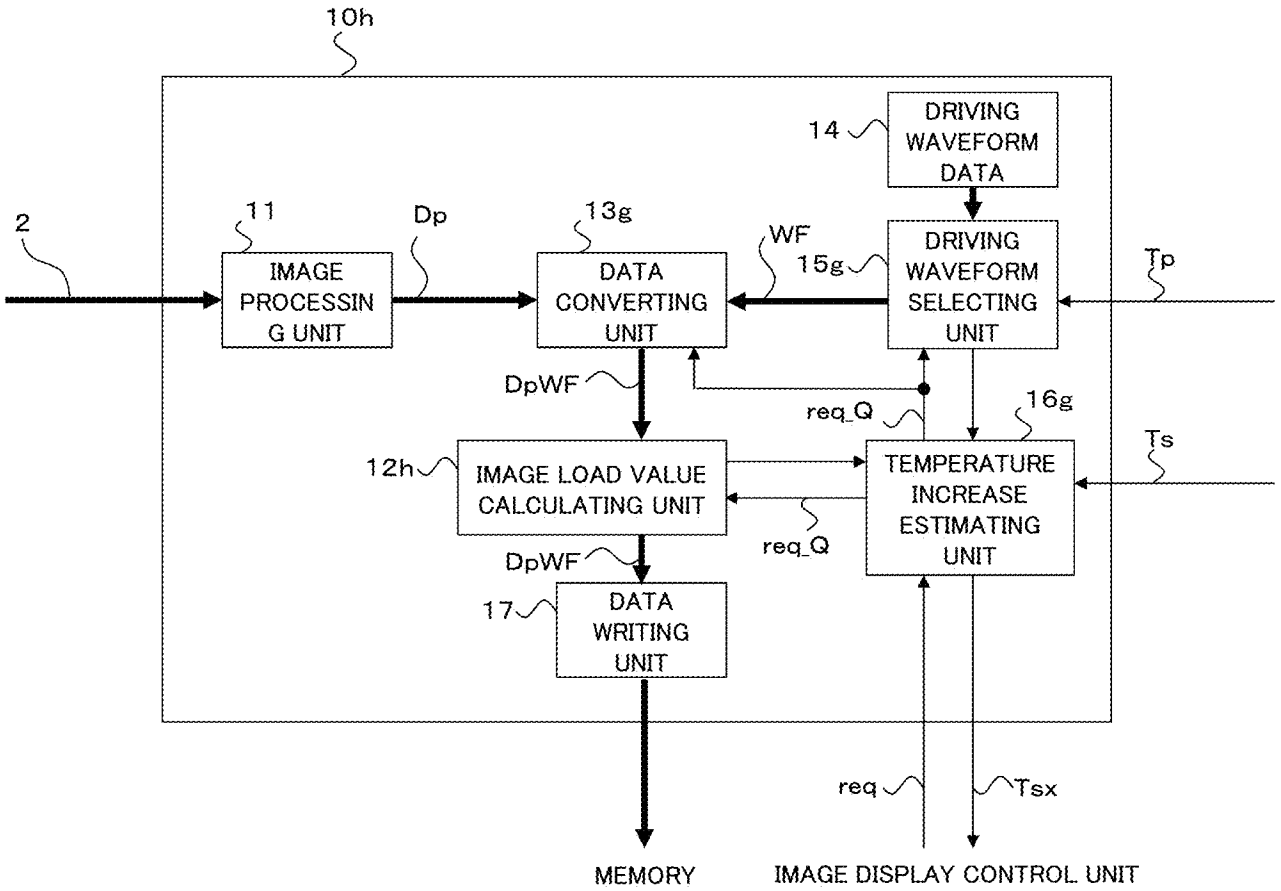
FIG. 60 is a block diagram of an image display control unit according to the sixth embodiment.

FIG. 60 is a block diagram of the temperature predicting unit 10*h* according to the second exemplary configuration of the sixth embodiment. As illustrated in FIG. 60, an image processing unit 11, a data converting unit 13*g*, a driving waveform data 14, a driving waveform selecting unit 15*g*, a temperature increase estimating unit 16*g*, and a data writing unit 17 configuring the temperature predicting unit 10*h* have the same functions as in the temperature predicting unit 10*g* (FIG. 53) of the first exemplary configuration, and thus a description thereof is omitted. The image load value calculating unit 12*h* illustrated in FIG. 60 has function of calculating the image load value PLV based on the voltage map in each frame of input DpWF using Formulas (5) and (6) and outputting the calculated value to the temperature increase estimating unit 16*g*, similarly to the second embodiment. The image load value calculating unit 12*h* further has function of calculating the image load value PLV based on the voltage map in each frame of DpWF using Formulas (5) and (6) and outputting the calculated value to the temperature increase estimating unit 16*g* when the request signal req_Q is received from the temperature increase estimating unit 16*g*, and DpWF converted into data corresponding to the source line time division image update according to the value of Q in the data converting unit 13*g* is input as a distinctive function of the fifth embodiment. For the coefficients J and K used in Formula (5), the coefficients according to the value of Q may be decided by measurement in advance and stored and may be used in individual cases. Further, a value obtained by dividing the image load value PLV calculated by Formula (6) by the number L of frames, that is, a value obtained by temporal averaging may be used as the image load value.

The remaining configuration of the second exemplary configuration of the sixth embodiment is the same as that of the first exemplary configuration of the sixth embodiment. An operation according to the second exemplary configuration of the sixth embodiment differs from that of the first exemplary configuration only in the calculation method of the image load value, and an operation of the image display control unit 20*g* in a display panel controller 80*h* is the same as in the first exemplary configuration, and thus the operation of the second exemplary configuration of the sixth embodiment is the same as the operations of the first exemplary configuration thereof (FIG. 56, FIG. 57, and FIG. 58).

The distinctive functions of the sixth embodiment can be applied to the third embodiment using the display panel equipped with the i source drivers. The components of the first exemplary configuration of the sixth embodiment or the second exemplary configuration of the sixth embodiment may be appropriately combined according to the concept of the configuration and operation described in the third embodiment. The distinctive functions of the sixth embodiment can be applied to the fourth embodiment using the temperature characteristics data of the source driver and the timer instead of the temperature sensor that obtains the temperature Ts of the source driver 150. The components of the first exemplary configuration of the sixth embodiment or the second exemplary configuration of the sixth embodiment may be appropriately combined according to the concept of the configuration and operation described in the fourth embodiment.

In the description of the sixth embodiment, the configuration in which the temperature predicting unit generates DpWF corresponding to the source line time division image update of the division number Q, and stores the source line time division image update of the division number Q in the memory has been described as the configuration of executing the source line time division image update of the division number Q, but it is for convenience of description, and the present invention is not limited to this configuration. For example, the data reading unit may have a function of using only data of Q=1 as DpWF to be stored in the memory and controlling the source lines to which the voltage according to the image data is output and the source lines to which 0 V is output according to the value of the division number Q. In the case of this configuration, it is possible to reduce the capacity of the memory that stores DpWF.

Seventh Embodiment

Next, a display device with a memory function according to a seventh embodiment of the present invention will be described. It is an object of the present invention to provide a high-quality high-reliable display device with a memory function and a driving method thereof, which are capable of preventing a display trouble caused by an operation failure occurring when the temperature of the source driver is high, performance degradation of the source driver, and a breakdown of the source driver by estimating the source driver temperature after the image update and appropriately setting the image update interval according to the estimated temperature. In order to achieve the object, in the first to sixth embodiments, the image load value of the image data to be displayed next is calculated, the source driver temperature Tsx is estimated from the calculated value, and the image update is performed when the estimated temperature Tsx is lower than the set temperature. Further, the fifth and sixth embodiments, the function of calculating the image load value of the image data to be displayed next using another driving waveform that increases the image update period of time but is able to suppress the increase in the temperature after the image update when the temperature Tsx is equal to or higher than the set temperature, estimating the source driver temperature Tsx again, and performing the image update using another driving waveform when the temperature Tsx is lower than the set temperature is added. When the driver temperature after the image update has a plurality of driving waveforms as described above, the object of the present invention can be achieved by estimating the temperature Tsx using the largest image load value as the image load value of the image data to be displayed next regardless of content of image data, and executing the image update according to the driving waveform in which the temperature Tsx is equal to or lower than the set temperature. In this case, the function of calculating the image load value according to the input image data can be omitted, the configuration can be simplified. A configuration and operation according to the seventh embodiment will be described below.

Figure 61:
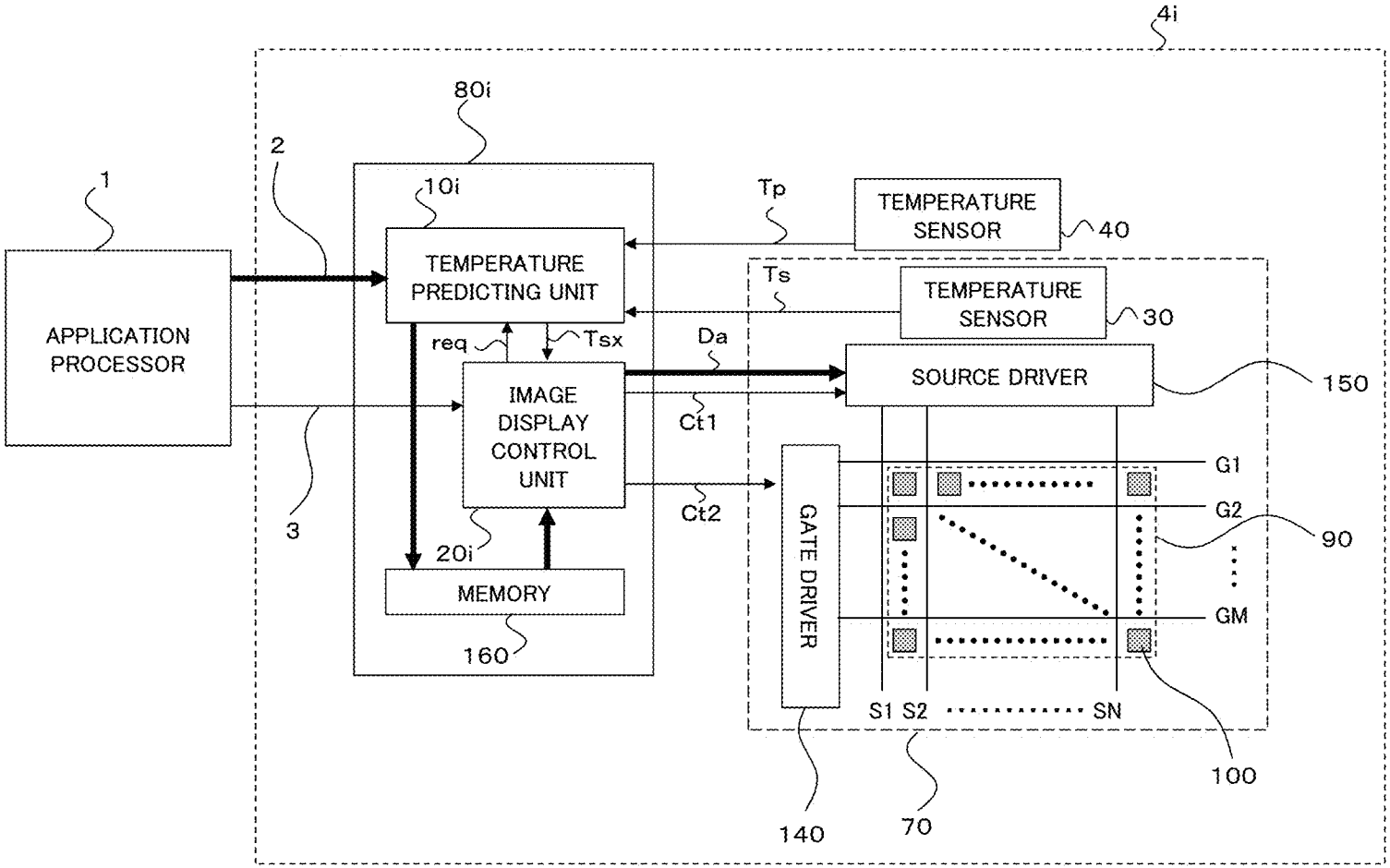
FIG. 61 is a block diagram for describing a configuration of a display device with a memory function according to a seventh embodiment.
Figure 62:
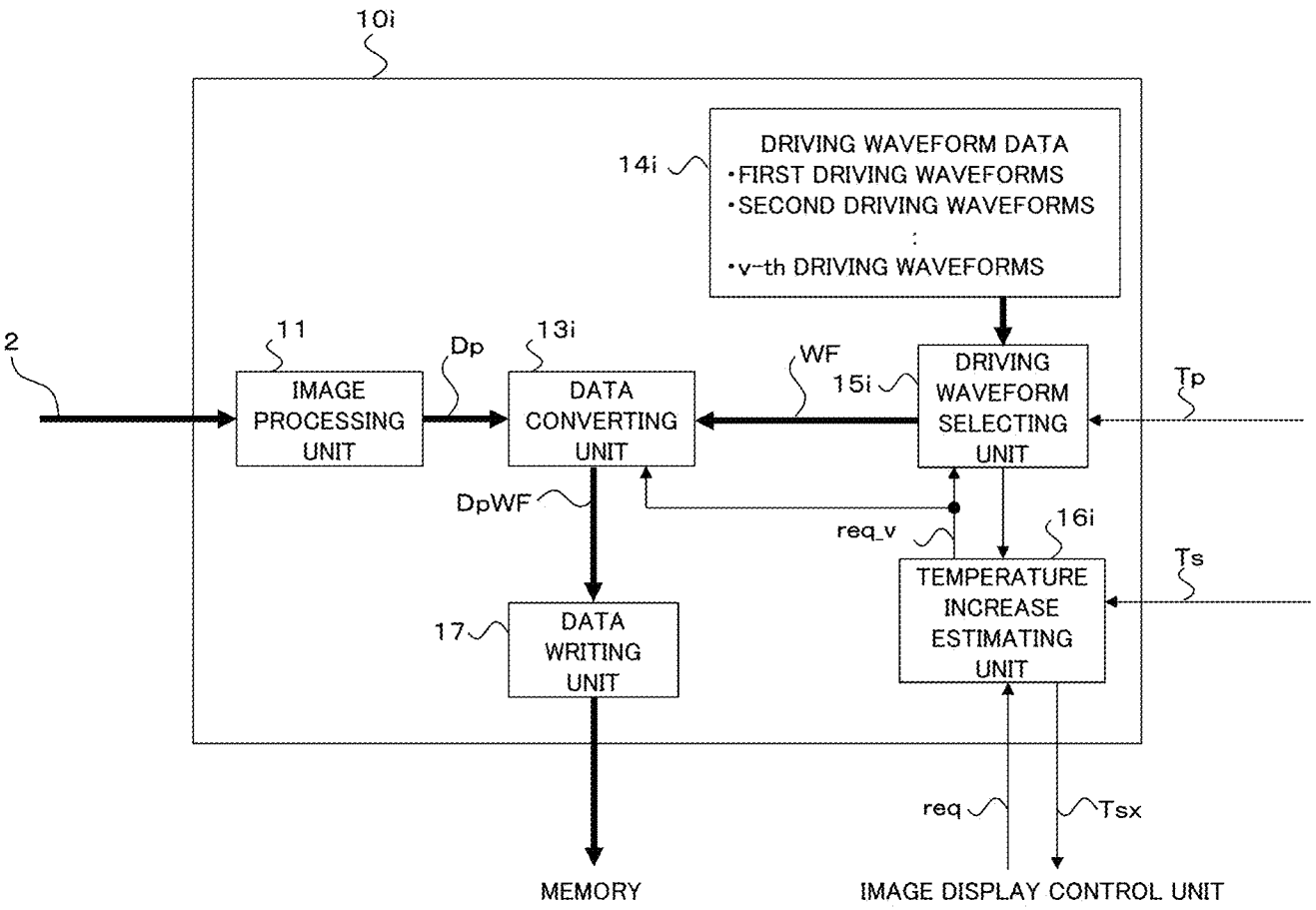
FIG. 62 is a block diagram of an image display control unit according to the seventh embodiment.

FIG. 61 is a block diagram for describing a configuration according to the seventh embodiment. As illustrated in FIG. 61, the seventh embodiment differs from the first and second embodiments in a display panel controller 80*i*, but the remaining components are the same, and thus a description thereof is omitted. FIG. 62 is a block diagram for describing a configuration of a temperature predicting unit 10*i* included in the display panel controller 80*i* according to the seventh embodiment. As illustrated in FIG. 62, the temperature predicting unit 10*i* includes an image processing unit 11, a data converting unit 13*i*, driving waveform data 14*i*, a driving waveform selecting unit 15*i*, a temperature increase estimating unit 16*i*, and a data writing unit 17.

The image processing unit 11 and the data writing unit 17 have the same configuration as in the above-described embodiments, and thus a description thereof is omitted.

The driving waveform data (storage unit) 14*i* in illustrated in FIG. 62 has a similar concept to that of the fifth embodiment in which the second driving waveform group is used, and stores a plurality of driving waveform groups, that is, first to v-th driving waveform groups. The stored driving waveform groups are the driving waveforms that differ in the source driver temperature increase after the image update, and includes the first to v-th driving waveform groups in the descending order of the temperature increases of the source driver. In the source line time division driving, in the sixth embodiment, the division number Q is changed in the same driving waveform, but in the seventh embodiment, the driving waveforms that differ in the division number Q are dealt as the different driving waveform groups. In other words, functions of performing the source line time division driving of the division numbers 1 to Q are associated as the driving waveform groups of 1 to Q. In other words, in the driving waveform of the present embodiment, a function capable of selecting all the driving waveforms and the image update described above in the first to sixth embodiments by selecting the stored driving waveform group is provided.

The driving waveform selecting unit 15*i* in illustrated in FIG. 62 has a function of selecting the driving waveform group according to a signal req_v from the driving waveform data 14*i* according to the signal req_v input from the temperature increase estimating unit 16*i*. The driving waveform selecting unit 15*i* has a function of selecting the optimal driving waveform WF from the selected driving waveform group according to the display panel temperature Tp and outputting the selected optimal driving waveform WF to the data converting unit 13*i* and a function of outputting the information of the selected driving waveform to the temperature increase estimating unit 16*i*, similarly to the first embodiment.

The temperature increase estimating unit 16*i* in illustrated in FIG. 62 has a function of transmitting the signal req_v to the driving waveform selecting unit 15*i* and the data converting unit 13*i* according to the request signal req input from the image display control unit 20*i* and a function of estimating the source driver temperature Tsx after the image update ends in the image pattern having the largest image load value based on the information of the driving waveform transmitted from the driving waveform selecting unit 15*i* and the source driver temperature Ts according to the signal req_v and outputting the estimated source driver temperature Tsx to the image display control unit 20*i*.

As described above in the first embodiment, the temperature increase ΔT of the source driver 150 at the time of image update according to an arbitrary image pattern is obtained by Formula (3) using the image load value PLV.

In the image pattern having the largest image load value, Formula (3) is the following Formula (7).

$$\Delta T=(T\alpha-T\beta)\times PLV/PLV\max+T\beta$$

$$=T\alpha \tag{7}$$

The source driver temperature Tsx after the image update can be calculated by Formula (8) from Formula (4) and the source driver temperature Ts as follows.

$$Tsx=Ts+\Delta T$$

$$=Ts+T\alpha \tag{8}$$

As indicated by Formula (8), the source driver temperature Tsx after the image update in the image pattern having the largest image load value is decided by Ts and Tα. For Tα, as described above in the first embodiment, preferably, the source driver temperature increase when the image update is performed on the image pattern having the largest image load value is measured using the source driver temperature Ts and the display panel temperature Tp as a parameter for each driving waveform used for the image update and stored as the table data as illustrated in FIG. 17. In the seventh embodiment, data of Tβ illustrated in FIG. 17 is unnecessary, and thus, for example, Tα obtained by a result of measurement is preferably stored as table data for each driving waveform as illustrated in FIG. 67. The table data illustrated in FIG. 67 is generated and stored by the first to v-th driving waveform groups serving as a plurality of driving waveform groups according to the seventh embodiment. Alternatively, Tα may be decided using a function having Ts, Tp, and the driving waveform group as a parameter instead of the table data. This function is preferably obtained by fitting with the measurement value.

The data converting unit 13*i* in illustrated in FIG. 62 has a function of converting the gradation data Dp into the chronological voltage data of the frame unit based on the selected driving waveform WF and a function of outputting the converted data DpWF to the data writing unit 17 when the signal req_v is received. Further, when the signal req_v is received again, the gradation data Dp is converted again based on the newly selected driving waveform WF. Thus, similarly to the fifth and sixth embodiments, the data converting unit 13*i* may have a function of reading the gradation data Dp from the memory. Further, a function of supporting the source line time division image update described above in the sixth embodiment may be provided. In this case, the division number is preferably decided according to content of the signal req_v.

Next, the image display control unit 20*i* of the seventh embodiment will be described. A configuration of the image display control unit 20*i* is basically the same as those in the fifth and sixth embodiments, and thus an illustration and description thereof are omitted. For an operation, the operation of requesting the temperature Tsx according to the first driving waveform and requesting the temperature Tsx according to the second driving waveform when the temperature Tsx is higher than the set temperature, which has been described above in the fifth embodiment is extended up to an operation of requesting the temperature Tsx according to the v-th driving waveform.

Figure 63:
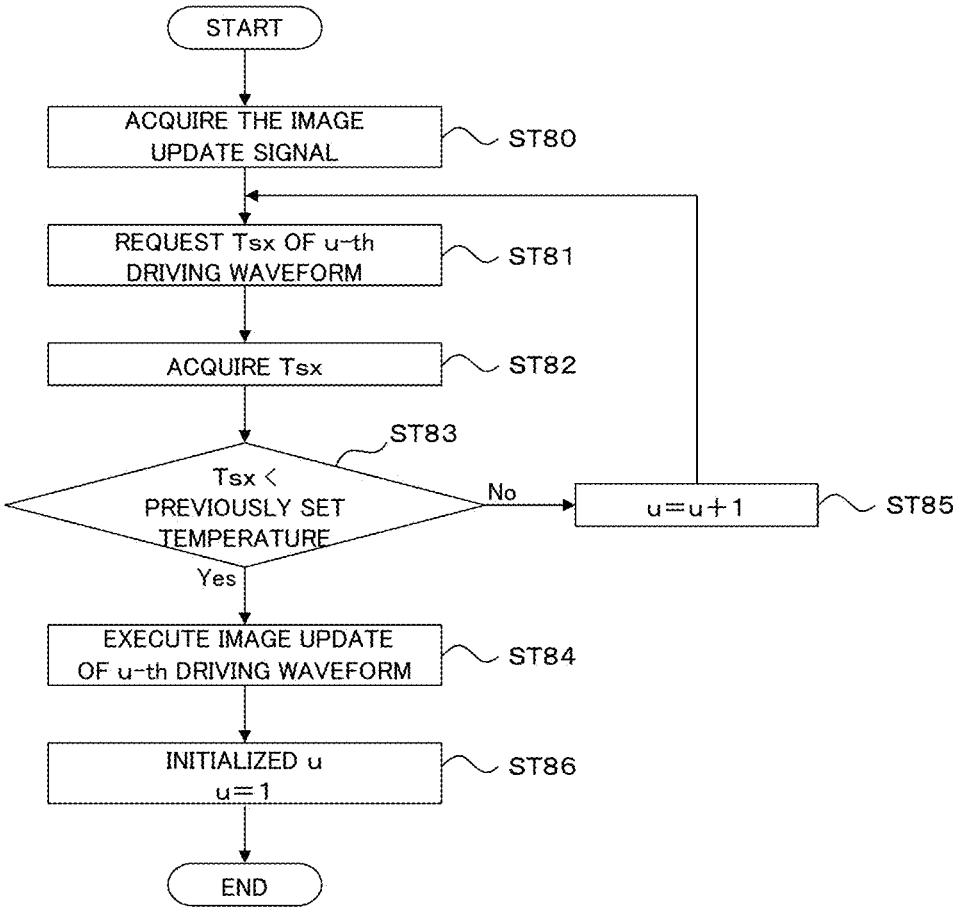
FIG. 63 is a flowchart for describing an operation of an image display control unit.

FIG. 63 is a flowchart for describing an operation of the image display control unit 20*i*. The operation of the image display control unit 20*i* will be described below with reference to FIGS. 61, 62, and 63.

As illustrated in FIG. 63, the image display control unit 20*i* (see FIG. 61) acquires the image update signal 3 to instruct the image update from the application processor 1 (step ST80). The image display control unit 20*i* requests the temperature predicting unit 10*i* to transmit the source driver temperature Tsx after the image update according to a u-th driving waveform through the request signal req (step ST81). Here, an initial value of u is assumed to be 1. Upon receiving the request, the temperature predicting unit 10*i* acquires the current source driver temperature Ts in the temperature increase estimating unit 16*i*, calculates the source driver temperature Tsx after the image update when the image load value is largest from the information of the driving waveform selected from the u-th driving waveform group, and transmits the calculated source driver temperature Tsx after the image update to the image display control unit 20*i*. The transmitted temperature Tsx is acquired by the image display control unit 20*i* (step ST82). Then, the image display control unit 20*i* determines whether or not the acquired temperature Tsx is lower than a previously set temperature (step ST83). When the determination result of step ST83 is NO, the image display control unit 20*i* adds 1 to the value of u in order to request the source driver temperature Tsx after the image update according to another driving waveform (step ST85). After step ST85, the process proceeds to step ST81, the source driver temperature Tsx after the image update according to the different driving waveform from the previous one is requested. When the determination result of step ST83 is YES, the image display control unit 20*i* performs the image update according to the u-th driving waveform (step ST84). Thereafter, u is initialized to 1 (step ST86).

The operation of the image display control unit 20*i* according to the seventh embodiment has been described above with reference to the flowchart of FIG. 63, but it is an example indicating the concept of the operation, and the present invention is not limited to FIG. 63. For example, when the image update is not performed although the value of u is continuously added, and thus the number v of driving waveform groups included in the driving waveform data 14*i* ends up to be equal to the value of u, the process of performing a standby operation during a predetermined period of time may be added as described above in the above-described embodiments.

As described above, the display device with the memory function according to the seventh embodiment can maintain the temperature of the source driver 150 to be equal to or less than the set temperature without deteriorating the display image quality, similarly to the first embodiment Thus, by setting an appropriate temperature based on the specification of the source driver as the set temperature, it is possible to prevent the image quality deterioration, the performance degradation of the source driver, and the breakdown of the source driver which are caused by the operation failure occurring when the operation guarantee temperature of the source driver is exceeded, it is possible to implement the reliable high-quality display device with the memory function. Further, the period of time until the image update is completed is long, but since the image update according to another driving waveform can be performed, it is possible to prevent the user's confusion when the display screen does not react immediately. Further, since the image load value calculating unit is unnecessary compared with the other embodiments, the configuration can be simplified.

Figure 64:
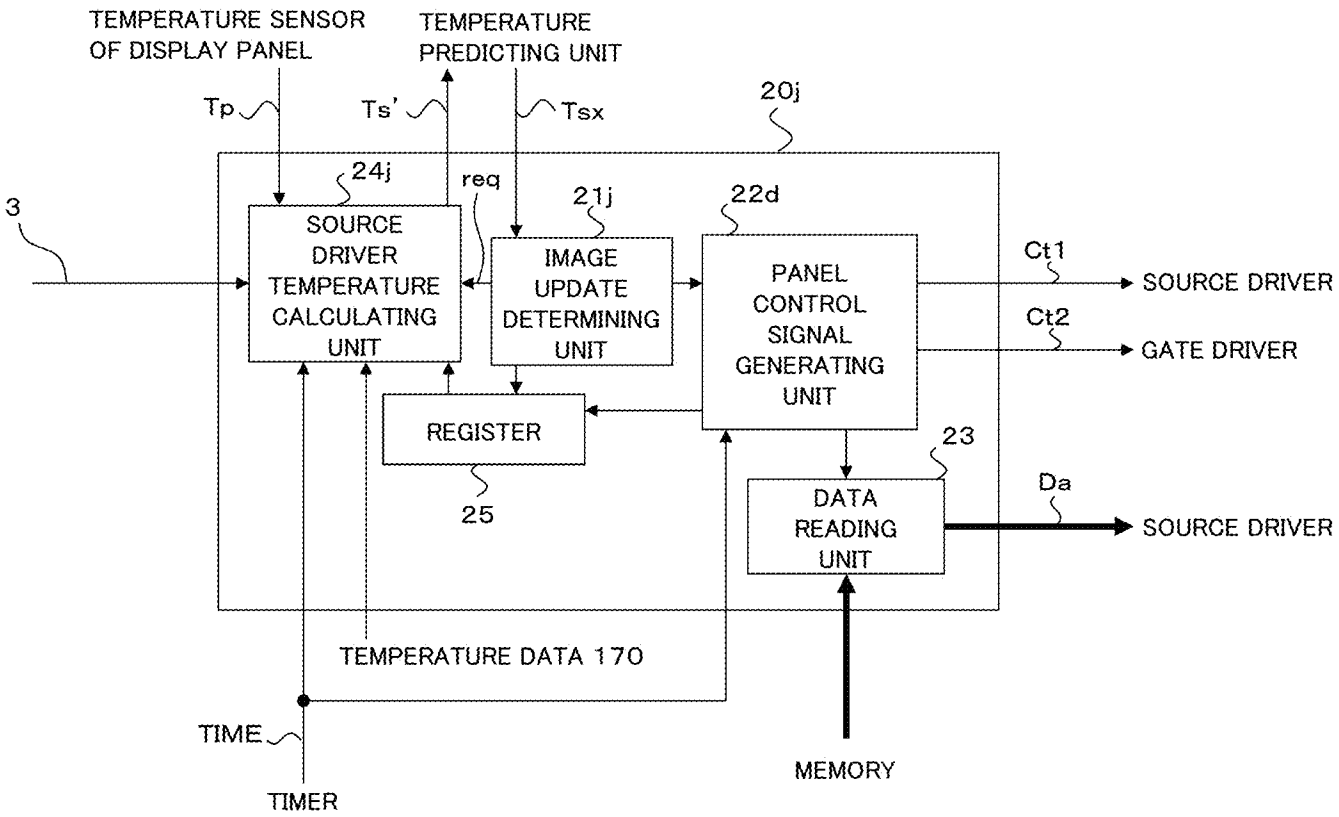
FIG. 64 is a block diagram of an image display control unit according to the seventh embodiment.
Figure 65:
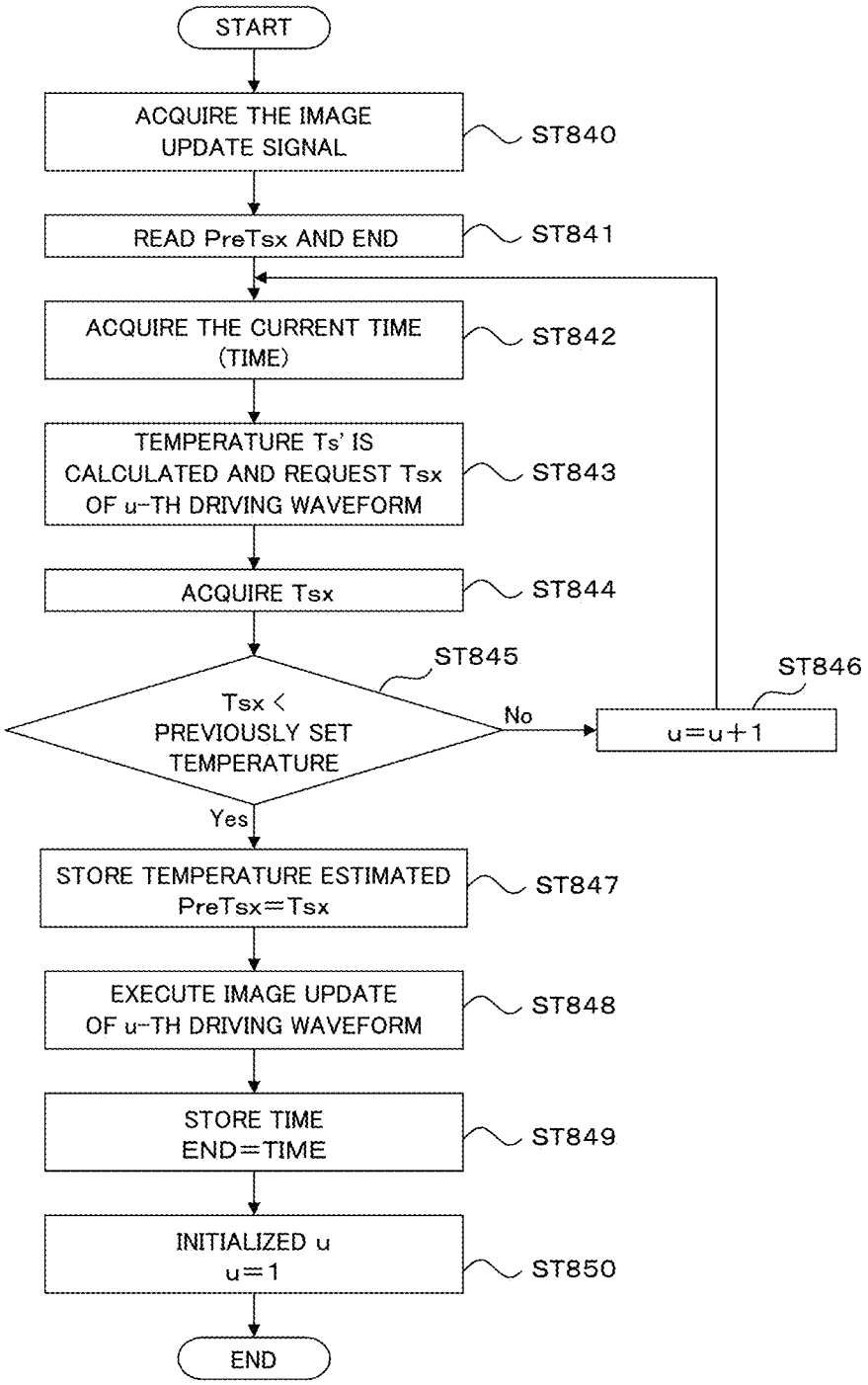
FIG. 65 is a flowchart for describing an operation of an image display control unit.

The seventh embodiment can be applied to the third embodiment using the display panel equipped with the i source drivers. The components of the seventh embodiment may be appropriately combined according to the concept of the configuration and operation described in the third embodiment. The seventh embodiment can be applied to the fourth embodiment using the temperature characteristics data of the source driver and the timer instead of the temperature sensor that obtains the temperature Ts of the source driver 150. In this case, the configuration of the display device with the memory function can be described using the block diagram of FIG. 32 described above in the fourth embodiment, and it is desirable to modify the temperature predicting unit 10*d* included in the display panel controller 80*d* and the image display control unit 20*d* to have the distinctive functions of the seventh embodiment. In other words, in this case, in the temperature predicting unit, as illustrated in FIG. 62, a plurality of driving waveform groups are stored in the driving waveform data 14*i*, the temperature increase estimating unit has a function of estimating the source driver temperature Tsx after the image update for the largest image load value from the information of the driving waveform, and the image load value calculating unit is not arranged. A different point from FIG. 62 lies in that Ts' is input from the image display control unit as the source driver temperature Ts as described above in the fourth embodiment. A configuration of the image display control unit when the seventh embodiment is applied to the fourth embodiment can be described by the same block diagram as FIG. 34, but since a different function and operation are included, an image display control unit 20*j* is illustrated in FIG. 64. FIG. 65 is a flowchart for describing an operation of the image display control unit 20*j*.

The operation of the image display control unit 20*j* when the seventh embodiment is applied to the fourth embodiment will be described with reference to FIGS. 64 and 65.

The source driver temperature calculating unit 24*j* acquires the image update signal 3 from the application processor 1 (step ST840). The temperature PreTsx (the source driver temperature after the previous image update) and the time END (an end time of the previous image update) are read from the register 25 (step ST841).

Subsequently to step ST841 (or upon receiving the signal req), the source driver temperature calculating unit 24*j* acquires the current time TIME from the timer 180 (step ST842).

Then, the display panel temperature Tp input to the source driver temperature calculating unit 24*j* is used as the ambient temperature, and the current source driver temperature Ts' is calculated based on the temperature PreTsx and the elapsed time acquired by the time END and the time TIME using the temperature data 170. The calculated temperature Ts' is transmitted to the temperature predicting unit. Further, the temperature Tsx of the u-th driving waveform is requested through this transmission (step ST843). At the time of an initial operation (there is no previous image update), the temperature Tp is included as the temperature Ts', and u is 1.

Upon receiving the request for the temperature Ts' and the temperature Tsx of the u-th driving waveform, similarly to when the temperature predicting unit 10*i* illustrated in FIG. 62 receives the signal req, the temperature increase estimating unit of the temperature predicting unit regards the received temperature Ts' as the source driver temperature Ts, calculates the source driver temperature Tsx after the image update for the largest image load value based on the information of the driving waveform selected from the u-th driving waveform group, and transmits the calculated source driver temperature Tsx after the image update to the image display control unit 20*j*. The transmitted temperature Tsx is acquired by the image update determining unit 21*j* (step ST844).

The image update determining unit 21*j* determines whether or not the acquired temperature Tsx is lower than a previously set temperature (step ST845).

When the determination result of step ST845 is NO, the image update determining unit 21*j* adds 1 to the value of u without transmitting the signal to instruct the image update to the panel control signal generating unit 22*d* (step ST846). Thereafter, the process returns to step ST842. The image update determining unit 21*j* repeats the process of ST842 to 846 until the determination result of step ST845 is YES.

When the determination result of step ST845 is YES, the image update determining unit 21*j* stores the temperature Tsx used for the determination in the register 25 as the temperature PreTsx (step ST847). Subsequently to step ST847, the signal to instruct the image update is output from the image update determining unit 21*j* to the panel control signal generating unit 22*d*, and the image update according to the u-th driving waveform is performed according to this signal (step ST848). When the image update ends, the panel control signal generating unit 22*d* acquires the current time TIME from the timer 180, and stores the acquired time TIME in the register 25 as the image update end time END (step ST849). The image update determining unit 21*j* initializes u to 1 (step ST850).

As described above, by configuring and operating the display device with the memory function, the seventh embodiment can be applied to the fourth embodiment in which the source driver includes no temperature sensor, and the temperature of the source driver 150 can be maintained to be equal to or lower than the set temperature. In addition to the effects of the seventh embodiment described above, since the temperature sensor need not be installed in the source driver 150, the cost reduction effect coming from a reduction in the number of parts and the effect that the degree of freedom of housing design (for example, a compact housing) are obtained. The application example of the seventh embodiment described with reference to FIGS. 64 and 65 to the fourth embodiment can be applied to the third embodiment. In this case, the effect that a plurality of temperature sensors can be reduced is increased.

In the application of the seventh embodiment to the fourth embodiment, the temperature data 170 (FIG. 64) serving as the drop characteristics of the source driver temperature is provided, and thus as described above in the fourth embodiment, the source driver temperature Ts' can be calculated based on the temperature Tp of the display panel, the temperature PreTsx, and the image update interval (Tint). Here, Tint is a period of time until the image update signal 3 is acquired from the application processor 1 again after the image update ends. The source driver temperature increase Tsx can be expressed by the addition of Ts and Tα as in Formula (8), and Tα is decided according to the temperatures Tp and Ts and the driving waveform as illustrated in FIG. 67.

Here, when the driving waveforms (for example, the driving waveforms for the high temperature, the normal temperature, and the low temperature as illustrated in FIG. 67) configuring the u-th driving waveform group are dealt as the same driving waveform, that is, the driving waveform u in order to simplify the description, and Tα is indicated by a function Fα, the following Formula is obtained:

$$T\alpha = F\alpha(Ts, Tp, u) \tag{9}$$

If the set temperature is indicated by Tset, and Formulas (8) and (9) are used, there are cases in which the condition that the temperature Tsx is lower than the set temperature satisfies the following Formula:

$$Tset > Ts' + F\alpha(Ts', Tp, u) \tag{10}$$

Figure 66:
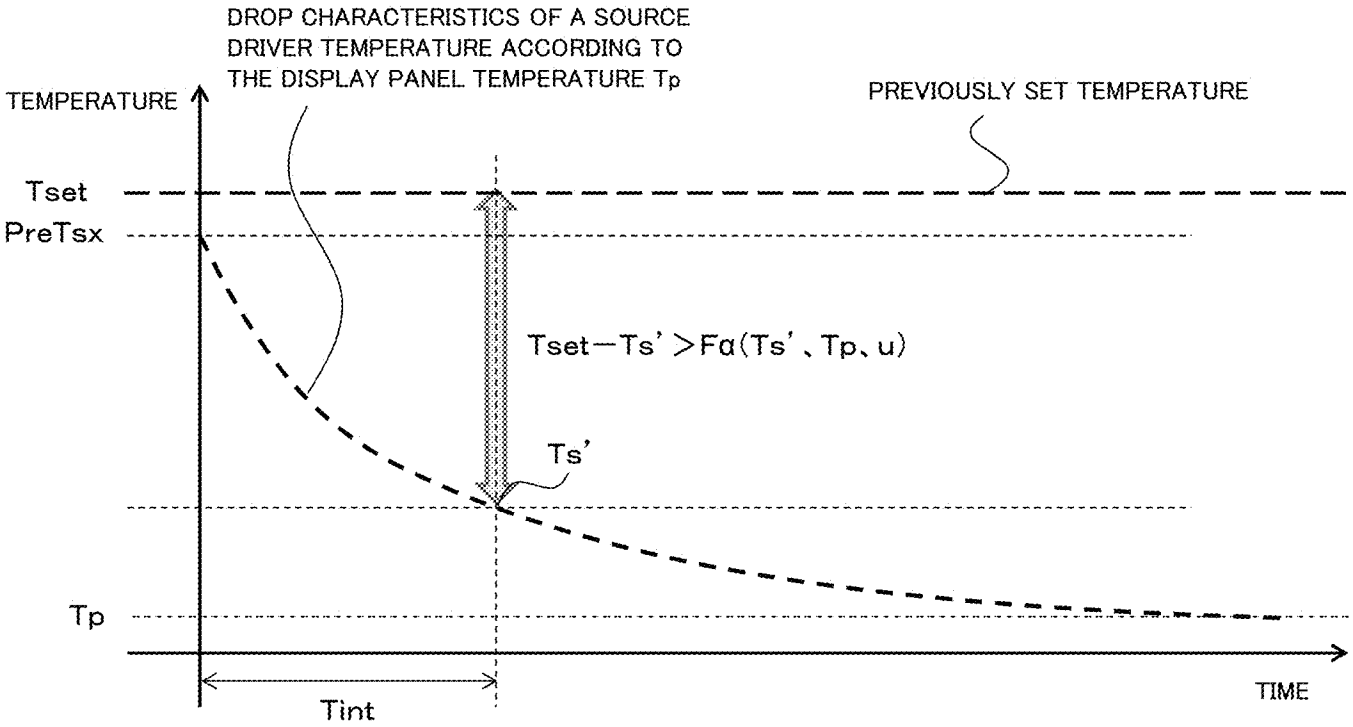
FIG. 66 is a diagram illustrating drop characteristics of a source driver temperature.

A relation of Formula (10) is illustrated in FIG. 66. Tset is a value that is set in advance, PreTsx is a value recorded in a register after the previous image update, and Tp is a value measured by the temperature sensor. Since Ts' is calculated based on Tint as described above, the value of u satisfying Formula (10) can be decided based on Tint.

For example, since Tsx can be calculated as illustrated in FIG. 67, a table in which one driving waveform is assumed in FIG. 67 as described above, a condition that the temperature Tsx is lower than the set temperature is described as "OK," and a condition that the temperature Tsx is equal to or higher than the set temperature is described as "NG" is generated. FIGS. 68A and 68B illustrate a specific example in which u=1 and a specific example in which u=2. This operation is performed by the number v of driving waveforms. It is desirable to generate and provide the table data for selecting the driving waveform u according to the display panel temperature Tp and the source driver temperature Ts from the table data. FIG. 69 illustrates an example in which v is 6.

Using FIG. 69, it is possible to decide the driving waveform u in which the temperature Tsx is lower than the set temperature Tset based on the temperature Tp measured by the temperature sensor and the temperature Ts (=Ts') calculated based on the interval Tint. Further, it is possible to decide the function Fa through fitting with the measurement value and calculate u using an inverse function of Fα.

Figure 70:
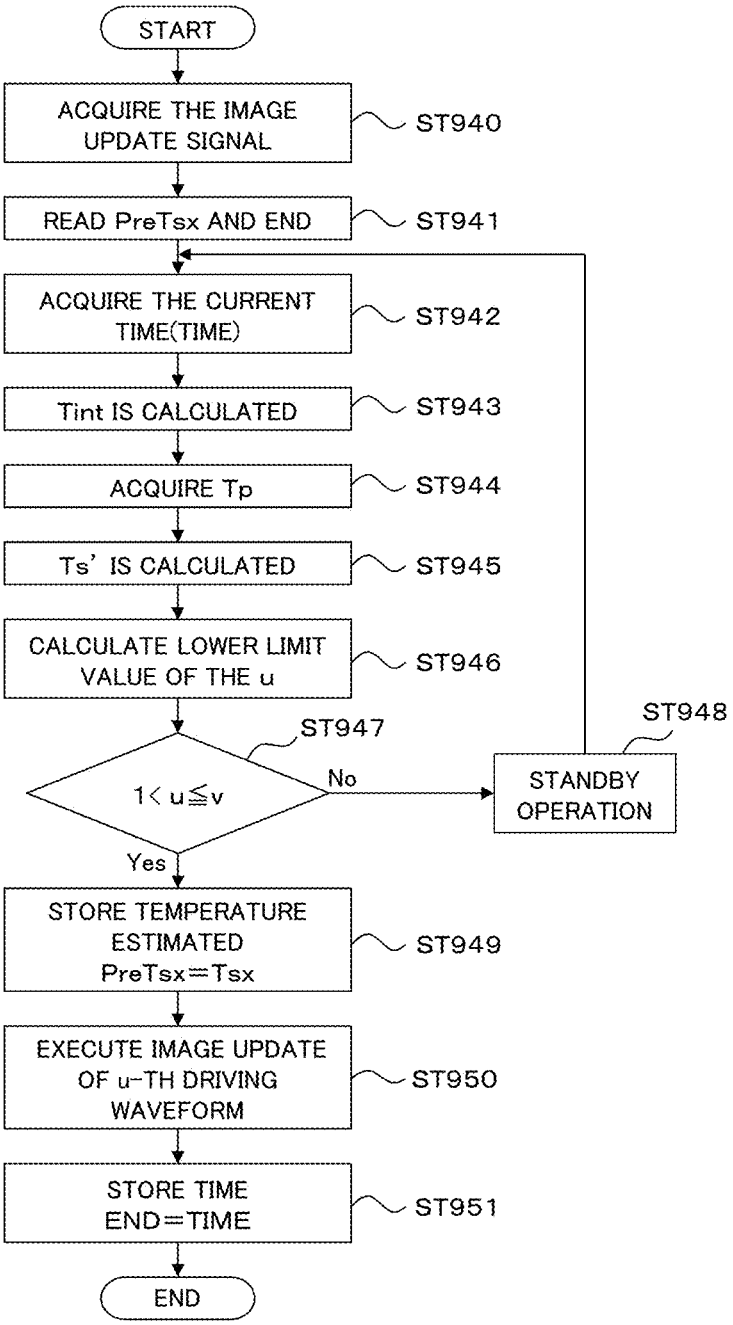
FIG. 70 is a flowchart for describing an operation of an image display control unit.

As described above, it is possible to implement the display device with the memory function obtained by applying the seventh embodiment to the fourth embodiment even using the display panel controller having the function of selecting the driving waveform based on the interval Tint. FIG. 70 illustrates a flowchart of the display panel controller in this case.

As illustrated in FIG. 70, the display panel controller acquires the image update signal 3 from the application processor 1 (step ST940), and reads the temperature PreTsx (the source driver temperature after the previous image update) and the time END (the end time of the previous image update) from the register (step ST941). Then, the current time TIME is acquired from the timer (step ST942). Then, the elapsed time Tint is calculated from END and TIME (step ST943). The display panel temperature Tp is acquired from the temperature sensor (step ST944). The current source driver temperature Ts' is calculated based on the temperature data indicating the relation between the source driver temperature that is measured in advance and the elapsed time illustrated in FIG. 33 and the interval Tint. At the time of an initial operation (there is no previous image update), the temperature Tp is included as the temperature Ts' (step ST944). u is calculated based on the set temperature Tset that is set in advance and the temperatures Ts' and Tp (step ST946). At the time of calculation of u, it is checked whether or not there is the calculated u among 1 to v driving waveforms included in the driving waveform data (step ST947). When the determination result of step ST947 is NO, the standby operation is performed during a predetermined period of time without performing the image update (step ST948). After the standby operation during the predetermined period of time, the process proceeds to step ST942, and the process of ST942 to ST948 is repeated until the determination result of step ST947 is YES. When the determination result of step ST947 is YES, the source driver temperature Tsx after the image update for the largest image load value is calculated in the u-th driving waveform to which a lower limit value of the calculated u is applied and stored in the register as the temperature PreTsx (step ST949). The image update according to the u-th driving waveform is performed (step ST950). When the image update ends, the current time TIME is acquired from the timer, and the acquired time TIME is stored in the register as the image update end time END (step ST951).

As described above, it is possible to decide the driving waveform used for the image update based on the data stored in the display panel controller in advance, the temperature Tp acquired from the temperature sensor, the temperature PreTsx stored in the register, and the time interval Tint of the image update. Further, in order to simplify the description, the driving waveforms configuring the u-th driving waveform group are dealt as the same driving waveform, that is, the driving waveform u, but it is possible to use the different driving waveform according to the temperature Tp, and it can be implemented by generating, for example, the table data illustrated in FIG. 69 such that the different driving waveforms are associated according to the temperature Tp.

Eighth Embodiment

Next, a terminal device employing the display device 70 with the memory function according to the first to fourth embodiments of the present invention will be described.

Figure 71:
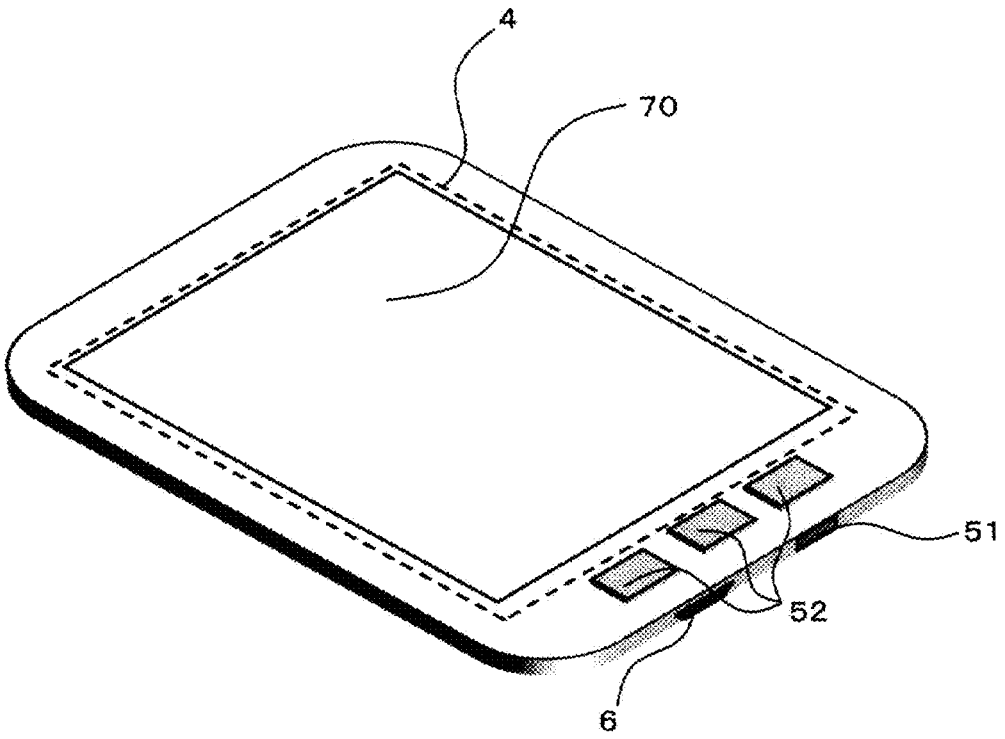
FIG. 71 is an external appearance diagram of an example of a terminal device employing the display device with the memory function according to the first embodiment.
Figure 72:
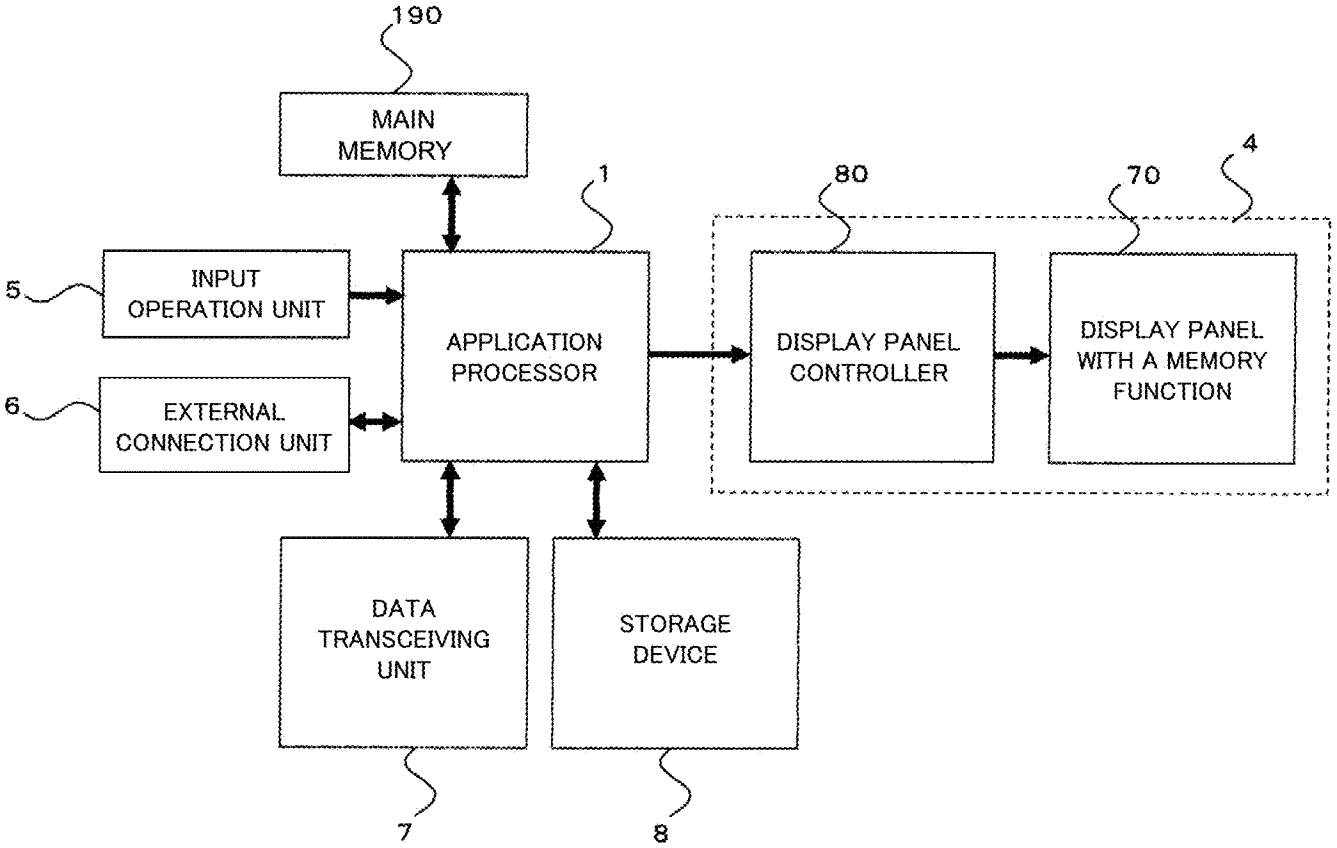
FIG. 72 is a block diagram for describing a configuration of the terminal device illustrated in FIG. 71.

FIG. 71 is an external appearance diagram of an example of a terminal device employing the display device with the memory function according to the first embodiment. FIG. 72 is a block diagram for describing a configuration of the terminal device illustrated in FIG. 71.

As illustrated in FIGS. 71 and 72, the terminal device of the present invention includes the application processor 1, the display device 4 with the memory function described above in the first embodiment, an input operation unit 5, an external connection unit 6, a data transceiving unit 7, a storage device 8, and a main memory 190.

The display device 4 is configured with the display panel 70 with the memory function and the display panel controller 80, and a detailed configuration of the display device 4 is the same as described above in the first embodiment.

The input operation unit 5 is a unit that transfers an operation desired by the user to the application processor 1 and configured with a power switch 51 and an operation switch group 52 according to an operation function as illustrated in FIG. 71. The operation switch group 52 is configured with a page forward button, a page backward button, a home button, and the like, for example, when the terminal device of the present invention is used as an electronic book terminal. The operation switch group 52 may further includes an additional operation switch to provide a function of inputting a character string or a number, and a touch panel (not illustrated) may be attached to the display panel 70 to substitute an arbitrary operation witch or all the operation switches (the operation switch group 52).

The external connection unit 6 is a cable-like connection unit between the terminal device and an external device and includes at least a power supply terminal. As a communication unit with the application processor 1, a cable connection terminal (connector) according to a communication specification may be provided as necessary.

The data transceiving unit 7 has a transmission function for requesting image data to be displayed on the display device 4 of the terminal device and a function of receiving data.

The storage device 8 has a unit that stores various kinds of data such as image data that is dealt with in the terminal device. The main memory 190 is configured with a ROM or a RAM used when the application processor 1 executes a process.

The display device 4 is configured with the display panel 70 with the memory function and the display panel controller 80.

Through the above configuration, the terminal device of the present invention displays the image data stored in the data transceiving unit 7 or the storage device 8 through the display device 4 according to a signal input from the application processor 1. Thus, the terminal device of the present invention cam maintain the temperature of the source driver 150 to be equal to or lower than the set temperature without deteriorating the display image quality as described above in the first embodiment, and the terminal device employing the reliable high-quality display device with the memory function can be implemented.

The terminal device of the eighth embodiment has been described as having the configuration using the display device 4 of the first embodiment, but the display device 4 of the modified example of the first embodiment, the display device 4*a* described above in the second embodiment, or the display device 4*d* described above in the fourth embodiment can be used. Further, the display device 4 to which the display panel controller to which the temperature predicting unit 10*b* and the image display control unit 20*b* described in the third embodiment are applied and the display panel 70*b* with the memory function are applied can be used.

The embodiments of the present invention have been described above with reference to the appended drawings, but the basic configuration of the present invention is not limited to the above embodiments, and a design change or the like within the scope not departing from the gist of the invention is also included in the invention.

For example, the example in which the microcapsule electrophoretic display element is used as the display element with the memory function has been described, but the present invention is not limited thereto, and, for example, a microcup electrophoretic element, an electric liquid powder element, a cholesteric liquid crystal, an electrochromic element, a twisting ball, or the like may be used.

The display panel with the memory function has been described as being configured with the source driver and the gate driver, but a driver having both functions of the source driver and the gate driver may be used. The source driver may be mounted on the display panel through tape automated. bonding (TAB) mounting or chip on glass (COG) mounting or may be a circuit configured on a TFT glass substrate using TFTs.

The display panel with the memory function has been mainly described as a monochrome display panel but may be a color display panel using a color filter. For example, the white pigments 117 and the black pigments 118 serving as the charged particles may be replaced with pigments of complementary colors such as red, green, and blue. Through such a modification, red, green, blue, and the like can be displayed.

Further, the present invention include an appropriate combination of some or all components of the above embodiments. For example, a function of calculating a standby time may be generated using the data of the temperature drop characteristics of the source driver 150 and the timer described above in the fourth embodiment and applied to the other embodiments.

The present invention can be widely applied to an electronic paper display device such as a public display, an electronic book terminal, or an electronic newspaper.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention(s) has(have) been described in detail, it should be understood that the various changes, substitutions, and alterations could be made hereto without departing from the spirit and scope of the invention.

What is claimed is:

1. A display device with a memory function, comprising:

a first substrate on which a plurality of pixels, each of which includes a switching element and a pixel electrode, are arranged in a matrix form, and a source line for applying a predetermined signal to the switching element, and a scanning line for controlling the switching element are arranged;

a second substrate on which an opposite electrode is formed;

a display layer that is interposed between the first substrate and the second substrate and configured with a display element with a memory function;

a driver that is configured to output a predetermined signal to the source line; and a controller configured to:

acquire a temperature of the driver;

measure an elapsed time after an image update operation;

store a plurality of driving waveforms in a storage, where the plurality of driving waveforms include voltages of respective frames to be applied to the pixel electrode for all gradation numbers when the pixels are set to perform a predetermined gradation display, and the plurality of driving waveforms are configured with a different number of frames and are specified so that the rising temperature of the driver after an image update is different;

select one driving waveform specified to keep a temperature of the driver, after the image update, below a set temperature from the plurality of driving waveforms stored in the storage based on the temperature and the elapsed time; and execute an image update according to the selected driving waveform.

2. The display device with the memory function according to claim 1, further comprising:

a temperature sensor that is configured to measure a temperature of the display layer; and temperature drop characteristics data of the driver, wherein the controller is further configured to acquire the temperature of the driver that is calculated based on the temperature measured by the temperature sensor, the temperature drop characteristics data of the driver, and the elapsed time.

3. A terminal device configured to use the display device with the memory function according to claim 1.

4. A driving method of a display device with a memory function which comprises:

a first substrate on which a plurality of pixels, each of which includes a switching element and a pixel electrode, are arranged in a matrix form, and a source line for applying a predetermined signal to the switching element and a scanning line for controlling the switching element are arranged, a second substrate on which an opposite electrode is formed, a display layer that is interposed between the first substrate and the second substrate and configured with a display element with a memory function, and a driver that outputs a predetermined signal to the source line, the driving method comprising:

acquiring a temperature of the driver;

measuring an elapsed time after an image update operation;

selecting one driving waveform specified to keep a temperature of the driver after the image update below a set temperature from a plurality of driving waveforms based on the temperature and the elapsed time, where the plurality of driving waveforms include voltages of respective frames to be applied to the pixel electrode for all gradation numbers when the pixels are set to perform a predetermined gradation display, and the plurality of driving waveforms are configured with different numbers of frames and are specified so that the rising temperature of the driver after an image update is different; and executing an image update according to the selected driving waveform.

* * * * *